US006440650B1

(12) United States Patent
Matsuda et al.

(10) Patent No.: US 6,440,650 B1
(45) Date of Patent: Aug. 27, 2002

(54) SILVER HALIDE COLOR REVERSAL PHOTOSENSITIVE MATERIAL AND COLOR IMAGE FORMING METHOD USING THE SAME

(75) Inventors: Naoto Matsuda; Hisashi Mikoshiba, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 90 days.

(21) Appl. No.: 09/708,684

(22) Filed: Nov. 9, 2000

(30) Foreign Application Priority Data

Nov. 10, 1999 (JP) ..... 11-319800

(51) Int. Cl.[7] ..... G03C 7/46

(52) U.S. Cl. ..... 430/379; 430/378; 430/567; 430/502; 430/505; 430/558

(58) Field of Search ..... 430/378, 379, 430/567, 558, 502, 505

(56) References Cited

U.S. PATENT DOCUMENTS 5,262,287 A * 11/1993 Deguchi et al. ..... 430/379
5,389,507 A * 2/1995 Chen et al. ..... 430/567
5,492,796 A * 2/1996 Ogiyama et al. ..... 430/558
5,846,698 A * 12/1998 Ogiyama et al. ..... 430/558
6,346,368 B1 * 2/2002 Irie ..... 430/379

FOREIGN PATENT DOCUMENTS

JP A63285548 11/1988

* cited by examiner

*Primary Examiner*—Geraldine Letscher
(74) *Attorney, Agent, or Firm*—Birch, Stewart, Kolasch & Birch, LLP

(57) ABSTRACT

A silver halide color reversal photosensitive material comprising at least one blue-sensitive emulsion layer, at least one green-sensitive emulsion layer, and at least one red-sensitive emulsion layer on a transparent support, and capable of forming a color image when the photosensitive material was subjected to color development in the presence of an aromatic primary amine color developing agent after the photosensitive material was subjected to first development of black-and-white development, wherein the silver halide content in the photosensitive material before the first development is 2.5 to 6.0 g in terms of silver per $m^2$ of the photosensitive material, the silver halide content in an unexposed portion of the photosensitive material immediately before the color development is 1.0 to 2.5 g in terms of silver per $m^2$ of the photosensitive material, and the maximum density of each of cyan, magenta, and yellow in the color image after the color development is 3.0 or more.

19 Claims, No Drawings

SILVER HALIDE COLOR REVERSAL PHOTOSENSITIVE MATERIAL AND COLOR IMAGE FORMING METHOD USING THE SAME

CROSS-REFERENCE TO RELATED APPLICATIONS

This application is based upon and claims the benefit of priority from the prior Japanese Patent Application No. 11-319800, filed Nov. 10, 1999, the entire contents of which are incorporated herein by reference.

BACKGROUND OF THE INVENTION

The present invention relates to a silver halide color reversal photographic lightsensitive material, hereinafter photographic lightsensitive material is also referred to as "photosensitive material", and a color image forming method using the same.

Color reversal films are transmitting materials, have high picturing capacity and good color reproduction resulting from a wide density dynamic range (common color reversal films are designed to have a transmission density of 3.0 or more in standard processing), and have high resolving power based on high graininess-sharpness. Hence, color reversal films are extensively used in various purposes from printing to color photographs requiring high quality. A development process of color reversal film photosensitive materials includes first development—reversal processing—color development, and a subsequent desilvering step. Compared to other color image forming methods (e.g., color paper and color negative films), the replenisher volume of a processing solution in the development step is larger, and the time of this processing step is longer.

To reduce the development time (e.g., the time of color development), a silver halide must be developed faster. However, the development rate of a silver halide is roughly determined by its halogen composition. Also, this halogen composition is determined in accordance with the sensitivity or the ease of spectral sensitization or in order to use the interimage effect produced in development. Therefore, the development rate of a silver halide cannot be easily changed.

One obstacle to shortening the color development time is that the maximum density of cyan lowers when the color development time is shortened. As a countermeasure against this problem, Jpn. Pat. Appln. KOKAI Publication No. (hereinafter referred to as JP-A-)63-285548 has disclosed a method of reducing the color development time by the use of a photosensitive material in which the silver coating amount is 3.5 to 12 g per $m^2$ of the material and a silver halide emulsion in each low-speed layer is a monodisperse emulsion.

The present inventors made extensive studies on methods of reducing the color development time including this method disclosed in JP-A-63-235548, and have found that another approach required for recent development processing is to reduce the replenishment of a developer, and that when the replenishment rate of a color developer is reduced the color development time cannot be shortened only by the use of monodisperse emulsions as disclosed in JP-A-63-285548. This is a problem still difficult to solve. Another problem when the color development time is shortened is that uneven color generation produced in the processing step worsens. The method disclosed in JP-A-63-295548 cannot well improve this problem. Hence, the color development time is difficult to reduce also in respect of processing nonuniformity.

BRIEF SUMMARY OF THE INVENTION

It is an object of the present invention to provide a color reversal photosensitive material suitable for reducing the time or replenishment amount of a development step and having small processing nonuniformity, and a color image forming method using the same.

The object of the present invention was achieved by the following photosensitive materials.

(1) A silver halide color reversal photosensitive material comprising at least one blue-sensitive emulsion layer, at least one green-sensitive emulsion layer, and at least one red-sensitive emulsion layer on a transparent support, and capable of forming a color image when the photosensitive material was subjected to color development in the presence of an aromatic primary amine color developing agent after the photosensitive material was subjected to first development of black-and-white development, wherein the silver halide content in the photosensitive material before the first development is 2.5 to 6.0 g in terms of silver per $m^2$ of the photosensitive material, the silver halide content in an unexposed portion of the photosensitive material immediately before the color development is 1.0 to 2.5 g in terms of silver per $m^2$ of the photosensitive material, and the maximum density of each of cyan, magenta, and yellow in the color image after the color development is 3.0 or more.

(2) The color reversal photosensitive material described in item (1) above, wherein at least one of the green- and red-sensitive emulsion layers contains a 2-equivalent coupler, and the molar ratio of this 2-equivalent coupler to all image-forming couplers contained in the photosensitive emulsion layer is 30% to 100%.

(3) The color reversal photosensitive material described in item (1) above, wherein the photosensitive material contains at least one magenta coupler represented by formula (MC-I) below or at least one cyan coupler represented by formula (CC-I) below, and the molar ratio of the coupler to all image-forming couplers in the photosensitive emulsion layer containing the magenta coupler or the cyan coupler is 30% to 100%.

(MC-I)

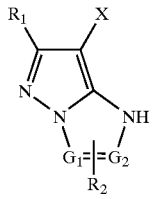

wherein $R_1$ represents a hydrogen atom or a substituent; one of $G_1$ and $G_2$ represents a carbon atom, the other represents a nitrogen atom; and $R_2$ represents a substituent and bounds to one of $G_1$ and $G_2$ which is a carbon atom. $R_1$ and $R_2$ can further have a substituent. A polymer of formula (MC-I) can be formed via $R_1$ or $R_2$, or the coupler represented by formula (MC-I) can be bonded to a polymeric chain via $R_1$ or $R_2$. X represents a hydrogen atom or a group which splits off by a coupling reaction with an oxidized form of the aromatic primary amine color developing agent.

(CC-I)

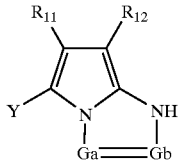

In formula (CC-I), $G_a$ represents —C($R_{13}$)═ or —N═, provided that when $G_a$ represents —N═, $G_b$ represents —C($R_{13}$)═, and when $G_a$ represents —C($R_{13}$)═, $G_b$ represents —N═. $R_{13}$ represents a substituent.

Each of $R_{11}$ and $R_{12}$ represents an electron attracting group having a Hammett substituent constant σp value of 0.20 to 1.0. Y represents a hydrogen atom or a group which splits off by a coupling reaction with the oxidized form of the aromatic primary amine color developing agent.

(4) A color image forming method comprising a step of black-and-white development, a step of reversal processing and then a step of color development, wherein the photosensitive material described in one of items (1) to (3) above is subjected to the step of color development with a development time of 1 to 5 min.

(5) A color image forming:method comprising a step of black-and-white development, a step of reversal processing and then a step of color development, wherein the photosensitive material described in one of items (1) to (3) above is subjected to the step of color development in which a replenishment amount of a color developer is set to 1.0 L or less per $m^2$ of a processing area of the photosensitive material.

DETAILED DESCRIPTION OF THE INVENTION

The present invention will be described in detail below.

The silver halide color reversal photosensitive material of the present invention has the maximum density of each of yellow, magenta, and cyan of a color image of 3.0 or more. This determination of the density is done by performing Development Process A described in Example 1 of the specification to an unexposed photosensitive material and measuring the color image density (status A) after the processing. The Development Process A in the determination is conducted after running is performed with a photosensitive material to be determined whose 40% in an area ratio was fully exposed to light, until the replenishment amount of the first development becomes three times the tank volume.

A feature of the photosensitive material of the present invention is that the content of a silver halide before the first development is 2.5 to 6.0 g in terms of silver per $m^2$ of the material. Another feature of the photosensitive material of the invention is that the silver halide content in an unexposed portion of the material after the black-and-white development and the reversal processing and immediately before the color development is 1.0 to 2.5 g in terms of silver per $m^2$ of the material.

These silver halide contents in terms of silver amounts are obtained as follows.

Three same photosensitive materials are prepared, and each photosensitive material is subjected to silver amount measurements (i), (ii) to (iv), and (v) to (viii) below, respectively. (Silver halide content before first development)

The following processing is performed at 38° C. except for a drying step.

(i) The amounts of all silver compounds such as a silver halide and metal silver contained in a first unexposed photosensitive material are obtained by a fluorescence x-ray method (a silver amount A).

(ii) A second photosensitive material that remains unexposed is fixed by a fixer having the following formulation and subsequently washed with water.

<Fixer>

| | |
|---|---|
| Ammonium thiosulfate | 80 g |
| Sodium sulfite | 5.0 g |
| Sodium bisulfite | 5.0 g |
| Water to make | 1,000 mL |
| pH | 6.60 |

The pH is adjusted by acetic acid or ammonia water.

The processing time is 4 min, and then, the processed material is washed with running water for 4 min, and dried (at 50° C. for 30 min).

(iii) The silver amount contained in the photosensitive material thus processed in accordance with (ii) is measured as in the above item (i) (a silver amount B). ( iv) (Silver amount A)-(silver amount B) is defined as the content (in terms of silver amount) of a silver halide before first development. (Silver halide content in an unexposed portion immediately before color development)

(v) A third photosensitive material that remains unexposed is processed as follows.

<First Developer; Processing Time 6 Min>

| | |
|---|---|
| Nitrilo-N,N,N-trimethylenephosphonic acid-pentasodium salt | 1.5 g |
| Diethylenetriaminepentaacetic acid pentasodium salt | 2.0 g |
| Sodium sulfite | 30 g |
| Hydroquinone-mono sulfonic acid, potassium salt | 20 g |
| Potassium carbonate | 15 g |
| Potassium bicarbonate | 12 g |
| 1-phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethyleneglycol | 13 g |
| Water to make | 1,000 mL |
| pH | 9.60 |

The pH is adjusted by sulfuric acid or potassium hydroxide.

<Washing; Processing Time 2 Min>

<Reversal Solution; Processing Time 2 Min>

| | |
|---|---|
| Nitrilo-N,N,N-trimethylenephosphonic acid-pentasodium salt | 3.0 g |
| Stannous chloride-dihydrate | 1.0 g |
| p-aminophenol | 0.1 g |
| Sodium hydroxide | 8 g |
| Glacial acetic acid | 15 mL |
| Water to make | 1,000 mL |
| pH | 6.00 |

The pH is adjusted by acetic acid or sodium hydroxide.

<Washing; Processing Time 2 Min>

(vi) The thus processed third material is desilvered by the same fixer as in the above item (ii).

(vii) The silver amount of the thus desilvered material is measured as in the above item (iii) (a silver amount C).

(viii) (Silver amount A)-(silver amount C) is defined as the silver halide content (in terms of silver amount) at an unexposed portion immediately before color development.

The silver halide content immediately before color development of the photosensitive material of the present invention is 1.0 to 2.5 g, preferably 2.3 g or less, and more preferably, 2.1 g or less in terms of silver per $m^2$ of the material.

Also, the silver halide content of the photosensitive material before first development of the present invention is 2.5 to 6.0 g, preferably 2.5 to less than 4.0 g, and more preferably, 2.5 to less than 3.5 g in terms of silver per $m^2$ of the material.

In the present invention, it is preferable that the silver halide content of the photosensitive material before first development is 2.5 to less than 4.0 g in terms of silver per $m^2$ of the material, and the silver halide content in an unexposed portion immediately before color development is 2.3 g or less in terms of silver per $m^2$ of the material. The silver halide content in an unexposed portion immediately before color development is more preferably 40% to 75% of the silver halide content before first development.

In the present invention, means for achieving the silver halide content in the photosensitive material before first development and the silver halide content in an unexposed portion immediately before color development described above can be any means.

In a common color reversal photosensitive material, fog occurs in first development even in an unexposed portion. The relationship between the silver halide amounts specified in the present invention can be met by controlling the coating amounts of silver halide emulsions and the degree of this fog.

An example of a method of increasing the amount of fog in first development is to add colloidal silver grains or previously fogged silver halide grains to a photosensitive emulsion layer or a non photosensitive interlayer.

In the present invention, it is preferable to add colloidal silver grains or previously fogged silver halide grains to a photosensitive emulsion layer.

The colloidal silver that is capable of using can be prepared by methods described in, e.g., U.S. Pat. Nos. 2,688,601 and 3,459,563. The colloidal silver that is capable of using in the present invention can have any color such as yellow, red, or black. When the colloidal silver is added to a photosensitive emulsion layer, the silver molar ratio of the colloidal silver to a silver halide contained in the photosensitive emulsion layer is preferably 0.01% to 10%, and more preferably, 0.05% to 5%. When the colloidal silver is added to an interlayer, the silver molar ratio of the colloidal silver to a silver halide in a photosensitive emulsion layer directly adjacent to the interlayer is preferably 0.1% to 30%, and more preferably, 0.5% to 20%.

In the present invention, the use of previously fogged silver halide grains is also preferred. A previously fogged silver halide emulsion grain is a silver halide emulsion grain whose interior or surface is previously fogged, and is a non photosensitive silver halide grain which can be developed non-imagewise regardless of whether a photosensitive material is unexposed or exposed. When the previously fogged silver halide emulsion grains are added to a photosensitive emulsion layer, the silver molar ratio of the grains to a silver halide contained in the photosensitive emulsion layer is preferably 1% to 30%, and more preferably 3% to 15%. When the previously fogged silver halide emulsion grains are added to an interlayer, the silver molar ratio of the grains to a silver halide in a photosensitive emulsion layer directly adjacent to the interlayer is preferably 5% to 50% and, more preferably, 10% to 30%.

The surface-fogged silver halide emulsion that is capable of using in the present invention can be prepared by a method of adding a reducing agent or gold salt to an emulsion capable of forming a surface latent image at an appropriate pH and pAg, a method of heating at a low pAg, or a method of giving uniform exposure. Examples of the reducing agent are stannous chloride, a hydrazine compound, and ethanol amine.

In the surface-fogged emulsion, any silver halide such as silver chloride, silver bromide, silver chlorobromide, silver iodobromide, or silver bromochloroiodide can be used. In the present invention, however, silver iodobromide or silver bromochloroiodide is preferred. Although the grain size is not particularly limited, an average grain size, which is an equivalent sphere diameter, is preferably 0.01 to 0.75 $\mu$m, and particularly preferably, 0.05 to 0.6 $\mu$m.

An internally fogged silver halide emulsion grain is a core-shell type grain consisting of a surface-fogged silver halide core and a silver halide shell covering the surface of the core.

In the present invention, the use of surface-fogged silver halide emulsion grains is preferred.

In the present invention, more favorable results are obtained when colloidal silver is used than when fogged silver halide emulsion grains are used. It is also preferable to add colloidal silver grains to a photosensitive emulsion layer.

In the present invention, any coupler can be used provided that a color image having a maximum density of 3.0 or more is given, and an arbitrary coupler coating amount can be selected. However, a coupler by which the density of a formed dye per mol of silver is low increases the coating amount thereof and deteriorates the sharpness or the physical strength of the photosensitive material. Therefore, it is preferable to use a magenta coupler and cyan coupler meeting at least one of the following requirements:

(i) Two-equivalent coupler, (ii) Magenta coupler represented by formula (MC-I), and (iii) Cyan coupler represented by formula (CC-I).

In particular, at least one magenta coupler represented by formula (MC-I) or at least one cyan coupler represented by formula (CC-I) is preferably contained. It is more preferable that at least one magenta coupler represented by formula (MC-I) and at least one cyan coupler represented by formula (CC-I) are contained.

Couplers preferably used in the present invention will be described in more detail below.

First, 2-equivalent couplers will be explained.

2-equivalent cyan couplers and 2-equivalent magenta couplers preferably used in the present invention can be any couplers as long as they are 2-equivalent couplers.

A 2-equivalent coupler is a coupler whose coupling position is substituted by a group which can split off as an anion by a coupling reaction with the oxidized form of an aromatic primary amine color developing agent.

Examples of 2-equivalent magenta couplers favorable to the present invention are 2-equivalent couplers of couplers represented by formula (2M-I) below and formula (MC-I) to be described later. Examples of 2-equivalent cyan couplers favorable to the present invention are 2-equivalent couplers of couplers represented by formula (2C-I) or (2C-II) below and formula (CC-I) to be described later.

(2M-I)

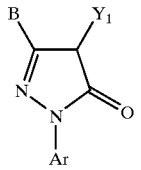

(2C-I)

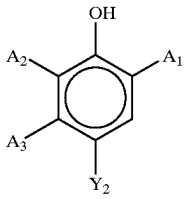

(2C-II)

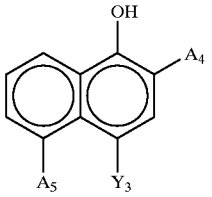

Formula (2M-I) will be described first. In formula (2M-I), Ar represents a substituted or nonsubstituted phenyl group, B represents a substituent, $Y_1$ represents a group which can split off as an anion by a coupling reaction with the oxidized form of an aromatic primary amine color developing agent.

Examples of a split-off group represented by $Y_1$ are groups, except for a hydrogen atom, enumerated in the explanation of X in formula (MC-I) to be described later. $Y_1$ is preferably an arylthio group or a nitrogen-containing heterocyclic group which bonds to the coupling position by a nitrogen atom. $Y_1$ is more preferably a substituted or nonsubstituted phenylthio group, substituted or nonsubstituted pyrazole, 1,2,4-triazole, or 1,2,3-triazole group.

Ar represents a substituted or nonsubstituted phenyl group. Ar is preferably a nonsubstituted phenyl group or a phenyl group substituted by at least one chlorine atom or fluorine atom. Ar is more preferably a phenyl group substituted by two or three chlorine atoms or fluorine atoms.

B represents a substituent. Examples are groups enumerated as examples of $R_2$ in formula (MC-I) to be described later. B is preferably an anilino group or acylamino group, and more preferably, an anilino group or acylamino group having a total number of carbon atoms of 10 to 50.

Practical compound examples of a coupler represented by formula (2M-I) will be presented below. However, the present invention is not limited to these examples.

2M-(1)

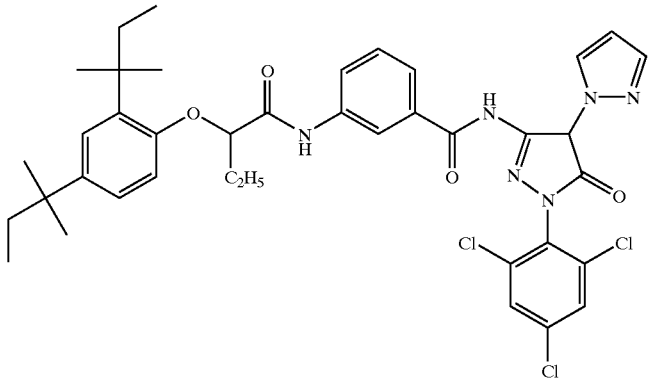

2M-(2)

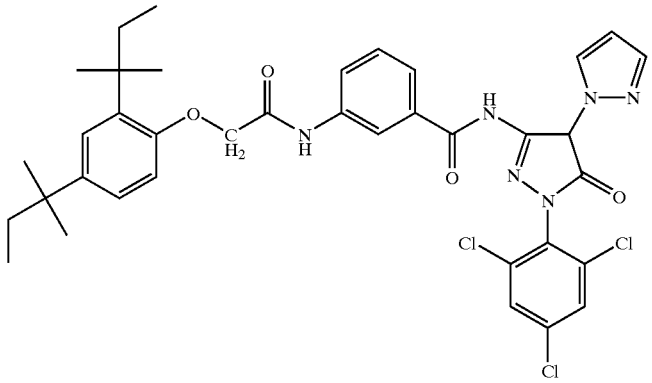

-continued
2M-(3)
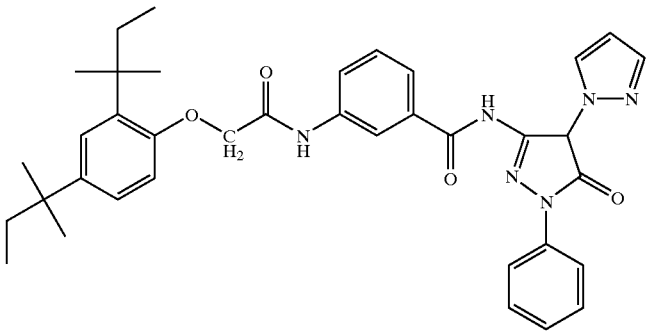
2M-(4)
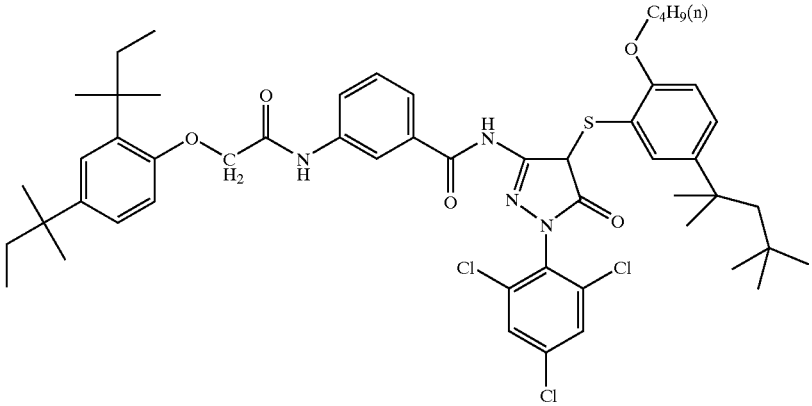
2M-(5)
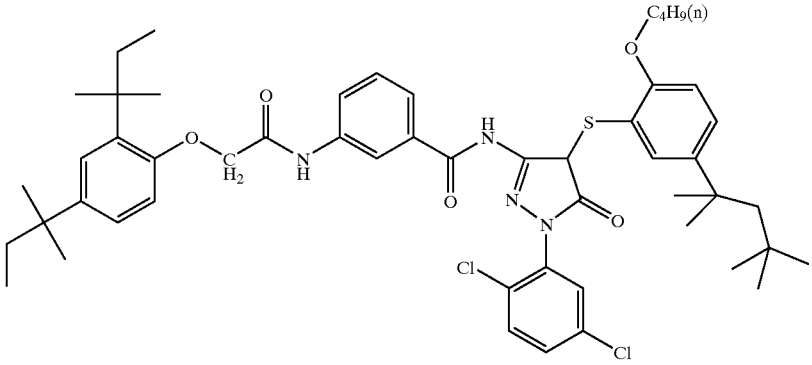
2M-(6)
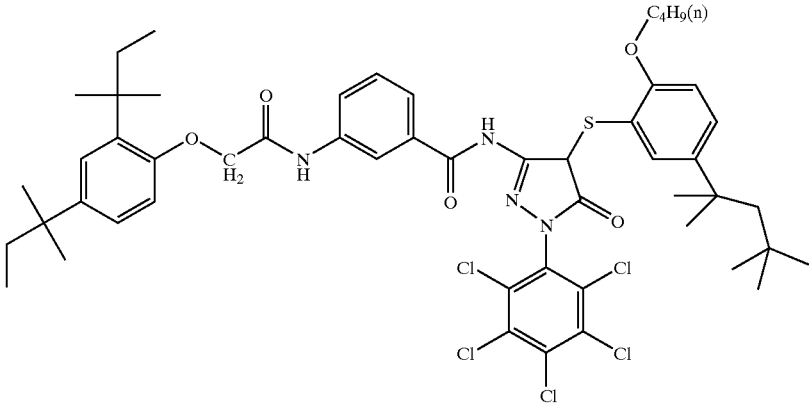

-continued
2M-(7)
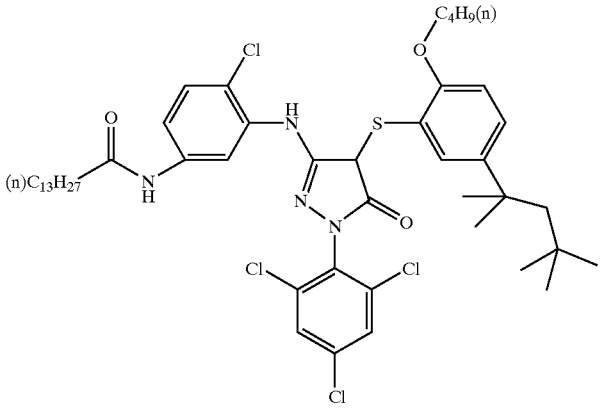
2M-(8)
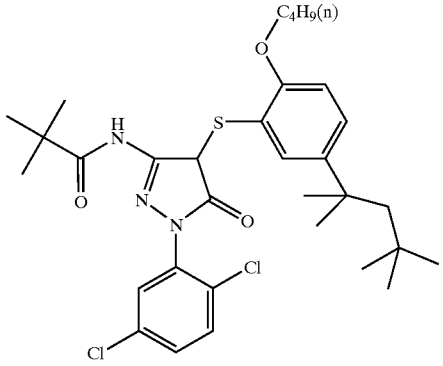
2M-(9)
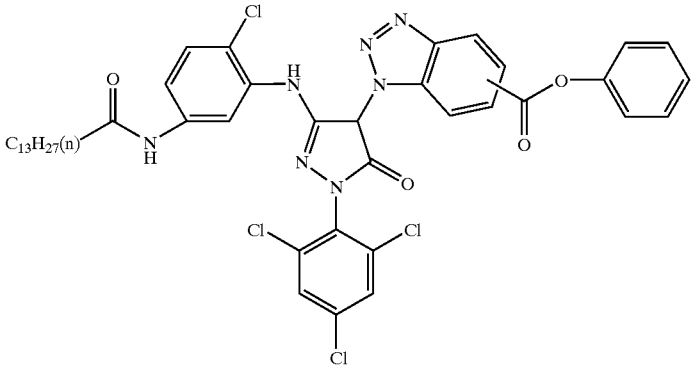
2M-(10)
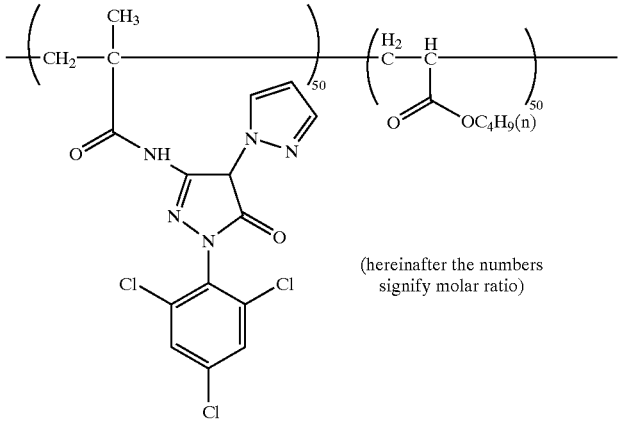
(hereinafter the numbers signify molar ratio)

-continued 2M-(11)

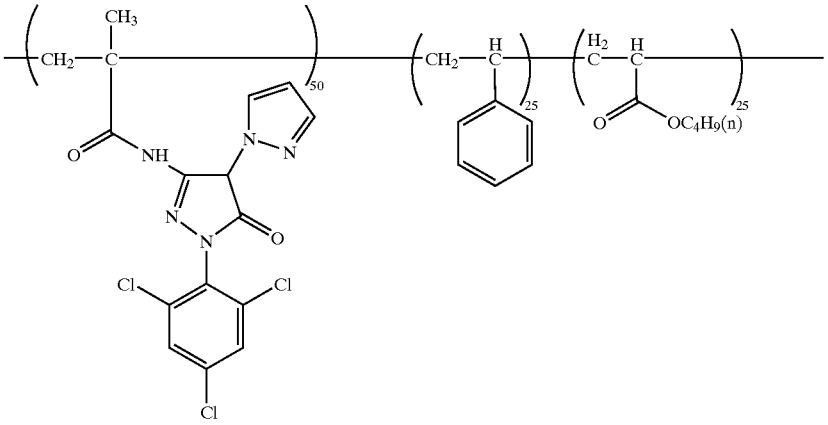

2M-(12)

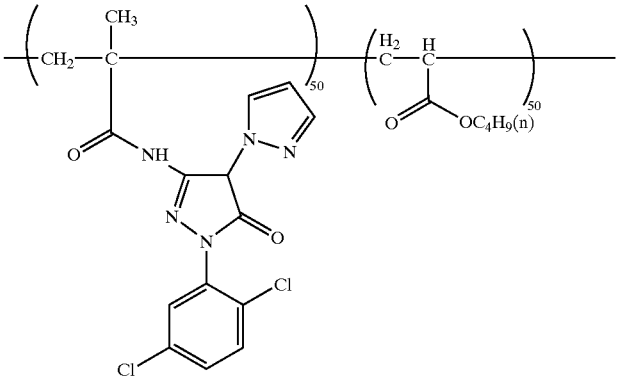

2M-(13)

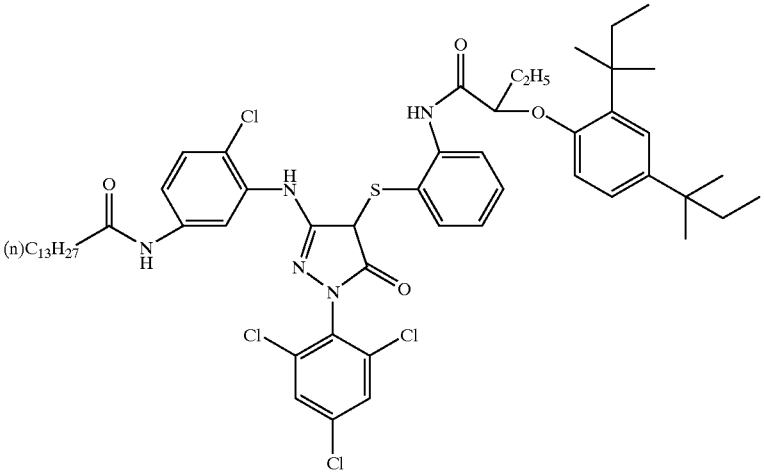

Formula (2C-I) will be described next.

In formula (2C-I), $Y_2$ represents a split-off group. Examples are those, except for a hydrogen atom, enumerated in the explanation of X in formula (MC-I) to be described later. In formula (2C-I), $Y_2$ is preferably a halogen atom, alkylthio group, arylthio group, alkoxy group, aryloxy group, acyloxy group, carbamoyloxy group, alkoxycarbonyloxy group, or arylcarbonyloxy group, more preferably, a halogen atom, and most preferably, a chlorine atom.

$A_1$ represents a substituent selected from an acyl group, acyloxy group, and acylamino group. These substituents can further have a substituent. $A_1$ is preferably an acyl group or acylamino group, and more preferably, an acylamino group, $A_2$ represents a hydrogen atom or substituent. Examples of the substituent are those enumerated as examples of $R_2$ in formula (MC-I) to be described later. $A_2$ is preferably a hydrogen atom or halogen atom, and a chlorine atom is preferable as a halogen atom.

$A_3$ represents a substituent. Examples are those enumerated as examples of $R_2$ in formula (MC-I) to be described later. $A_3$ is preferably an alkyl group, acylamino group, alkoxycarbonylamino group, or carbamoyloxy group.

A preferred example of a coupler represented by formula (2C-I) is a coupler in which $A_1$ is an acylamino group substituted by at least two fluorine atoms, $A_2$ is a hydrogen atom, $A_3$ is an acylamino group or carbamoyloxy group each having a total number of carbon atoms of 10 to 50, and $Y_2$ is a chlorine atom, or a coupler in which $A_1$ is an acylamino group having a total number of carbon atoms of 10 to 50, $A_2$ is a chlorine atom, $A_3$ is a 1- to 3-carbon alkyl group, and $Y_2$ is a chlorine atom.
Practical examples of a coupler represented by formula (2C-I) will be presented below. However, the present invention is not limited to these examples.
2C-(1)
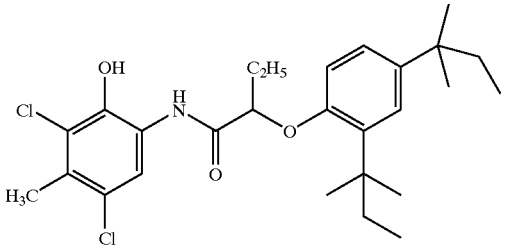
2C-(2)
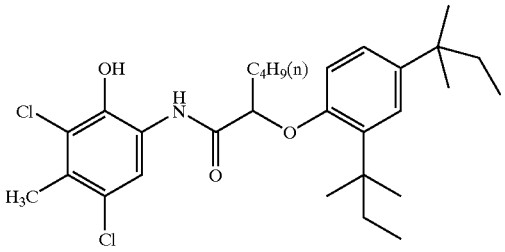
2C-(3)
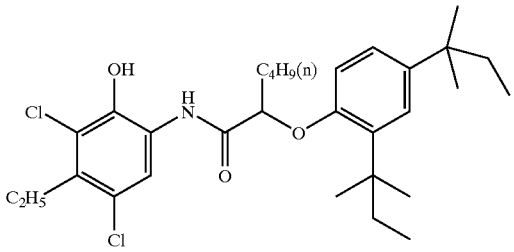
2C-(4)
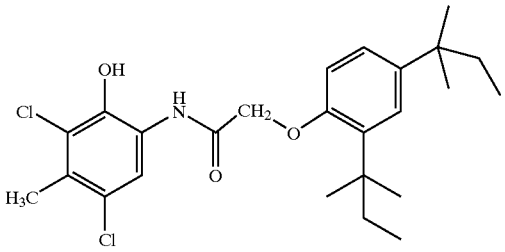
2C-(5)
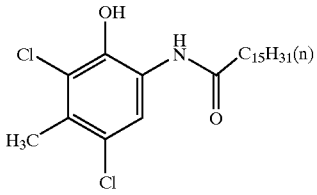
-continued
2C-(6)
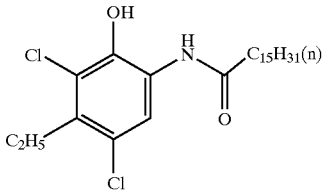
2C-(7)
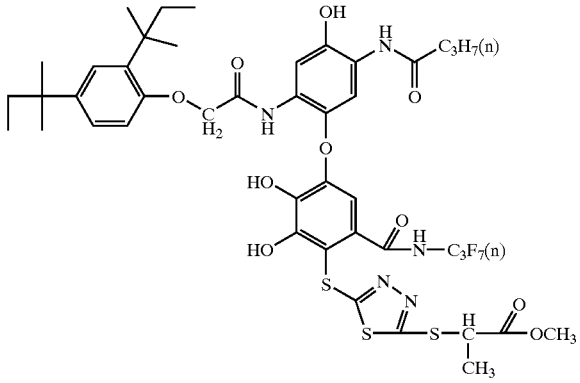
2C-(8)
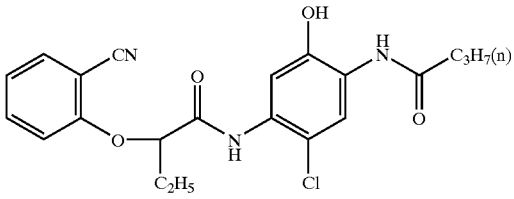
2C-(9)
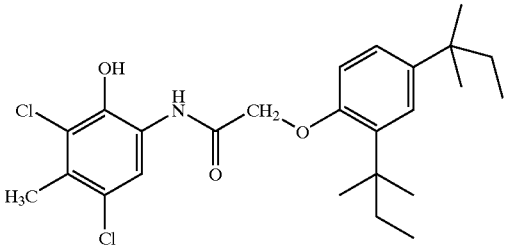
2C-(10)
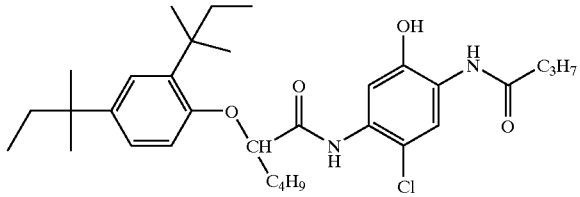
2C-(11)
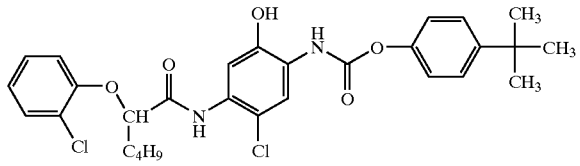

-continued
2C-(12)
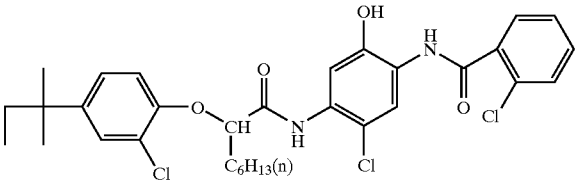
2C-(13)
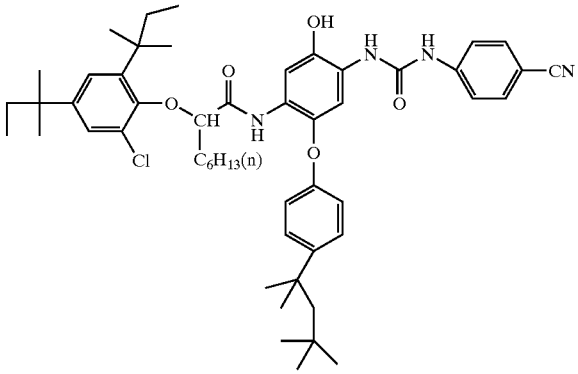
2C-(14)
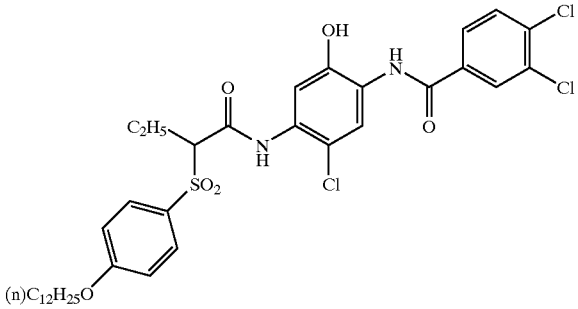
2C-(15)
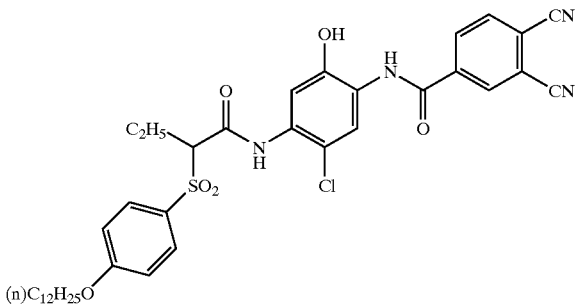
2C-(16)
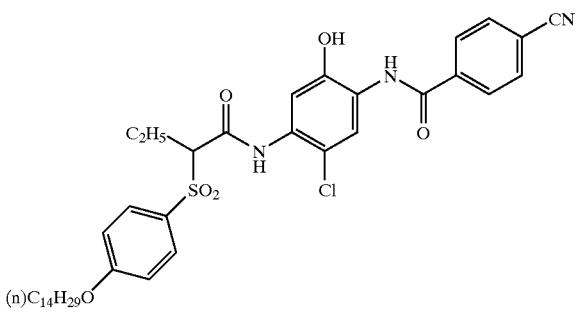
-continued
2C-(17)
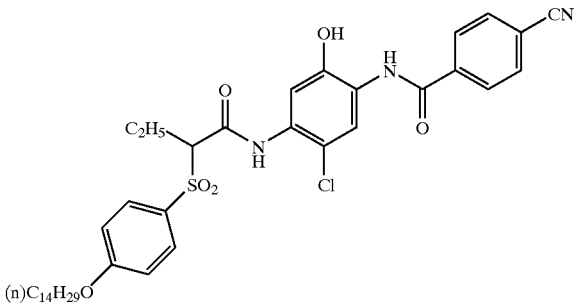
2C-(18)
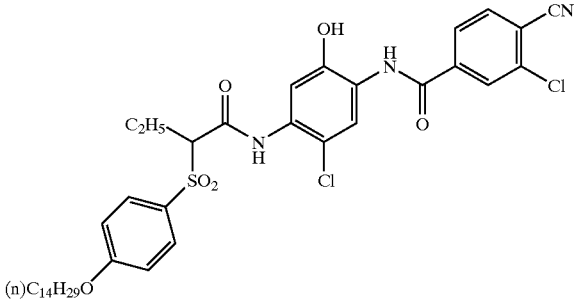
2C-(19)
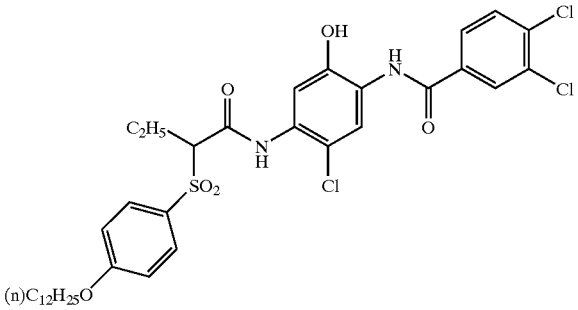
2C-(20)
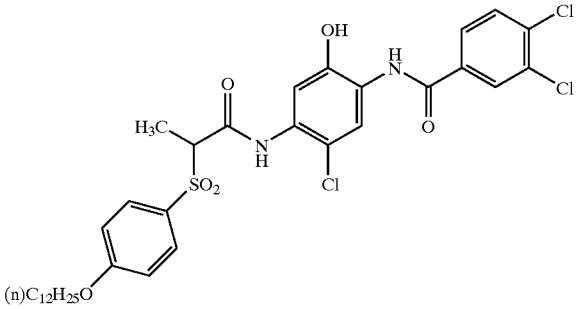

-continued 2C-(21)

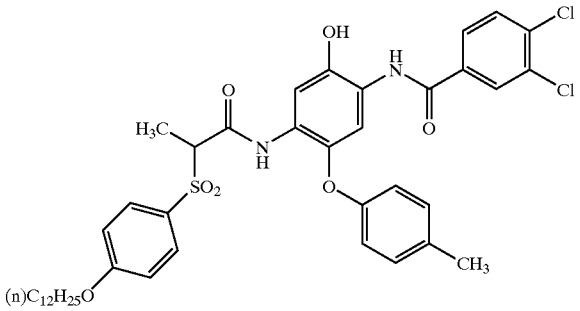

2C-(22)

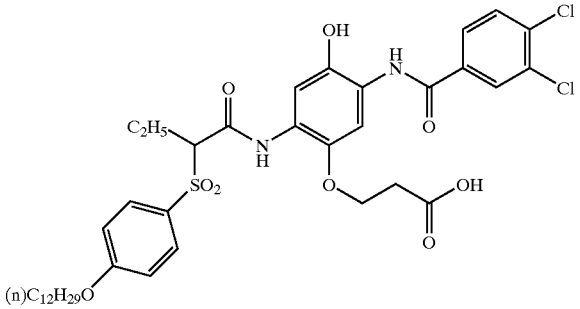

2C-(23)

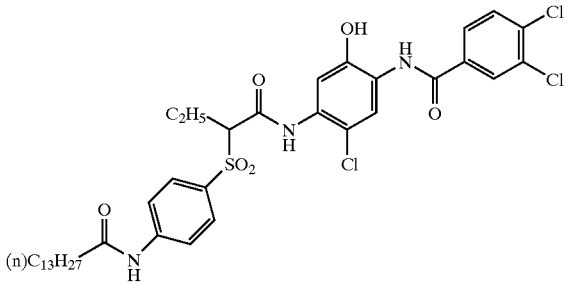

Formula (2C-II) will be described below.

In formula (2C-II), $Y_3$ represents a group which can split off by a coupling reaction with the oxidized form of an aromatic primary amine color developing agent. Examples of this split-off group are those, except for a hydrogen atom, enumerated in the explanation of X in formula (MC-I) to be described later. In formula (2C-II), $Y_3$ is preferably a halogen atom, alkylthio group, arylthio group, alkoxy group, aryloxy group, acyloxy group, or carbamoyloxy group, more preferably, a halogen atom, alkoxy group, alkylthio group, or acyloxy group, and most preferably, a chlorine atom, alkoxy group, or acyloxy group.

$A_4$ represents a substituent. Examples are those enumerated as examples of $R_2$ in formula (MC-I) to be described later. $A_4$ is preferably a carbamoyl group, acylamino group, alkoxycarbonyl group, or acyl group, and most preferably, an carbamoyl group. $A_4$ is preferably a group having a total number of carbon atoms of 8 to 60 and gives immobility to the coupler represented by formula (2C-II).

$A_5$ represents a hydrogen atom or substituent. Examples of the substituent are those enumerated as examples of $R_2$ in formula (MC-I) to be described later. $A_5$ is preferably a hydrogen atom, acylamino group, alkoxycarbonylamino group, ureido group, or sulfonylamino group, and more preferably, a hydrogen atom, acylamino group, alkoxycarbonylamino group, or aminocarbonylamino group.

Practical examples of a coupler represented by formula (2C-II) will be presented below. However, the present invention is not restricted to these examples.

2C-(24)

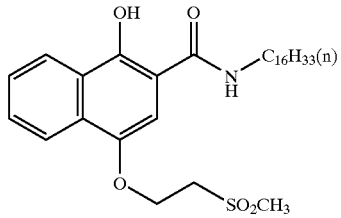

2C-(25)

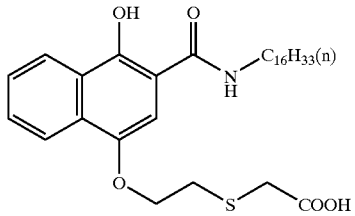

2C-(26)

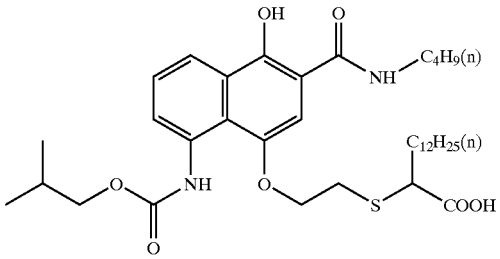

2C-(27)

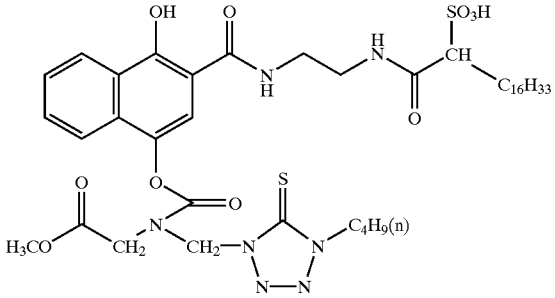

2C-(28)

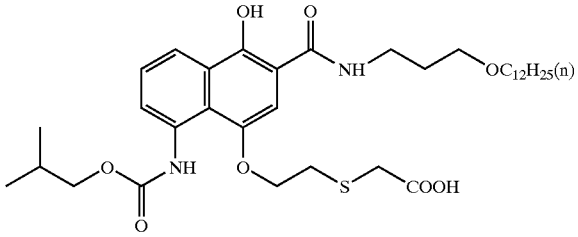

-continued 2C-(29)

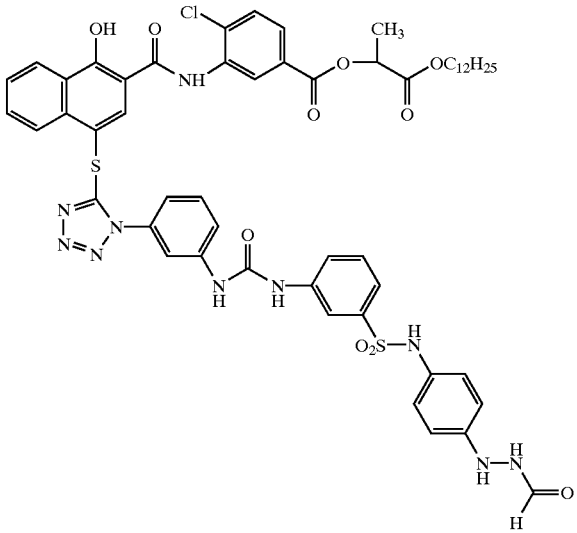

2C-(30)

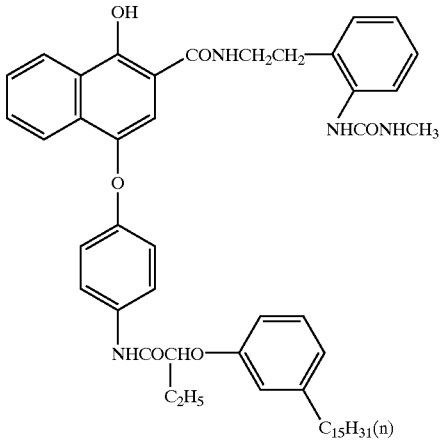

2C-(31)

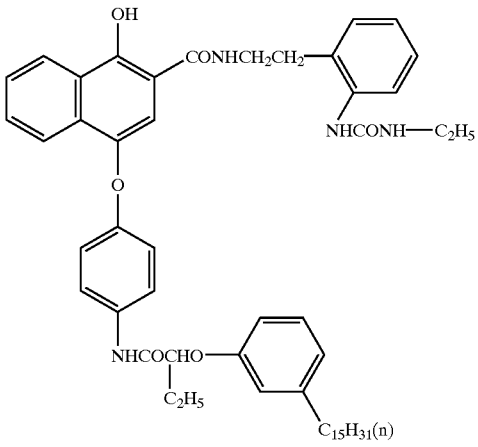

-continued 2C-(32)

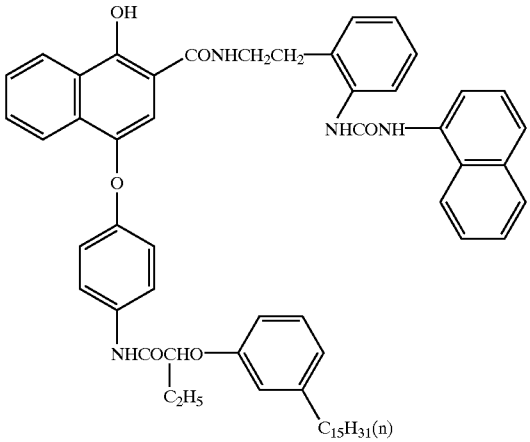

(ii) Magenta coupler represented by formula (MC-I)

Formula (MC-I) will be described below.

In formula (MC-I), $R_1$ represents hydrogen atom or a substituent selected from an alkyl group, aralkyl group, aryl group, alkoxy group, aryloxy group, amino group, acylamino group, arylthio group, alkylthio group, ureido group, alkoxycarbonylamino group, carbamoyloxy group, and heterocyclic thio group. These substituents can further have a substituent.

Examples of the substituent represented by $R_1$ are an alkyl group (e.g., methyl, ethyl, isopropyl, t-butyl, t-amyl, adamantyl, 1-methylcylopropyl, t-octyl, cyclohexyl, 2-methanesulfonylethyl, 3-(3-pentadecylphenoxy)propyl, 3-{4-{2-[4-(4-hydroxyphenylsulfonyl)phenoxy]dodecanamido}phenyl}propyl, 2-ethoxytridecyl, trifluoromethyl, cyclopentyl, and 3-(2,4-di-t-amylphenoxy)propyl); aralkyl group (e.g., benzyl, 4-methoxybenzyl, and 2-methoxybenzyl); aryl group (e.g., phenyl, 4-t-butylphenyl, 2,4-di-t-amylphenyl, and 4-tetradecanamidophenyl); alkoxy group (e.g., methoxy, ethoxy, 2-methoxyethoxy, 2-dodecylethoxy, 2-methanesulfonylethoxy, and 2-phenoxyethoxy); aryloxy group (e.g., phenoxy, 2-methylphenoxy, 4-t-butylphenoxy, 3-nitrophenoxy, 3-t-butyloxycarbamoylphenoxy, and 3-methoxycarbamoylhpenoxy); amino group (including an anilino group; e.g., methylamino, ethylamino, anilino, dimethylamino, diethylamino, t-butylamino, 2-methoxyanilino, 3-acetylaminoanilino, and cyclohexylamino); acylamino group (e.g., acetamide, benzamide, tetradecaneamide, 2-(2,4-di-t-amylphenoxy)butaneamide, 4-(3-t-butyl-4-hydroxyphenoxy)butaneamide, and 2-{4-(4-hydroxyphenylsulfonyl)phenoxy}decanamide); ureido group (e.g., phenylureido, methylureido, and N,N-dibutylureido); alkylthio group (e.g., methylthio, octylthio, tetradecylthio, 2-phenoxyethylthio, 3-phenoxypropylthio, and 3-(4-t-butylphenoxy)propylthio); arylthio group (e.g., phenylthio, 2-butoxy-5-t-octylphenylthio, 3-pentadecylphenylthio, 2-carboxyphenylthio, and 4-tetradecanamidophenylthio); alkoxycarbonylamino group (e.g., methoxycarbonylamino and tetradecyloxycarbonylamino); carbamoyloxy group (e.g., N-methylcarbamoyloxy and N-phenylcarbamoyloxy); and heterocyclic thio group (e.g., 2-benzothiazolylthio, 2,4-diphenoxy-1,3,5-triazole-6-thio, and 2-pyridylthio).

Of these substituents, an alkyl group, aralkyl group, aryl group, alkoxy group, aryloxy group, and amino group are preferred, a secondary or tertiary alkyl group having a total number of carbon atoms of 3 to 15 is more preferred, and a 4- to 10-carbon, tertiary alkyl group is most preferred.

X represents a hydrogen atom or a split-off group which can split off by a coupling reaction with the oxidized form of an aromatic primary amine color developing agent. Examples of the split-off group are a halogen atom, alkoxy group, aryloxy group, acyloxy group, alkylsulfonyloxy or arylsulfonyloxy group, acylamino group, alkylsulfonamide or arylsulfonamide group, alkoxycarbonyloxy group, aryloxycarbonyloxy group, alkylthio, arylthio, or heterocyclic thio group, carbamoylamino group, carbamoyloxy group, 5- or 6-membered, nitrogen-containing heterocyclic group, imide group, and arylazo group. These groups can be further substituted by groups enumerated as substituents of $R_2$.

More specifically, examples of X are a halogen atom (e.g., a fluorine atom, chlorine atom, and bromine atom); alkoxy group (e.g., ethoxy, dodecyloxy, methoxyethylcarbamoylmethoxy, carboxypropyloxy, methylsulfonylethoxy, and ethoxycarbonylmethoxy); aryloxy group (e.g., 4-methylphenoxy, 4-chlorophenoxy, 4-methoxyphenoxy, 4-carboxyphenoxy, 4-methoxycarboxyphenoxy, 4-carbamoylphenoxy, 3-ethoxycarboxyphenoxy, 3-acetylaminophenoxy, and 2-carboxyphenoxy); acyloxy group (e.g., acetoxy, tetradecanoyloxy, and benzoyloxy); alkylsulfonyloxy or arylsulfonyloxy group (e.g., methanesulfonyloxy and toluenesulfonyloxy); acylamino group (e.g., dichloroacetylamino and heptafluorobutylylamino), alkylsulfonamide or arylsulfonamide group (e.g., methanesulfonamino, trifluoromethanesulfonamino, and p-toluenesulfonylamino); alkoxycarbonyloxy group (e.g., ethoxycarbonyloxy and benzyloxycarbonyloxy); aryloxycarbonyloxy group (e.g., phenoxycarbonyloxy); alkylthio, arylthio, or heterocyclic thio group (e.g., dodecylthio, 1-carboxydodecylthio, phenylthio, 2-butoxy-5-t-octylphenylthio, and tetrazolylthio); carbamoylamino group (e.g., N-methylcarbamoylamino and N-phenylcarbamoylamino); carbamoyloxy group (e.g., N,N-dimethylcarbamoyloxy, N-phenylcarbamoyloxy, morpholinylcarbamoyloxy, and pyrrolidinylcarbamoyloxy); 5- or 6-membered, nitrogen-containing heterocyclic group (e.g., imidazolyl, pyrazolyl, triazolyl, tetrazolyl, and 1,2-dihydro-2-oxo-1-pyridyl); imide group (e.g., succinimide and hydantoinyl); and arylazo group (e.g., phenylazo and 4-methoxyphenylazo). X can also take the form of a bis coupler obtained by condensing a 4-equivalent coupler by aldehydes or ketones, as a split-off group bonded via a carbon atom.

X is preferably a hydrogen atom, halogen atom, alkoxy group, aryloxy group, alkylthio or arylthio group, or 5- or 6-membered, nitrogen-containing heterocyclic group which bonds to the coupling active position by a nitrogen atom, and particularly preferably, a hydrogen atom, chlorine atom, or phenoxy group which may be substituted.

One of $G_1$ and $G_2$ is a nitrogen atom, and the other is a carbon atom. $R_2$ in formula (MC-I) bonds to one of $G_1$ and $G_2$ which is a carbon atom.

$R_2$ represents a substituent. Examples are a halogen atom, alkyl group, aryl group, heterocyclic group, cyano group, hydroxyl group, nitro group, carboxyl group, amino group, alkoxy group, aryloxy group, acylamino group, alkylamino group, anilino group, ureido group, sulfamoylamino group, alkylthio group, arylthio group, alkoxycarbonylamino group, sulfonamide group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imide group, heterocyclic thio group, sulfinyl group, phosphonyl group, aryloxycarbonyl group, acyl group, and azolyl group. These substituents can have a substituent.

More specifically, examples of a substituent represented by $R_2$ are a halogen atom (e.g., a chlorine atom and bromine atom); alkyl group (e.g., a 1- to 32-carbon, straight-chain or branched-chain alkyl group and cycloalkenyl group; more specifically, methyl, ethyl, propyl, isopropyl, t-butyl, tridecyl, 2-methanesulfonylethyl, 3-(3-pentadecylphenoxy) propyl, 3-{4-{2-[4-(4-hydroxyphenylsulfonyl)phenoxy] dodecanamid o}phenyl}propyl, 2-ethoxytridecyl, trifluoromethyl, cyclopentyl, and 3-(2,4-di-t-amylphenoxy) propyl); aryl group (e.g., phenyl, 4-t-butylphenyl, 2,4-di-t-amylphenyl, and 4-tetradecanamidophenyl); heterocyclic group (e.g., 2-furyl, 2-thienyl, 2-pyrimidinyl, and 2-benzothiazolyl); cyano group; hydroxyl group; nitro group; carboxyl group; amino group; alkoxy group (e.g., methoxy, ethoxy, 2-methoxyethoxy, 2-dodecylethoxy, and 2-methanesulfonylethoxy); aryloxy group (e.g., phenoxy, 2-methylphenoxy, 4-t-butylphenoxy, 3-nitrophenoxy, 3-t-butyloxycarbamoylphenoxy, and 3-methoxycarbamoylphenoxy); acylamino group (e.g., acetamide, benzamide, tetradecanamide, 2-(2,4-di-t-amylphenoxy)butaneamide, 4-(3-t-butyl-4-hydroxyphenoxy)butaneamide, 2-{4-(4-hydroxyphenylsulfonyl)phenoxy}decaneamide); alkylamino group (e.g., methylamino, butylamino, dodecylamino, diethylamino, and methylbutylamino); anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{α-(3-t-butyl-4-hydroxyphenoxy) dodecaneamido}anilino); ureido group (e.g., phenylureido, methylureido, and N,N-dibutylureido); sulfamoylamino group (e.g., N,N-dipropylsulfamoylamino and N-methyl-N-decylsulfamoylamino); alkylthio group (e.g., methylthio, octylthio, tetradecylthio, 2-phenoxyethylthio, 3-phenoxypropylthio, and 3-(4-t-butylphenoxy)propylthio); arylthio group (e.g., phenylthio, 2-butoxy-5-t-octylphenylthio, 3-pentadecylphenylthio, 2-carboxyphenylthio, and 4-tetradecanamidophenylthio); alkoxycarbonylamino group (e.g., methoxycarbonylamino and tetradecyloxycarbonylamino); sulfonamide group (e.g., methanesulfonamide, hexadecanesulfonamide, benzenesulfonamide, p-toluenesulfonamide, octadecanesulfonamide, and 2-methyloxy-5-t-butylbenzenesulfonamide); carbamoyl group (e.g., N-ethylcarbamoyl, N,N-dibutylcarbamoyl, N-(2-dodecyloxyethyl)carbamoyl, N-methyl-N-dodecylcarbamoyl, and N-(3-(2,4-di-t-amylphenoxy) propyl)carbamoyl); sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl); sulfonyl group (e.g., methanesulfonyl, octanesulfonyl, benzenesulfonyl, and toluenesulfonyl); alkoxycarbonyl group (e.g., methoxycarbonyl, butyloxycarbonyl, dodecyloxycarbonyl, and octadecyloxycarbonyl); heterocyclic oxy group (e.g., 1-phenyltetrazole-5-oxy and 2-tetrahydropyranyloxy); azo group (e.g., phenylazo, 4-methoxphenylazo, 4-pyvaloylaminophenylazo, and 2-hydroxy-4-propanoylphenylazo); acyloxy group (e.g., acetoxy); carbamoyloxy group (e.g., N-methylcarbamoyloxy and N-phenylcarbamoyloxy); silyloxy group (e.g., trimethylsilyloxy and dibutylmethylsilyloxy); aryloxycarbonylamino group (e.g., phenoxycarbonylamino); imide group (e.g., N-succinimide, N-phthalimide, and 3-octadecenylsuccinimide); heterocyclic thio group (e.g., 2-benzothiazolylthio, 2,4-di-phenoxy-1,3,5-trizole-6-thio, and 2-pyridylthio); sulfinyl group (e.g., dodecanesulfinyl, 3-pentadecylphenylsulfinyl, and 3-phenoxypropylsulfinyl); phosphonyl group (e.g., phenoxyphosphonyl, octyloxyphosphonyl, and phenylphosphonyl); aryloxycarbonyl group (e.g., phenoxycarbonyl); acyl group (e.g., acetyl, 3-phenylpropanoyl, benzoyl, and 4-dodecyloxybenzoyl); and azolyl group (e.g., imidazolyl, pyrazolyl, 3-chloro-pyrazole-1-yl, and triazole).

In a case where a group represented by $R_2$ can further have a substituent, such further substituent may be an organic substituent which bonds to $R_2$ with a carbon atom, oxygen atom, nitrogen atom, or sulfur atom thereof, or a halogen atom.

Preferable examples of $R_2$ are an alkyl group, aryl group, alkoxy group, aryloxy group, alkylthio group, ureido group, alkoxycarbonylamino group, and acylamino group. More preferably, $R_2$ is a group having a total number of carbon atoms of 6 to 70, which contains a 6- to 70-carbon alkyl group or aryl group as a partial structure, and gives immobility to a coupler represented by formula (MC-1).

The coupler represented by formula (MC-1) is preferably those where $R_2$ is a group represented by formula (BL-1) or (BL-2) below:

(BL-1)

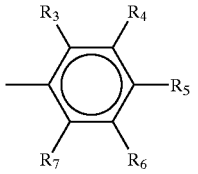

(BL-2)

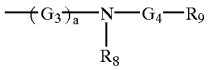

In formula (BL-1), each of $R_3$, $R_4$, $R_5$, $R_6$, and $R_7$ independently represents a hydrogen atom or substituent, and at least one of them represents a substituent having a total number of carbon atoms of 4 to 70 and containing a substituted or nonsubstituted alkyl group as a partial structure, or a substituent having a total number of carbon atoms of 6 to 70 and containing a substituted or nonsubstituted aryl group as a partial structure. The term "as a partial structure" herein includes such a group is attached to each of $R_3$ to $R_7$ as a substituent, and also such a group itself is each of $R_3$ to $R_7$. Accordingly, each of $R_3$ to $R_7$ itself may be an alkyl group having a total number of carbon atoms of 4 to 70, or an aryl group having a total number of carbon atoms of 6 to 70.

A group represented by formula (BL-1) will be described below. Each of $R_3$, $R_4$, $R_5$, $R_6$, and $R_7$ independently represents a hydrogen atom or substituent. Examples of this substituent are those enumerated above for $R_2$. At least one of $R_3$, $R_4$, $R_5$, $R_6$, and $R_7$ is a substituent having a total number of carbon atoms of 4 to 70 and containing a substituted or nonsubstituted alkyl group as a partial structure, or a substituent having a total number of carbon atoms of 6 to 70 and containing a substituted or nonsubstituted aryl group as a partial structure. Preferable examples are an alkoxy group, aryloxy group, acylamino group, ureido group, carbamoyl group, alkoxycarbonylamino group, sulfonyl group, sulfonamide group, sulfamoyl group, sulfamoylamino group, alkoxycarbonyl group, alkyl group, and aryl group each having a total number of carbon atoms of 4 (6 if an aryl group is contained) to 70, and each containing a substituted or nonsubstituted alkyl or aryl group as a partial structure. Of these substituents, a 4- to 70-carbon alkyl group and an alkoxy group, acylamino group, and sulfonamide group containing a 4- to 70-carbon alkyl group as a partial structure are preferred.

In particular, $R_3$ or both of $R_4$ and $R_6$ are preferably the above mentioned substituents containing a substituted or nonsubstituted alkyl or aryl group as a partial structure, and having a total number of carbon atoms of 4 (6 if an aryl group is contained as the partial structure) to 70.

In formula (BL-2), $G_3$ represents a substituted or nonsubstituted methylene group, a represents an integer from 1 to 3, $R_8$ represents a hydrogen atom, alkyl group, or aryl group, $G_4$ represents —CO— or —$SO_2$—, and $R_9$ represents a substituent having a total number of carbon atoms of 6 to 70 and containing a substituted or nonsubstituted alkyl or aryl group as a partial structure. If $R_9$ has a substituent, examples of this substituent are those enumerated above for $R_2$. If a is 2 or more, a plurality of $G_3$'s may be the same or different. Preferably, a group represented by $(G_3)_a$ is —$CH_2$—, —$C_2H_4$—, —$C(CH_3)H$—, —$C(CH_3)_2$—, —$C(CH_3)H$—$CH_2$—, —$C(CH_3)_2$—$CH_2$—, —$C(CH_3)_2$—$C(CH_3)H$—, —$C(CH_3)H$—$C(CH_3)H$—, or —$C(CH_3)_2$—$C(CH_3)_2$—, $R_8$ is a hydrogen atom, $G_4$ is —CO— or —$SO_2$—, and $R_9$ is a substituted or nonsubstituted alkyl or aryl group each having a total number of carbon atoms of 10 to 70.

In a compound represented by formula (MC-1), if $G_1$ is a nitrogen atom, $G_2$ is a carbon atom, and x is a hydrogen atom, it is desirable that $R_1$ be a tertiary alkyl group, $R_2$ be a group represented by formula (BL-1), and each of $R_4$ and $R_6$ be a group selected from an acylamino group, sulfonamide group, ureido group, alkoxycarbonylamino group, sulfonyl group, carbamoyl group, sulfamoyl group, sulfamoylamino group, and alkoxycarbonyl group, each of which is substituted by a substituted or nonsubstituted alkyl group having a total number of carbon atoms of 4 or more or by a substituted or nonsubstituted aryl group having a total number of carbon atoms of 6 or more.

In a compound represented by formula (MC-I), if $G_1$ is a carbon atom, $G_2$ is a nitrogen atom, and x is a hydrogen atom, $R_1$ is preferably a tertiary alkyl group, and $R_2$ is preferably a group represented by formula (Bl-1) or (BL-2), and particularly preferably, a group represented by formula (BL-2).

In a compound represented by formula (MC-I), if $G_1$ is a nitrogen atom, $G_2$ is a carbon atom, and x is a split-off group except for a hydrogen atom, it is favorable that $R_1$ be a tertiary alkyl group, $R_2$ be a group represented by formula (BL-1), $R_3$ be a group selected from an acylamino group, sulfonamide group, ureido group, alkoxycarbonylamino group, sulfonyl group, carbamoyl group, sulfamoyl group, sulfamoylamino group, and alkoxycarbonyl group, each of which is substituted by a substituted or nonsubstituted alkyl group having a total number of carbon atoms of 4 or more or by a substituted or nonsubstituted aryl group having a total number of carbon atoms of 6 or more, and X is a chlorine atom.

In a compound represented by formula (MC-I), if $G_1$ is a carbon atom, $G_2$ is a nitrogen atom, and X is a substituent except for a hydrogen atom, $R_1$ is preferably a tertiary alkyl group, and $R_2$ is preferably a group represented by formula (Bl-1) or (BL-2), and particularly preferably, a group represented by formula (BL-2).

In the present invention, it is desirable that $G_1$ be a carbon atom, $G_2$ be a nitrogen atom, $R_1$ be a tertiary alkyl group, and $R_2$ be represented by formula (BL-2) in which $G_4$ is —$SO_2$—, $R_9$ is a phenyl group having at least one group, which contains a 6- to 50-carbon alkyl group, as a substituent, and a is 1 or 2, and it is particularly desirable that X be a hydrogen atom, chlorine atom, or substituted phenyloxy group.

Practical compound examples of formula (MC-I) will be presented below. However, the present invention is not limited to these examples.

MC-1

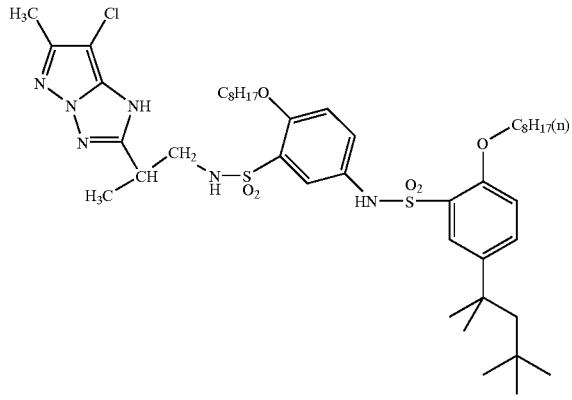

MC-2

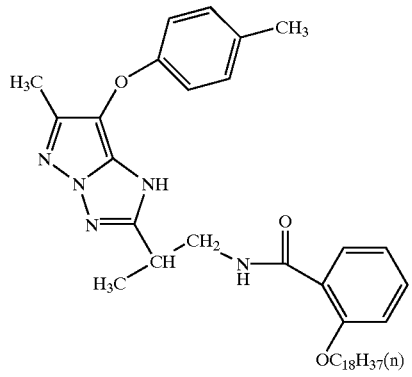

MC-3

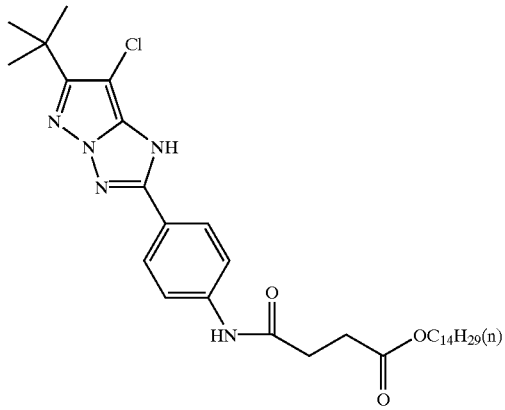

-continued
MC-4
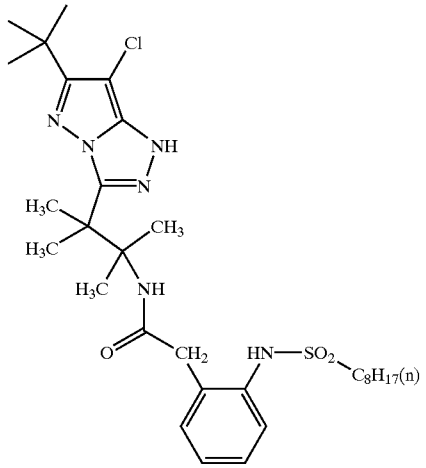
MC-5
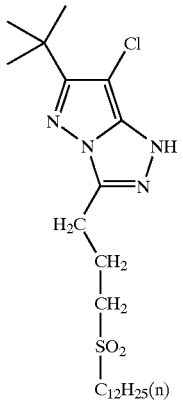
MC-6
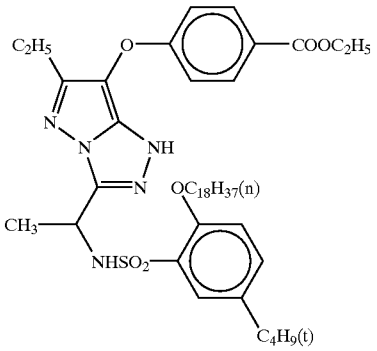
MC-7
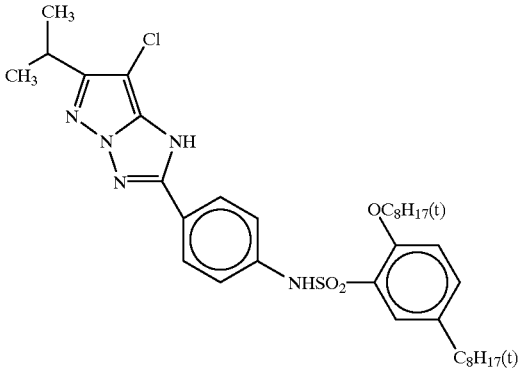

-continued
MC-8
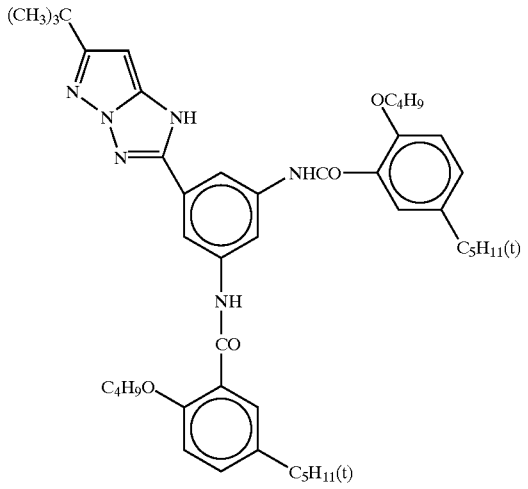
MC-9
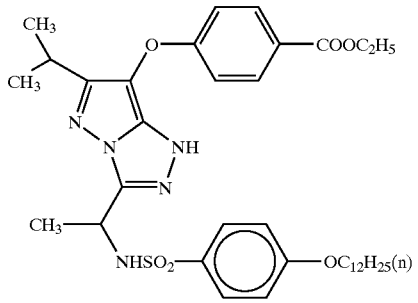
MC-10
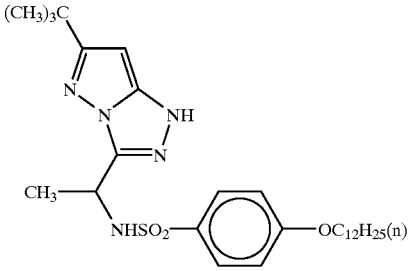
MC-11
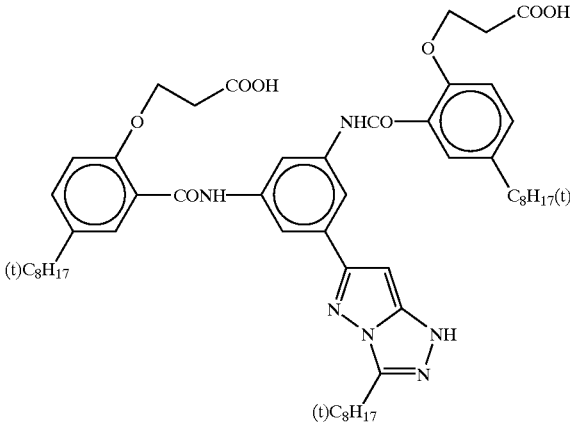

-continued
MC-12
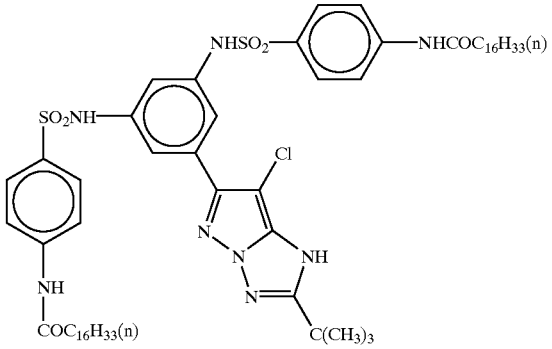
MC-13
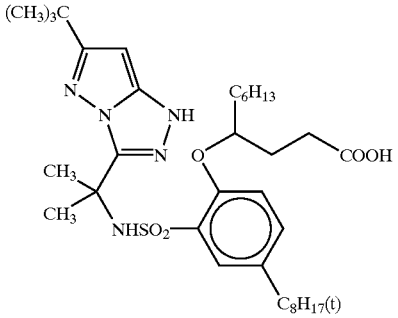
MC-14
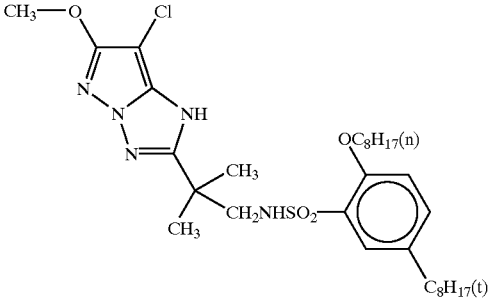
MC-15
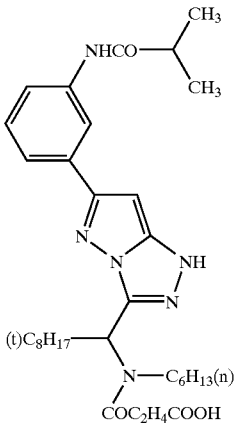

-continued
MC-16
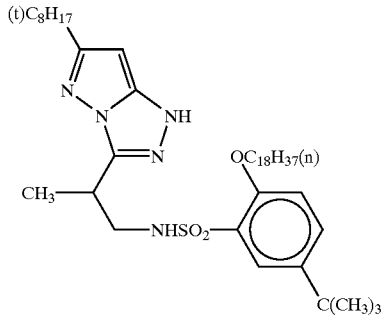
MC-17
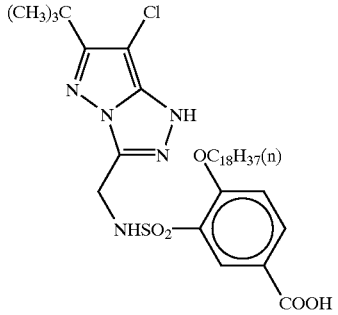
MC-18
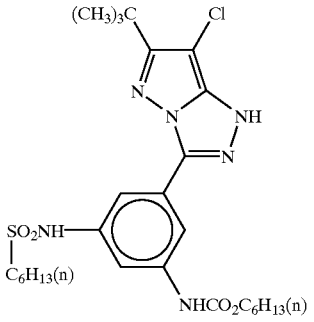
MC-19
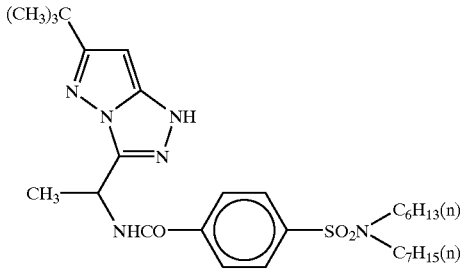

-continued
MC-20
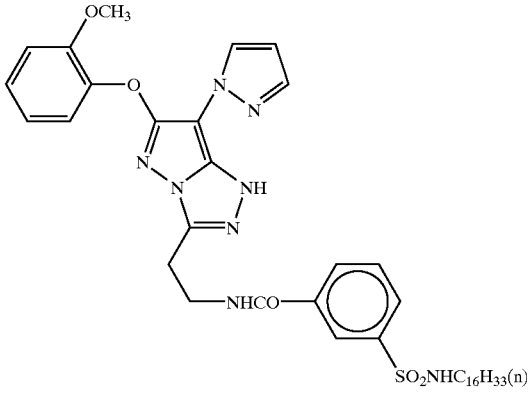
MC-21
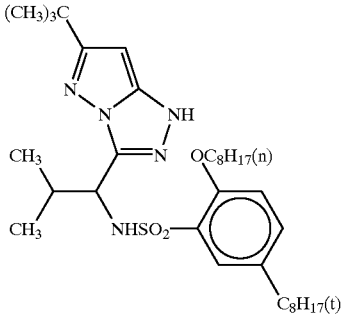
MC-22
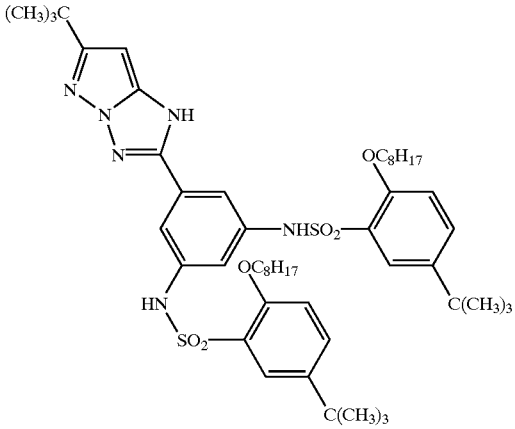
MC-23
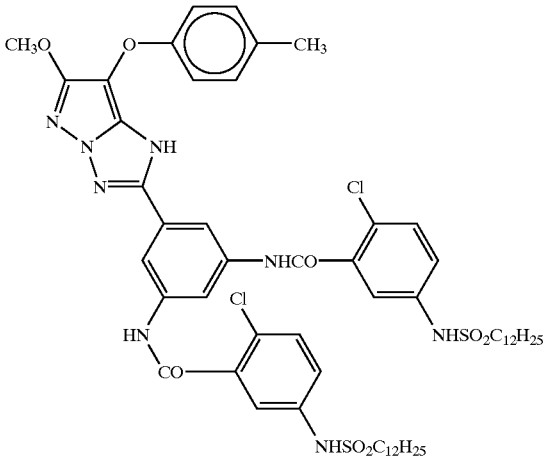

-continued
MC-24
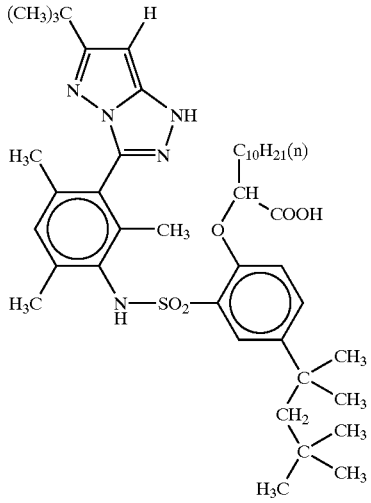
MC-25
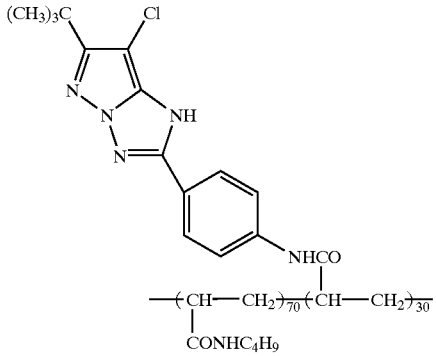
MC-26
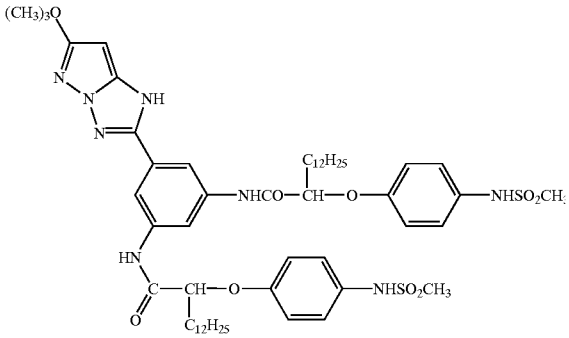
MC-27
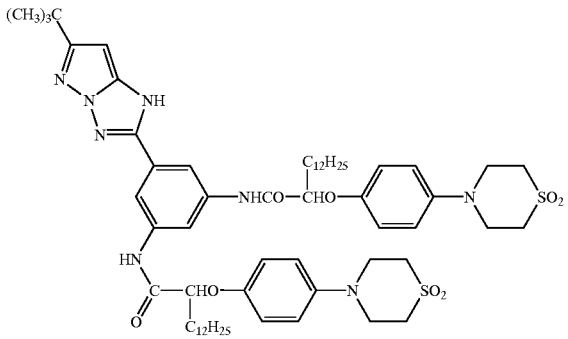

-continued
MC-28
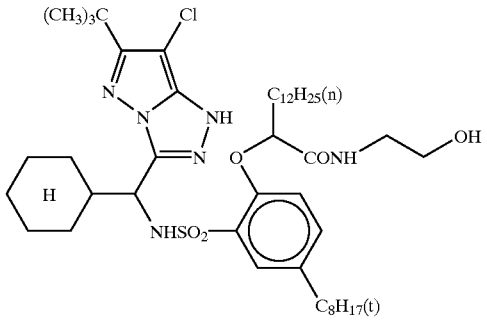
MC-29
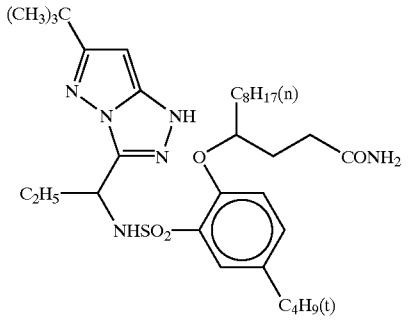
MC-30
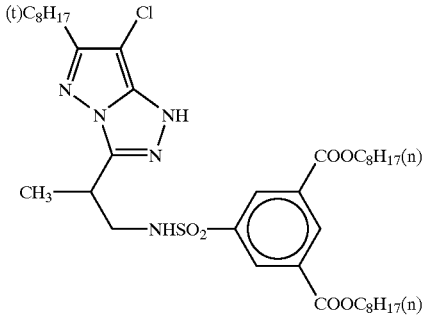
MC-31
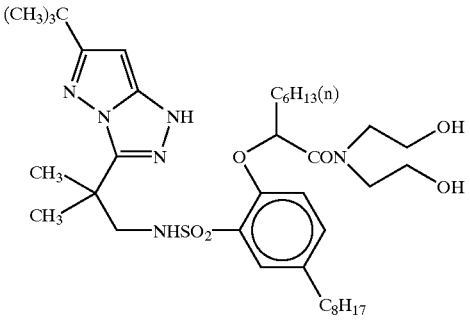
MC-32
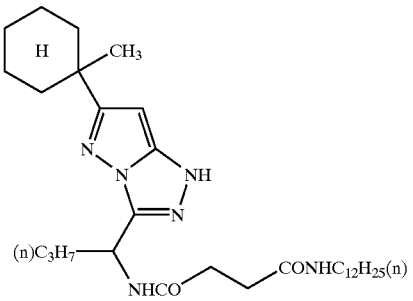

-continued
MC-33
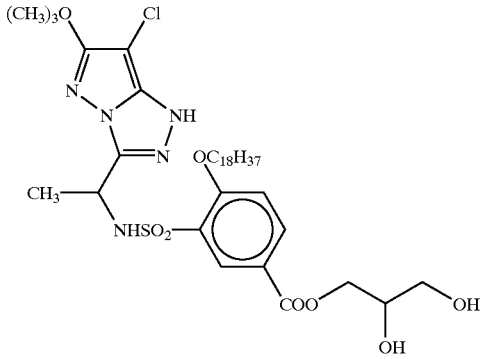
MC-34
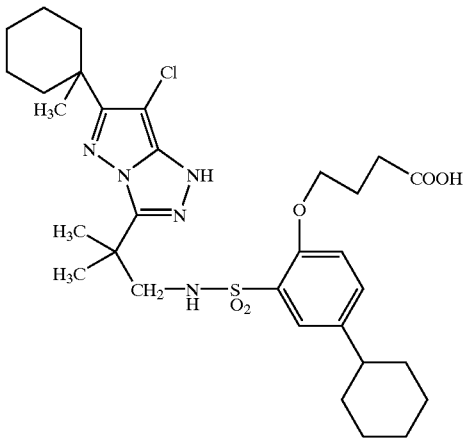
MC-35
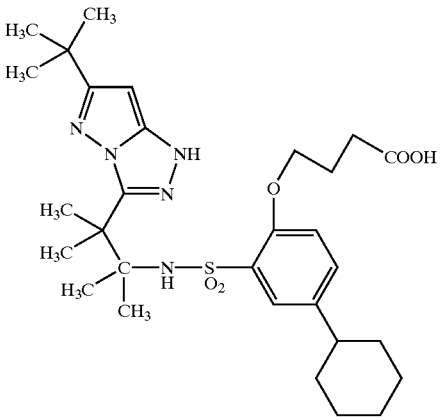

-continued
MC-36
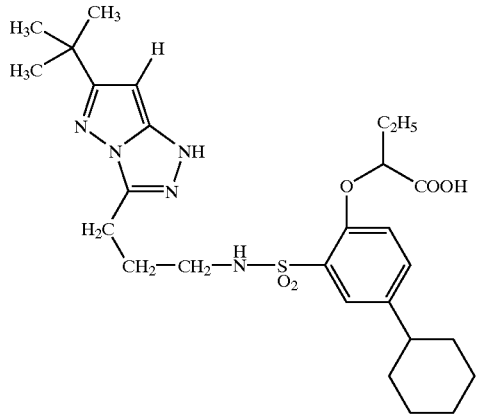
MC-37
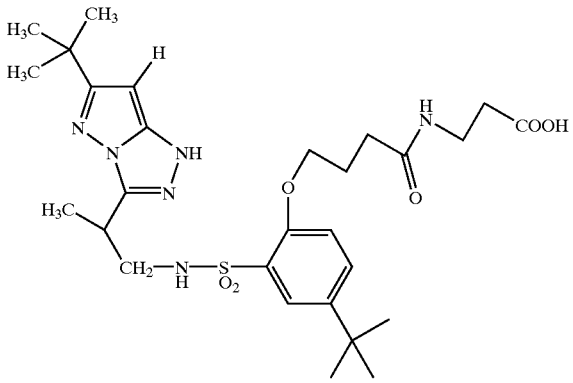
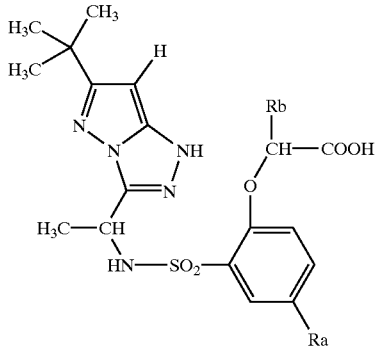
| Compound No. | Ra | Rb* |
|---|---|---|
| MC-38 | 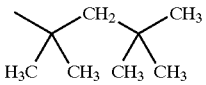 | $—C_{10}H_{21}$ |
| MC-39 | 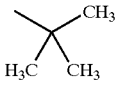 | $—C_8H_{17}$ |

-continued
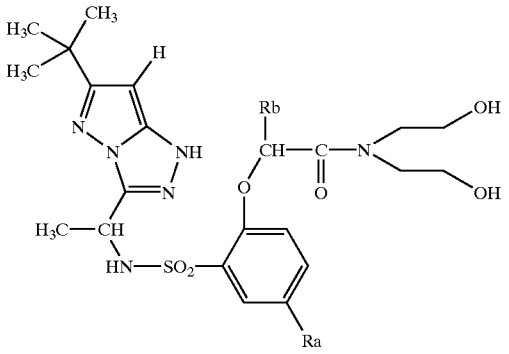
| Compound No. | Ra | Rb |
|---|---|---|
| MC-40 | 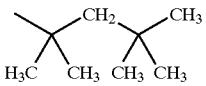 | $—C_8H_{17}$ |
| MC-41 | 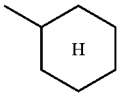 | $—C_8H_{17}$ |
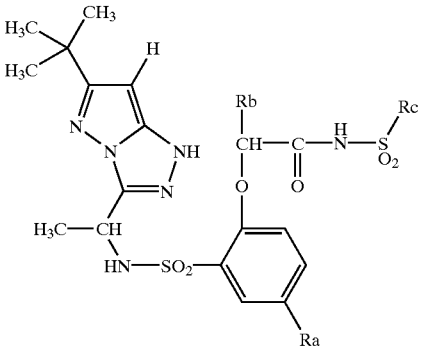
| Compound No. | Ra | Rb | Rc |
|---|---|---|---|
| MC-42 | 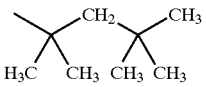 | $—C_{10}H_{21}$ | $—CH_3$ |
| MC-43 | 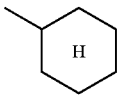 | $—C_8H_{17}$ | $—CH_3$ |
| MC-44 | 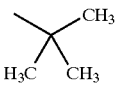 | $—C_{10}H_{21}$ | 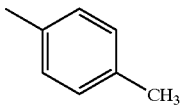 |

-continued

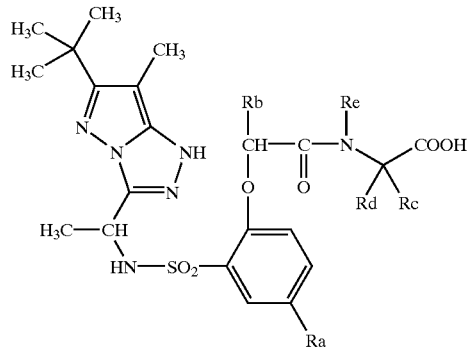

| Compound No. | Ra | Rb | Rc | Rd | Re |
|---|---|---|---|---|---|
| MC-45 | 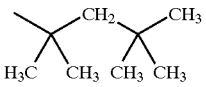 | $-C_{12}H_{25}$ | $-CH_3$ | —H | —H |

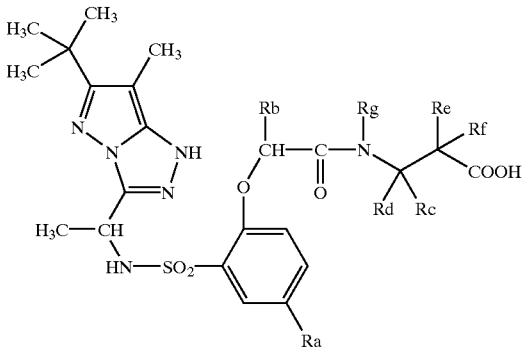

| Compound No. | Ra | Rb | Rc | Rd | Re | Rf | Rg |
|---|---|---|---|---|---|---|---|
| MC-46 | 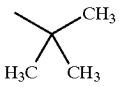 | $-C_{10}H_{21}$ | —H | —H | —H | —H | —H |

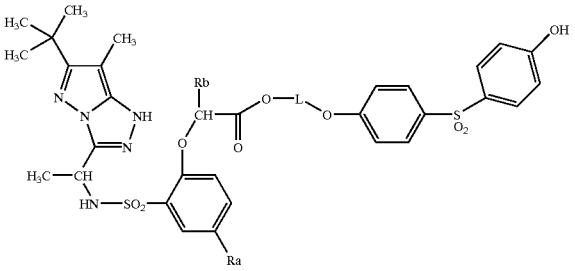

| Compound No. | Ra | Rb | L |
|---|---|---|---|
| MC-47 | 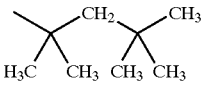 | $-C_{10}H_{21}$ | 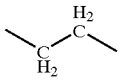 |

*The groups are normal alkyl groups, except otherwise indicated.

A coupler represented by formula (MC-1) of the present invention can be synthesized by know methods. Examples are described in U.S. Pat. Nos. 4,540,654, 4,705,863, and 5,451,501, JP-A's-61-65245, 62-209457, 62-249155, and 63-41851, Jpn. Pat. Appln. KOKOKU Publication No. (hereinafter referred to as JP-B-)7-122744, JP-B's-5-

105682, 7-13309, and 7-82252, U.S. Pat. Nos. 3,725,067 and 4,777,121, JP-A's-2-201442, 2-101077, 3-125143, and 4-242249.

(iii) A coupler represented by formula (CC-I) will be described below.

In formula (CC-I), $G_a$ represents —C($R_{13}$)═ or —N═. When $G_a$ represents —N═, $G_b$ represents —C($R_{13}$)═. When $G_a$ represents —C($R_{13}$)═, $G_b$ represents —N═.

Each of $R_{11}$ and $R_{12}$ represents an electron attractive group having a Hammett substituent constant σp value of 0.20 to 1.0. The sum of the σp values of $R_{11}$ and $R_{12}$ is desirably 0.65 or more. The coupler of the present invention is given superior performance as a cyan coupler by introducing this strong electron attractive group. The sum of the σp values of $R_{11}$ and $R_{12}$ is preferably 0.70 or more, and its upper limit is about 1.8.

In the present invention, each of $R_{11}$ and $R_{12}$ is an electron attractive group with a Hammett substituent constant σp value (to be simply referred to as a σp value hereinafter) of 0.20 to 1.0, preferably an electron attractive group having a σp value of 0.30 to 0.8. The Hammett's rule is an empirical rule proposed by L. P. Hammett in 1935 in order to quantitatively argue the effects of substituents on reaction or equilibrium of benzene derivatives. The rule is widely regarded as appropriate in these days. The substituent constants obtained by the Hammett rule include a σp value and a σm value, and these values are described in a large number of general literature. For example, the values are described in detail in J. A. Dean ed., "Lange's Hand Book of Chemistry," the 12th edition, 1979 (McGraw-Hill), "The Extra Number of The Domain of Chemistry," Vol. 122, pages 96 to 103, 1979 (Nanko Do) and Chemical Reviews, vol. 91, pp.165–195 (1991). In the present invention, each of $R_{11}$ and $R_{12}$ is defined by the Hammett substituent constant σp value. However, this does not mean that $R_{11}$ and $R_{12}$ are limited to substituents having the already known values described in these literature. That is, the present invention includes, of course, substituents having values that fall within the above range when measured on the basis of the Hammett's rule even if they are unknown in literature.

Practical examples of $R_{11}$ and $R_{12}$, as the electron attractive group with a σp value of 0.20 to 1.0, are an acyl group, acyloxy group, carbamoyl group, aliphatic oxycarbonyl group, aryloxycarbonyl group, cyano group, nitro group, dialkylphosphono group, diarylphosphono group, diarylphosphinyl group, alkylsulfinyl group, arylsulfinyl group, alkylsulfonyl group, arylsulfonyl group, sulfonyloxy group, acylthio group, sulfamoyl group, thiocyanate group, thiocarbonyl group, alkyl group substituted by at least two halogen atoms, alkoxy group substituted by at least two halogen atoms, aryloxy group substituted by at least two halogen atoms, alkylamino group substituted by at least two halogen atoms, alkylthio group substituted by at least two halogen atoms, aryl group substituted by another electron attractive group with a σp value of 0.20 or more, heterocyclic group, chlorine atom, bromine atom azo group, and selenocyanate group. Of these substituents, those capable of further having substituents can further have substitutes to be enumerated later for $R_{13}$.

The aliphatic portion of an aliphatic oxycarbonyl group can be straight-chain, branched-chain, or cyclic and can be saturated or can contain an unsaturated bond. This aliphatic oxycarbonyl group includes, e.g., alkoxycarbonyl, cycloalkoxycarbonyl, alkenyloxycarbonyl, alkinyloxycarbonyl, and cycloalkenyloxycarbonyl.

The σp values of representative electron attractive groups having a σp value of 0.2 to 1.0 are a bromine atom (0.23), chlorine atom (0.23), cyano group (0.66), nitro group (0.78), trifluoromethyl group (0.54), tribromomethyl group (0.29), trichloromethyl group (0.33), carboxyl group (0.45), acetyl group (0.50), benzoyl group (0.43), acetyloxy group (0.31), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), ethoxycarbonyl group (0.45), phenoxycarbonyl group (0.44), pyrazolyl group (0.37), methanesulfonyloxy group (0.36), dimethoxyphosphoryl group (0.60), and sulfamoyl group (0.57). Each of the numbers in parenthesis is σp value.

$R_{11}$ preferably represents a cyano group, aliphatic oxycarbonyl group (a 2- to 36-carbon, straight-chain or branched-chain alkoxycarbonyl group, aralkyloxycarbonyl group, alkenyloxycarbonyl group, or alkinyloxycarbonyl group, or a 3-to 36-carbon cycloalkoxycarbonyl group, or cycloalkenyloxycarbonyl group, e.g., methoxycarbonyl, ethoxycarbonyl, dodecyloxycarbonyl, octadecyloxycarbonyl, 2-ethylhexyloxycarbonyl, sec-butyloxycarbonyl, oleyloxycarbonyl, benzyloxycarbonyl, propargyloxycarbonyl, cyclopentyloxycarbonyl, cyclohexyloxycarbonyl, or 2,6-di-t-butyl-4-methylcylohexyloxycarbonyl); dialkylphosphono group (a 2- to 36-carbon dialkylphosphono group, e.g., diethylphosphono or dimethylphosphono); alkylsulfonyl or arylsulfonyl group (a 1- to 36-carbon alkylsulfonyl or arylsulfonyl group, e.g., a methanesulfonyl group, butanesulfonyl group, benzenesulfonyl group, or p-toluenesulfonyl group); or fluorinated alkyl group (a 1- to 36-carbon fluorinated alkyl group, e.g., trifluoromethyl). $R_{11}$ is particularly preferably a cyano group, aliphatic oxycarbonyl group, or fluorinated alkyl group, and most preferably, a cyano group.

$R_{12}$ preferably represents an aliphatic oxycarbonyl group as enumerated above for $R_{11}$; carbamoyl group (a 1- to 36-carbon carbamoyl group, e.g., diphenylcarbamoyl or dioctylcarbamoyl); sulfamoyl group (a 1- to 36-carbon sulfamoyl, e.g., dimethylsulfamoyl or dibutylsulfamoyl); dialkylphosphono group enumerated above for $R_{11}$; diarylphosphono group (a 12- to 50-carbon diarylphosphono group, e.g., diphenylphosphono or di(p-tolyl)phosphono). $R_{12}$ is particularly preferably a group represented by the following formula (1).

(1)

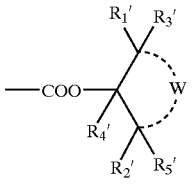

wherein each of $R_1'$ and $R_2'$ represents an aliphatic group, e.g., a 1- to 36-carbon, straight-chain or branched-chain alkyl group, aralkyl group, alkenyl group, alkinyl group, cycloalkyl group, or cycloalkenyl group, and more specifically, methyl, ethyl, propyl, isopropyl, t-butyl, t-amyl, t-octyl, tridecyl, cyclopentyl, or cyclohexyl. Each of $R_3'$, $R_4'$, and $R_5'$ represents a hydrogen atom or aliphatic group. Examples of the aliphatic group are those enumerated above for $R_1'$ and $R_2'$. Each of $R_3'$, $R_4'$, and $R_5'$ is preferably a hydrogen atom.

W represents a non-metallic atomic group required to form a 5- to 8-membered ring. This ring may be substituted, may be a saturated ring, or can have an unsaturated bond. A non-metallic atom is preferably a nitrogen atom, oxygen atom, sulfur atom, or carbon atom, and more preferably, a carbon atom.

Examples of a ring formed by W are a cyclopentane ring, cyclohexane ring, cycloheptane ring, cyclooctane ring, cyclohexene ring, piperazine ring, oxane ring, and thiane ring. These rings can be substituted by the substituents described above.

A ring formed by W is preferably a cyclohexane ring which may be substituted, and most preferably, a cyclohexane ring whose 4-position is substituted by a 1- to 36-carbon alkyl group (which may be substituted by a substituent represented by $R_{13}$ described below).

$R_{13}$ represents a substituent. Examples are those enumerated above for $R_1$ in formula (MC-I). $R_{13}$ is preferably an alkoxy group, acylamino group, aliphatic group, or aryl group. These groups may be substituted by the substituents enumerated for $R_{13}$.

Y represents a hydrogen atom or a group which splits off when the coupler reacts with the oxidized form of an aromatic primary amine color developing agent. When Y represents a split-off group, examples are those enumerated above in the explanation of X in formula (MC-I).

Y is preferably a hydrogen atom, halogen atom, aryloxy group, heterocyclic acyloxy group, dialkylphosphonooxy group, arylcarbonyloxy group, arylsulfonyloxy group, alkoxycarbonyloxy group, or carbamoyloxy group. Also, the split-off group or a compound released from the split-off group preferably has a property of further reacting with the oxidized form of an aromatic primary amine color developing agent. For example, the split-off group is a non-color-generating coupler, hydroquinone derivative, aminophenol derivative, sulfonamidophenol derivative.

In a coupler represented by formula (CC-I), a group represented by $R_{12}$ or $R_{13}$ can contain a coupler moiety represented by formula (CC-I) to form a polymer which is a dimer or a higher-order polymer (whose polymerization degree is preferably 50 to 10,000, more preferably 100 to 5,000, or a group represented by $R_{12}$ or $R_{13}$ can contain a polymeric chain to form a homopolymer or a copolymer. A typical example of a homopolymer or copolymer containing a polymeric chain is a homopolymer or copolymer of an addition polymer of ethylene type unsaturated compound having a coupler moiety represented by formula (CC-I). One or more types of cyan-generating repeating units having a coupler moiety represented by formula (CC-I) may be contained in the polymer. A copolymer can contain, as copolymerization components, one or more types of non-color-generating ethylene type monomers which do not couple with the oxidized product of an aromatic primary amine color developing agent such as acrylate, methacrylate, or maleate.

Practical examples of a coupler represented by formula (CC-I) will be presented below. However, the present invention is not restricted to these examples.

(CC-1)

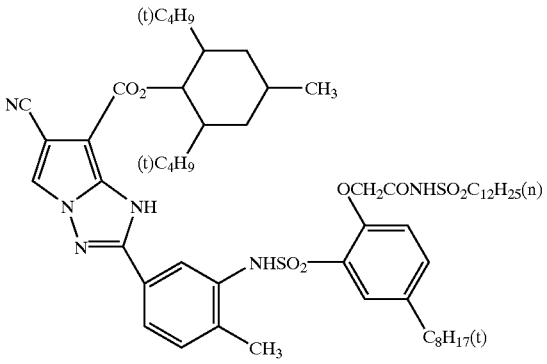

(CC-2)

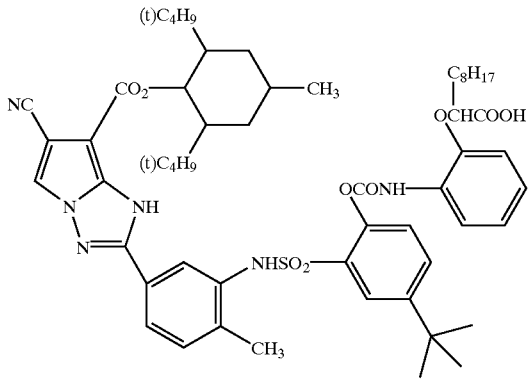

(CC-3)

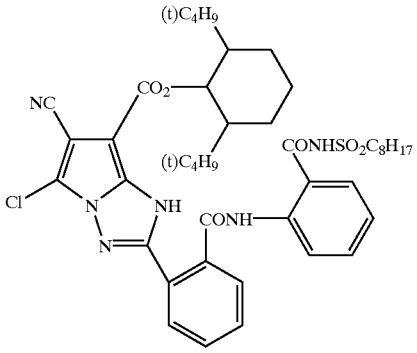

(CC-4)

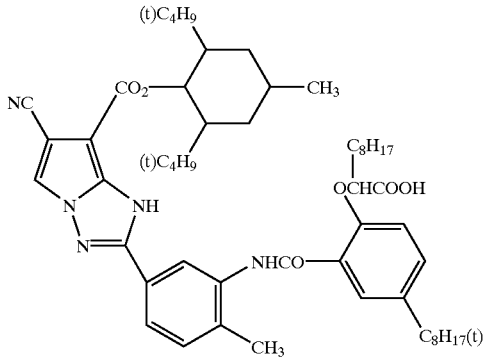

-continued
(CC-5)
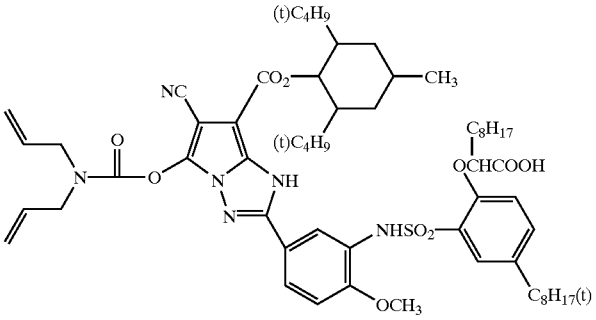
(CC-6)
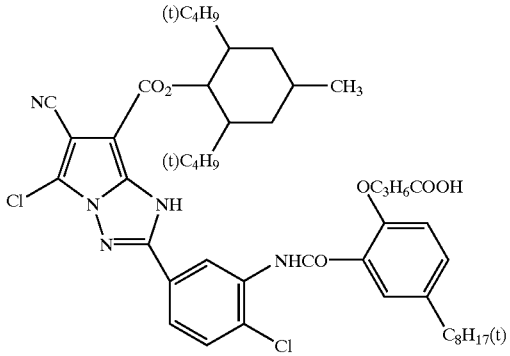
(CC-7)
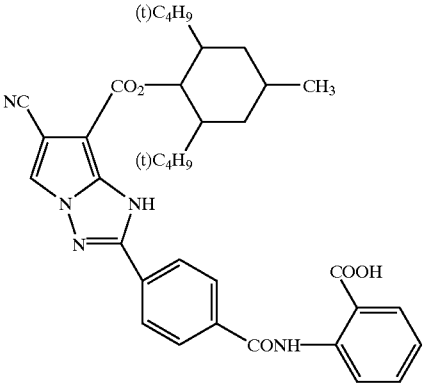
(CC-8)
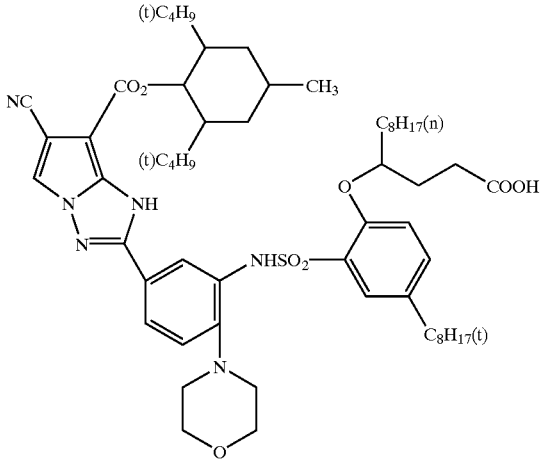
(CC-9)
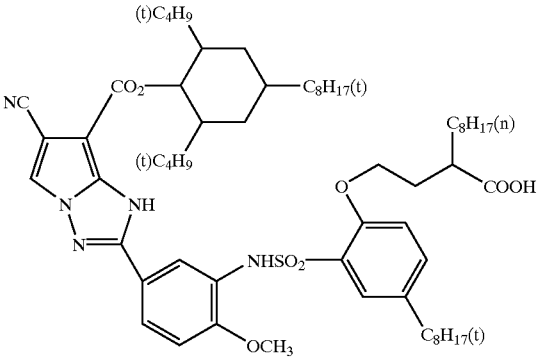
(CC-10)
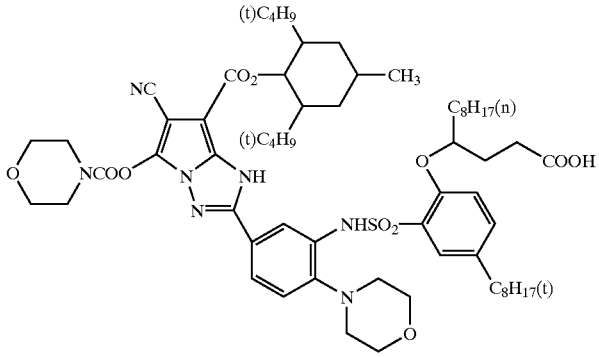
(CC-11)
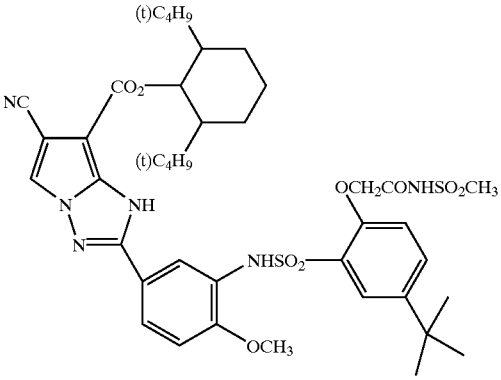
(CC-12)
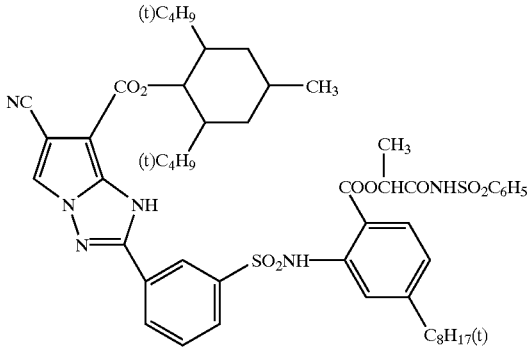

-continued
(CC-13)
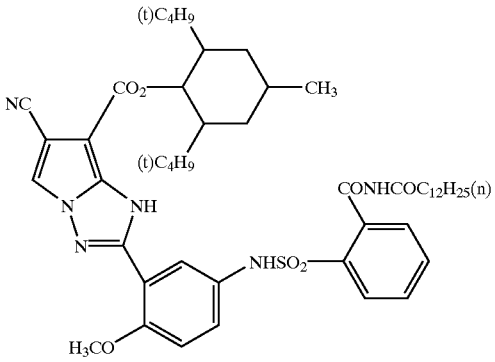
(CC-14)
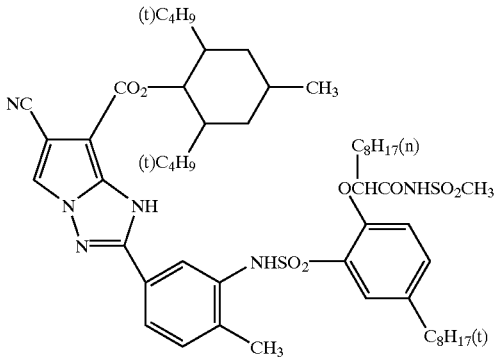
(CC-15)
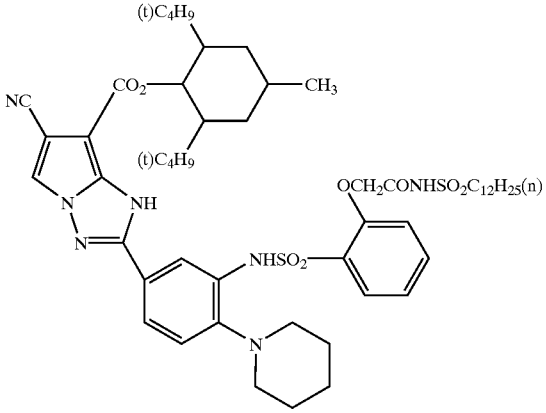
(CC-16)
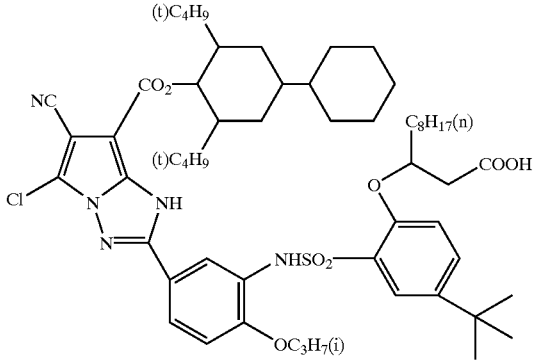
(CC-17)
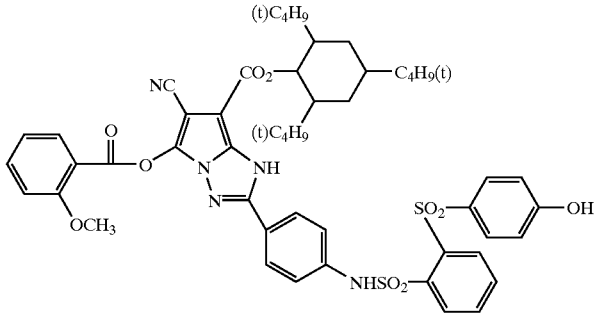
(CC-18)
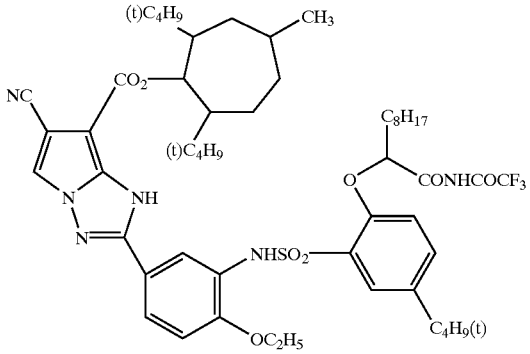
(CC-19)
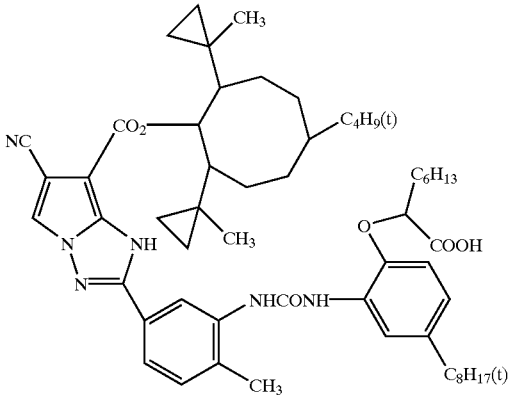

-continued
(CC-20)
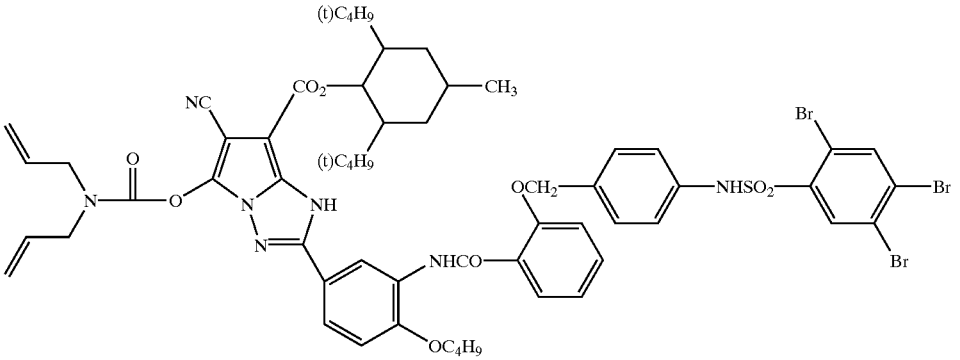
(CC-21)
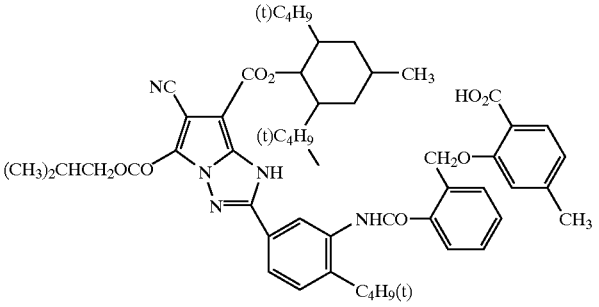
(CC-22)
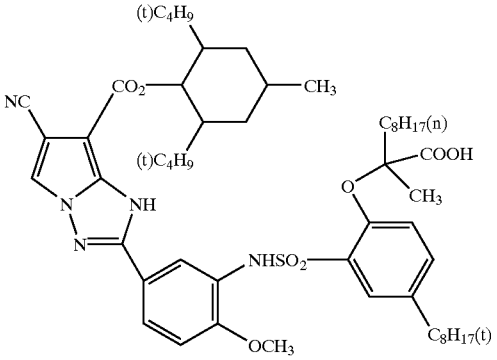
(CC-23)
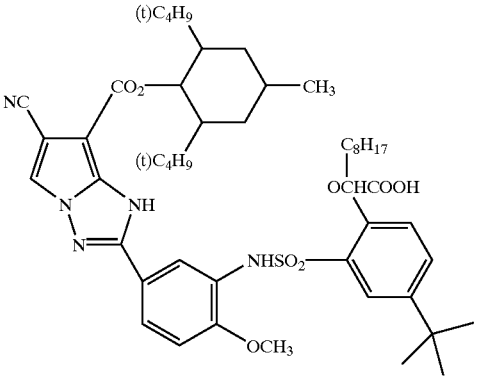
(CC-24)
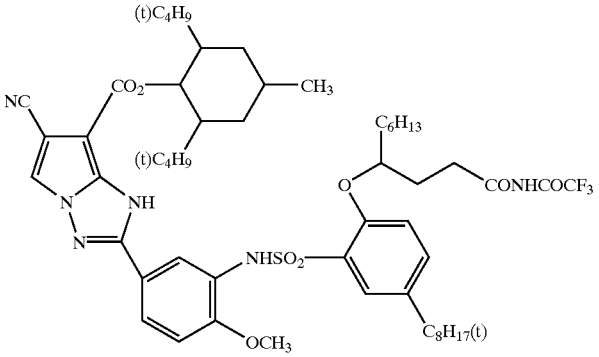
(CC-25)
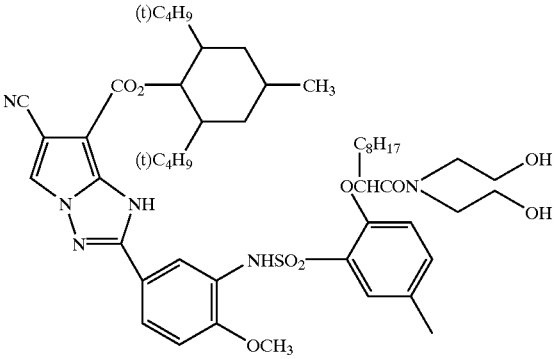
(CC-26)
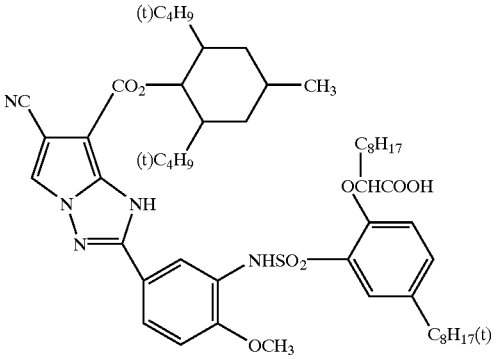

-continued
(CC-27)
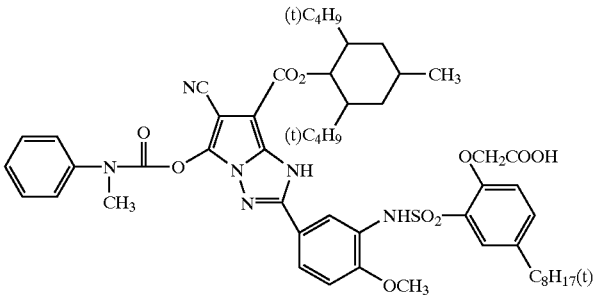
(CC-28)
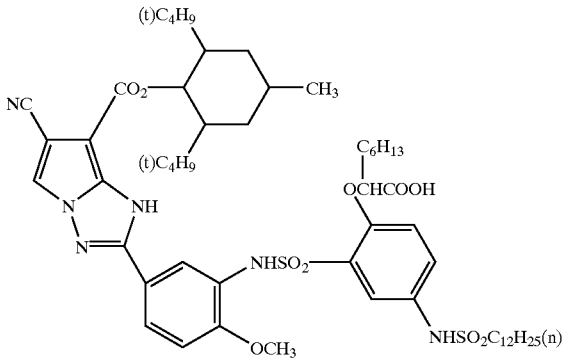
(CC-29)
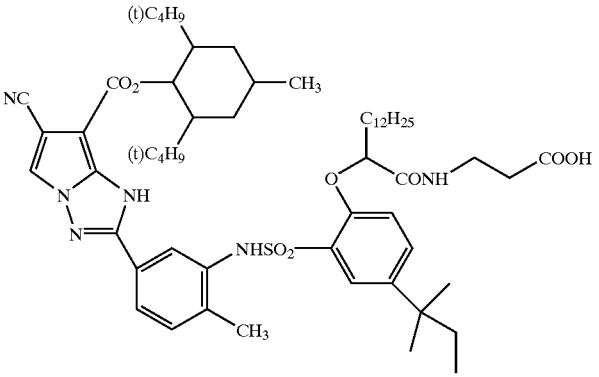
(CC-30)
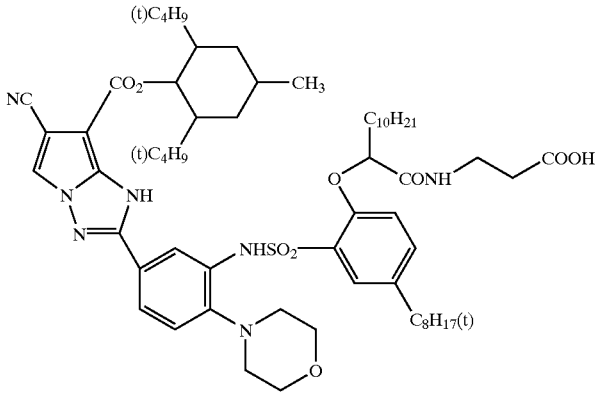
(CC-31)
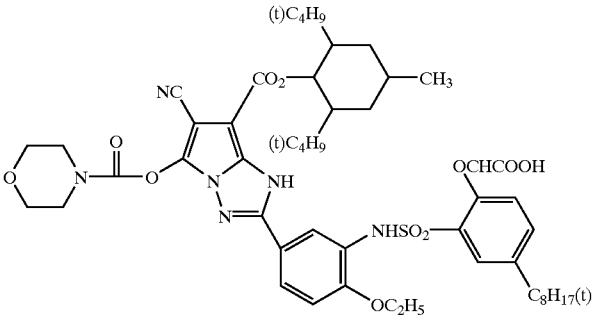
(CC-32)
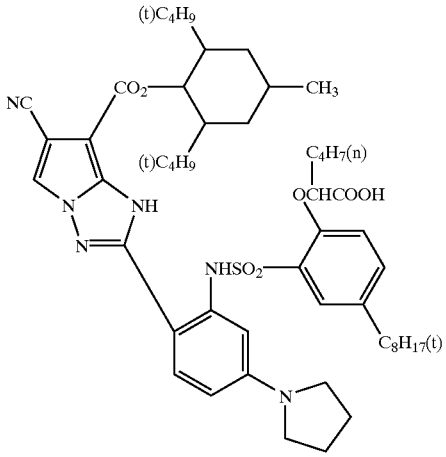

-continued
(CC-33)
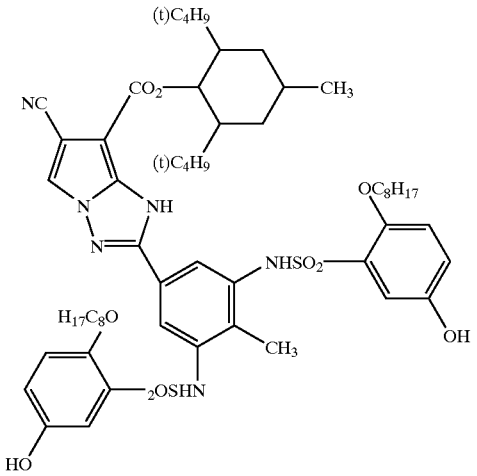
(CC-34)
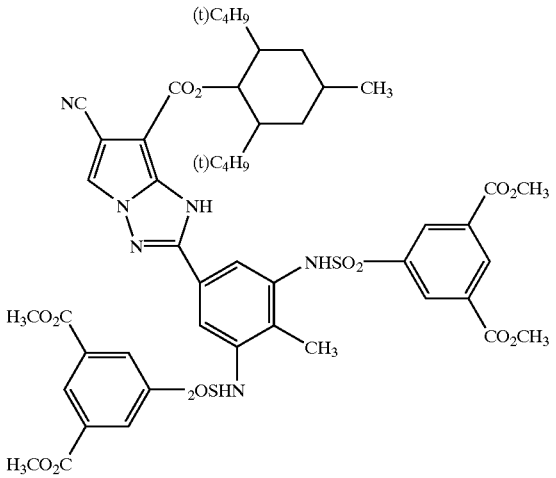
(CC-35)
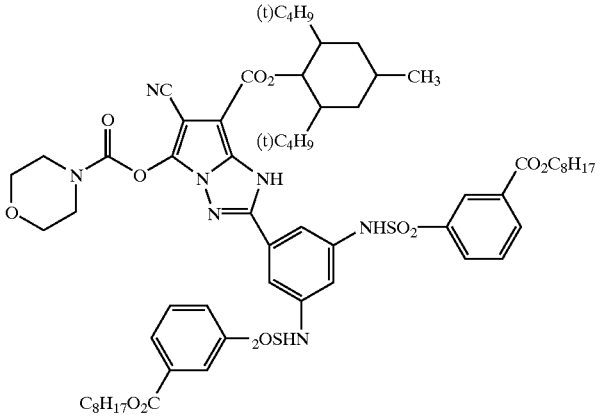
(CC-36)
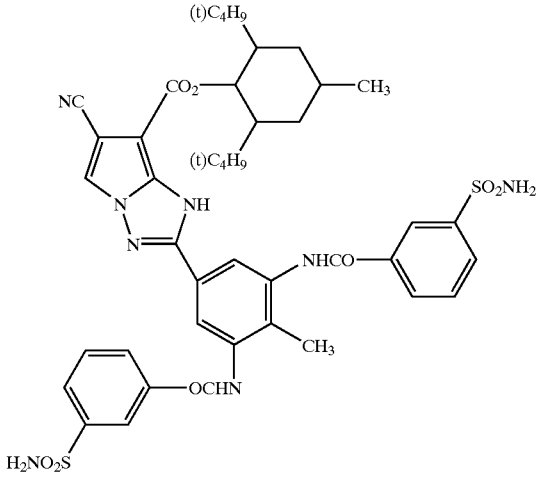
(CC-37)
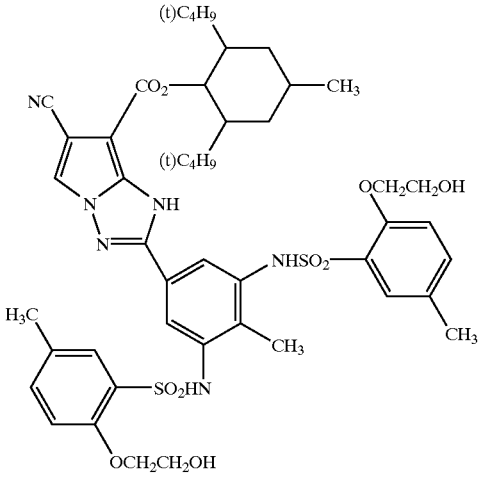
(CC-38)
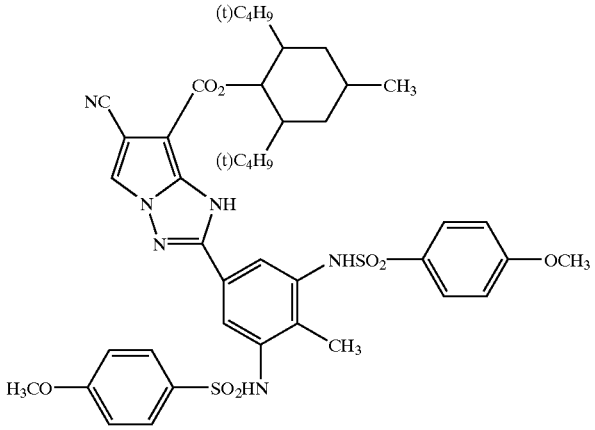

-continued
(CC-39)
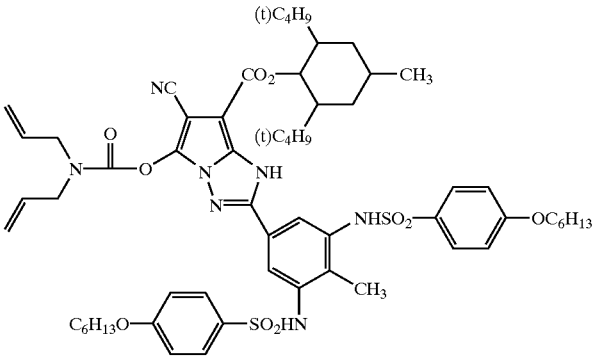
(CC-40)
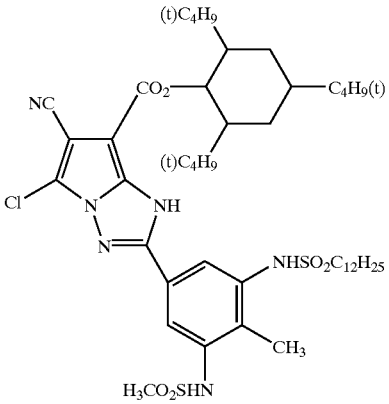
(CC-41)
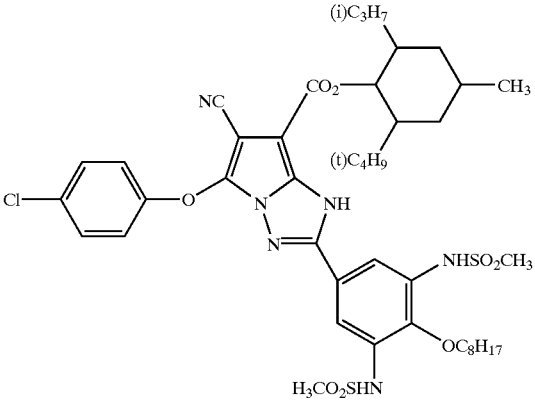
(CC-42)
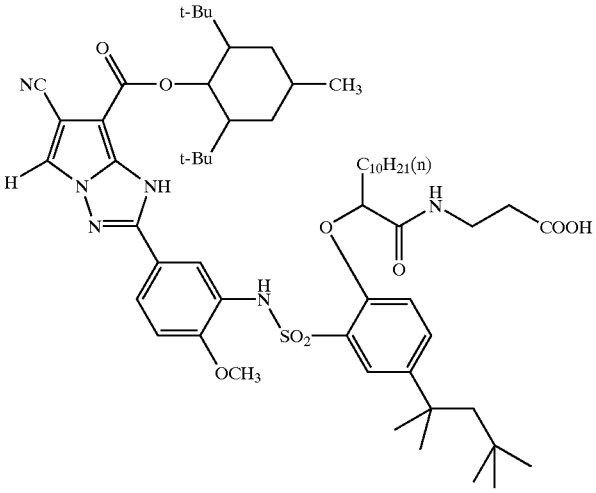
(CC-43)
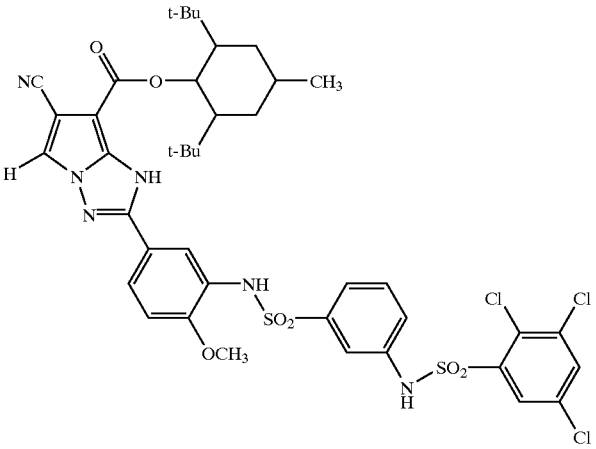
(CC-44)
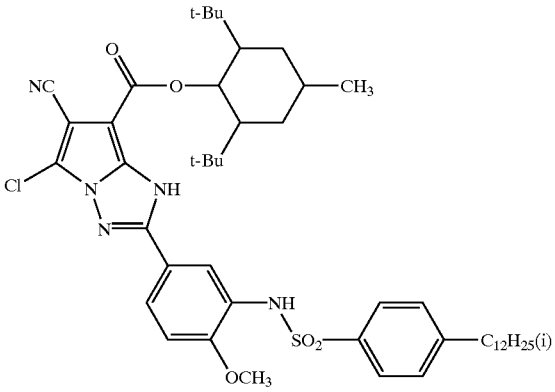

-continued (CC-45)

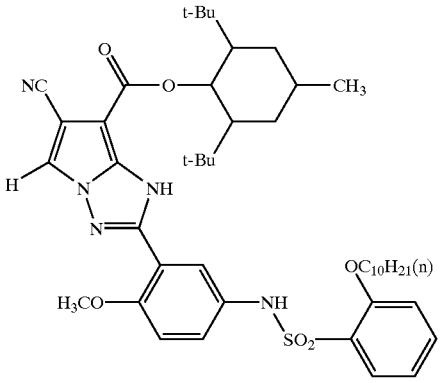

(CC-46)

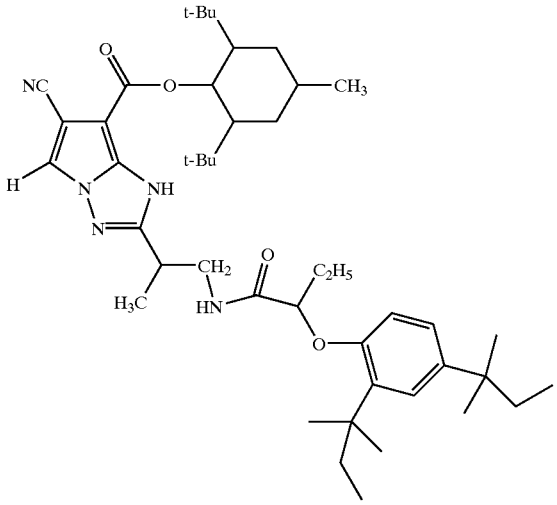

(CC-47)

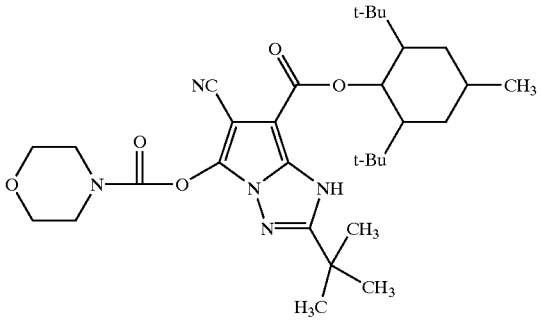

(CC-48)

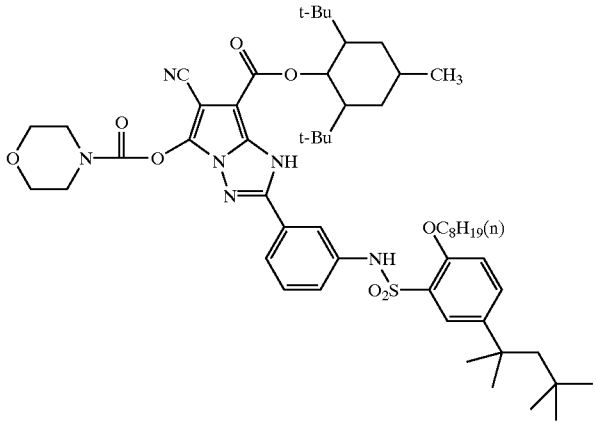

(CC-49)

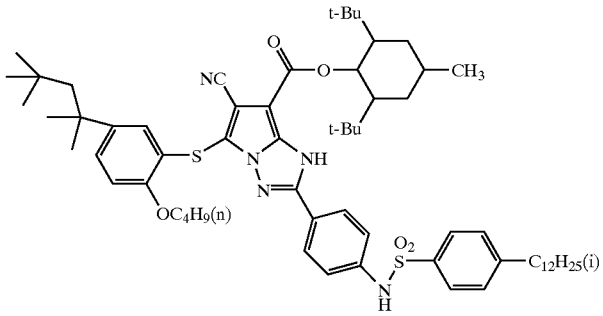

(CC-50)

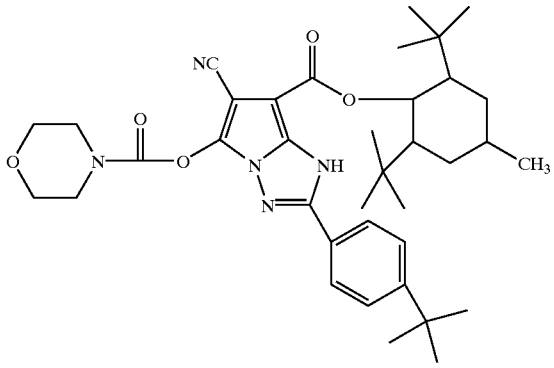

The compound represented by formula (CC-I) of the present invention can be synthesized by known methods, e.g., methods described in J.C.S., 1961, page 518, J.C.S., 1962, page 5,149, Angew. Chem., Vol. 72, page 956 (1960), and Berichte, Vol. 97, page 3,436 (1964), and literature or similar methods cited in these literature.

Couplers bnn(which give maximum densities of 3.0 or more of yellow, magenta, and cyan of a color image after color development (the same shall apply hereinafter)) of the present invention can be introduced to a photosensitive material by various known dispersion methods. Of these methods, an oil-in-water dispersion method is preferable in which a coupler is dissolved in a high-boiling organic solvent (used in combination with a low-boiling solvent where necessary), the solution is dispersed by emulsification in an aqueous gelatin solution, and the dispersion is added to a silver halide emulsion.

Examples of the high-boiling solvent used in this oil-in-water dispersion method are described in, e.g., U.S. Pat. No. 2,322,027, the disclosure of which is incorporated herein by reference. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104. Dispersion using an organic solvent-soluble polymer is described in PCT International Publication W088/00723.

Examples of the high-boiling solvent usable in the above-mentioned oil-in-water dispersion method are phthalic acid esters (e.g., dibutyl phthalate, dioctyl phthalate, dicyclohexyl phthalate, di-2-ethylhexyl phthalate, decyl phthalate, bis(2,4-di-tert-amylphenyl)iso phthalate, and bis(1,1-diethylpropyl) phthalate), esters of phosphoric acid or phosphonic acid (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, and di-2-ethylhexylphenyl phosphate), benzoic acid esters (e.g., 2-ethylhexyl benzoate, 2,4-dichloro benzoate, dodecyl benzoate, and 2-ethylhexyl-p-hydroxy benzoate), amides (e.g., N,N-diethyldodecaneamide and N,N-diethyllaurylamide), alcohols and phenols (e.g., isostearylalcohol and 2,4-di-tert-amylphenol), aliphatic esters (e.g., dibutoxyethyl succinate, di-2-ethylhexyl succinate, 2-hexyldecyl tetradecanate, tributyl citrate, diethyl azelate, isostearyl lactate, and trioctyl tosylate), aniline derivatives (e.g., N,N-dibutyl-2-butoxy-5-tert-octylaniline), chlorinated paraffins (paraffins containing 10% to 80% of chlorine), trimesic acid esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy)butyric acid and 2-ethoxyoctanedecanic acid), and alkylphosphoric acids (e.g., di-(2-ethylhexyl)phosphoric acid and diphenylphosphoric acid). In addition to the above high-boiling solvents, compounds described in, e.g., JP-A-6-258803 can also be preferably used as high-boiling solvents.

Of these compounds, phosphoric acid esters are preferable, and the combination of phosphoric acid esters with alcohols or phenols is also preferable.

The weight ratio of a high-boiling organic solvent to a coupler of the present invention is preferably 0 to 2.0, more preferably, 0 to 1.0, and most preferably, 0 to 0.5.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C.

The content of a coupler of the present invention in a photosensitive material is 0.01 to 10 g, preferably 0.1 g to 2 g per $m^2$. The content is $1\times10^{-3}$ to 1 mol, preferably $2\times10^{-3}$ to $3\times10^{-1}$ mol per mol of a silver halide in the same photosensitive emulsion layer.

When a photosensitive layer has a unit configuration including two or more photosensitive emulsion layers differing in speed, the coupler content of the present invention per mol of a silver halide is preferably $2\times10^{-3}$ to $1\times10^{-1}$ mol in a low-speed layer and $3\times10^{-2}$ to $3\times10^{-1}$ mol in a high-speed layer.

The magenta-generating, 2-equivalent coupler of the present invention and the coupler represented by formula (MC-I) are preferably added to a green-photosensitive emulsion layer. Also, a cyan-generating, 2-equivalent coupler of the present invention and a coupler represented by formula (CC-I) are preferably added to a red-sensitive emulsion layer.

In the present invention, the 2-equivalent coupler or a coupler represented by formula (MC-I) or (CC-I) is preferably contained. Although another coupler can also be used together with these couplers, the results become more preferable as the ratio of a color dye arising from the coupler of the present invention in the contribution to the total density of dyes which form substantially the same color increases. More specifically, the amount is such that the 2-equivalent coupler or a coupler represented by formula (MC-I) or (CC-I) preferably occupies 30 mol % or more, more preferably 50 mol % or more, much more preferably 70 mol % or more among the couplers giving substantially the same color.

The photosensitive material of the present invention can also contain a competing compound (a compound which competes with an image forming coupler to react with the oxidized form of an anomatic primary amine color developing agent and which does not form any dye image). Examples of this competing coupler are reducing compounds such as hydroquinones, catechols, hydrazines, and sulfonamidophenols, and compounds which couple with the oxidized form of an anomatic primary amine color developing agent but do not substantially form a color image (e.g., colorless compound-forming couplers disclosed in German Patent No. 1,155,675, British Patent No. 861,138, and U.S. Pat. Nos. 3,876,428 and 3,912,513, the disclosures of which are incorporated herein by reference, and flow-out couplers disclosed in JP-A-6-83002, the disclosure of which is incorporated herein by reference).

The competing compound is preferably added to a photosensitive emulsion layer containing the magenta coupler of the present invention or a non-photosensitive layer. The competing compound is particularly preferably added to a photosensitive emulsion layer containing a coupler of the present invention. The content of a competing compound is 0.01 to 10 g, preferably 0.10 to 5.0 g per $m^2$ of a photosensitive material. The content is 1 to 1,000 mol %, preferably 20 to 500 mol % with respect to a coupler of the present invention.

In a photosensitive material of the present invention, a photosensitive unit comprising emulsion layers sensitive to the same color but different in speed can have a non-color-generating interlayer. Additionally, this interlayer preferably contains a compound selectable as the aforementioned competing compound.

To prevent deterioration of the photographic properties caused by formaldehyde gas, a photosensitive material of the present invention preferably contains a compound described in U.S. Pat. Nos. 4,411,987 or 4,435,503, which can react with and fix formaldehyde gas.

A photosensitive material of the present invention need only have at least one blue-sensitive silver halide emulsion layer, at least one green-sensitive silver halide emulsion layer, and at least one red-sensitive silver halide emulsion layer on a support. Although a support is preferably coated with these layers in this order from the farthest one from the support, the order can also be changed.

In the present invention, it is preferable to form red-, green-, and blue-sensitive silver halide emulsion layers in this order from the closest one to a support. Each color-sensitive layer preferably has a unit configuration including two or more photosensitive emulsion layers different in sensitivity. More preferably, each color-sensitive layer has a three-layered unit configuration including three photosensitive emulsion layers, i.e., low-, medium-, and high-speed layers formed in this order from the closest one to a support.

In the present invention, silver halide grains having substantially no photosensitivity besides photosensitive silver halide are used in a photosensitive emulsion layer, an interlayer between two photosensitive emulsion layers and/or an interlayer between a photosensitive emulsion layer closest to a support and the support. This enhances the effect of improving processing nonuniformity.

In the present invention, "having substantially no photosensitivity" is defined that the relative sensitivity to photosensitive silver halide having the lowest sensitivity in a photosensitive material is 1/100 or less (more preferably, 1/1,000 or less).

The silver halide emulsion grains having substantially no photosensitivity used in the invention are preferably silver bromide, silver iodobromide, silver chloride, silver iodide, silver bromochloroiodide, or silver chlorobromide, and more preferably, silver bromide, silver iodide, or silver iodobromide, having an average equivalent-sphere diameter of 0.02 to less than 0.15 $\mu$m (more preferably, 0.03 to 0.10 $\mu$m). When the silver halide emulsion grains are silver iodobromide, the silver iodide content is preferably 1 to 20 mol %.

The surface or the interior of the silver halide grain having substantially no photosensitivity may or may not be fogged. In the present invention, the silver halide grain is unfogged silver bromide, silver iodide, or silver iodobromide containing 1% to 20% of silver iodide. The average equivalent-sphere grain size is preferably 0.03 to 0.10 $\mu$m.

When the silver halide fine grains having substantially no photosensitivity are added to a photosensitive emulsion layer, the addition amount is preferably 1% to 30%, and more preferably, 1% to 15%, as a silver molar ratio, with respect to the total silver halide in the layer.

When the silver halide fine grains having substantially no photosensitivity are added to an interlayer, the silver amount is preferably 1 mg to 1 g, and more preferably, 10 mg to 0.3 g per $m^2$ of a photosensitive material. When the grains are added to an interlayer, this interlayer is preferably positioned between two photosensitive emulsion layers or between a support and a photosensitive emulsion layer closest to the support. More preferably, in a photosensitive material in which photosensitive emulsion layers are arranged in the order of red-, green-, and blue-sensitive layers from the closest one to a support, this interlayer is positioned between the green- and red-sensitive layers or between the support and the red-sensitive layer.

In the present invention, the silver halide grains are preferably unfogged non-photosensitive silver bromide or silver iodobromide (the silver iodide content is preferably 1% to 20%, and more preferably, 1% to 10%). The silver halide grains are preferably used together with a photosensitive emulsion within the range of 1% to 15% as a molar ratio with respect to the total silver halide in a photosensitive emulsion layer containing the grains.

Photosensitive silver halide emulsions to be contained in a photosensitive material of the present invention will be described below.

Photosensitive silver halide grains for use in the present invention are silver bromide, silver chloride, silver iodide, silver chlorobromide, silver iodochloride, silver iodobromide, or silver bromochloroiodide. A silver halide grain can also contain another silver salt, such as silver rhodanate, silver sulfide, silver selenide, silver carbonate, silver phosphate, or organic acid silver, as another grain or as a portion of the grain. In the present invention, silver iodobromide or silver bromochloroiodide is preferable. The silver iodide content is preferably 0.5 to 30 mol %, more preferably, 1 to 10 mol %, and most preferably 1 to 5 mol %.

Photosensitive silver halide grains for use in the present invention can be selected in accordance with the intended use. Examples are a regular crystal not containing a twin plane and crystals explained in Japan Photographic Society ed., The Basis of Photographic Engineering, Silver Salt Photography (CORONA PUBLISHING CO., LTD. (1979)), page 163, such as a single twinned crystal containing one twin plane, a parallel multiple twinned crystal containing two or more parallel twin planes, and a nonparallel multiple twinned crystal containing two or more nonparallel twin planes. A method of mixing grains having different shapes is disclosed in U.S. Pat. No. 4,865,964, and this method can be selected as needed. In the case of a regular crystal, it is possible to use a cubic grain constituted by (100) faces, an octahedral grain constituted by (111) faces, or a dodecahedral grain constituted by (110) faces disclosed in JP-B-55-42737 or JP-A-60-222842.

It is also possible to use, in accordance with the intended use, an (h11) face grain represented by a (211) face grain, an (hh1) face grain represented by a (331) face grain, an (hk0) face grain represented by a (210) face grain, or an (hk1) face grain represented by a (321) face grain, as reported in Journal of Imaging Science, Vol. 30, page 247, 1986, although the preparation method requires some improvements. A grain having two or more different faces, such as a tetradecahedral grain having both (100) and (111) faces, a grain having (100) and (110) faces, or a grain having (111) and (110) faces, can also be used in accordance with the intended use.

A value obtained by dividing the equivalent-circle diameter of the projected area of a grain by the thickness of that grain is called an aspect ratio that defines the shape of a tabular grain.

Tabular grains having aspect ratios higher than 1 are preferably used in the present invention. Particularly favorable results can be obtained when tabular grains having an aspect ratio of 2 or more account for 50% or more (more preferably 70% or more) as a silver ratio of all photosensitive silver halide grains.

Tabular grains can be prepared by the methods described in, e.g., Cleve, Photography Theory and Practice (1930), page 131; Gutoff, Photographic Science and Engineering, Vol. 14, pages 248 to 257, (1970); and U.S. Pat. Nos. 4,434,226, 4,414,310, 4,433,048, and 4,439,520, and British Patent 2,112,157.

The shape of a tabular grain can be selected from, e.g., a triangle, hexagon, and circle. A regular hexagon having six substantially equal side length as described in U.S. Pat. No. 4,797,354 is a preferred form.

An equivalent-circle diameter of a projected area is often used as the grain size of a tabular grain. To improve the image quality, grains with an average diameter of 0.6 $\mu$m or smaller such as described in U.S. Pat. No. 4,748,106 are preferable. Also, as the shape of a tabular grain, limiting the grain thickness to 0.5 $\mu$m or less, more preferably, 0.3 $\mu$m or less is preferable to improve the sharpness. Grains described in JP-A-63-163451 in which the grain thickness and the distance between twin planes are defined are also preferable.

More desirable results can sometimes be obtained when monodisperse tabular grains with a narrow grain size distribution are used. U.S. Pat. No. 4,797,354 and JP-A-2-838 describe methods of manufacturing monodisperse hexagonal tabular grains with high tabularity. EP514,742 describes a method of manufacturing tabular grains having a grain size distribution variation coefficient of less than 10% by using a polyalkyleneoxide block copolymer. The use of these tabular grains in the present invention is preferred. Grains with a grain thickness variation coefficient of 30% or less, i.e., with a high thickness uniformity, are also preferred.

The sensitive silver halide emulsion of the present invention is preferably a monodisperse emulsion having a narrow grain size distribution. More specifically, it is desirable to use a monodisperse emulsion having a size distribution with an equivalent-sphere diameter variation coefficient of preferably 25% or less, more preferably, 20% or less, and much more preferably, 15% or less.

In silver halide photosensitive materials of the present invention and silver halide photosensitive emulsions used therein, it is generally possible to use various techniques and inorganic and organic materials described in Research Disclosure Nos. 308119 (1989), 37038 (1995), and 40145 (1997).

In addition, and more specifically, techniques and inorganic and organic materials usable in color photosensitive materials of the present invention can be applied are described in portions of EP436,938A2 and patents cited below, the disclosures of which are incorporated herein by reference.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers usable together | page 137, line 35 to page 146, line 33, and page 149, lines 21 to 23 |
| 4) | Magenta couplers usable together | page 149, lines 24 to 28; EP421,453A1, page 3, line 5 to page 25, line 55 |
| 5) | Cyan couplers usable together | page 149, lines 29 to 33; EP432,804A2, page 3, line 28 to page 40, line 2 |
| 6) | Polymer couplers | page 149, lines 34 to 38; EP435,334A2, page 113, line 39 to page 123, line 37 |
| 7) | Colored couplers | page 53, line 42 to page 137, line 34, and page 149, lines 39 to 45 |
| 8) | Functional couplers usable together | page 7, line 1 to page 53, line 41, and page 149, line 46 to page 150, line 3; EP435,334A2, page 3, line 1 to page 29, line 50 |
| 9) | Antiseptic and mildewproofing agents | page 150, lines 25 to 28 |
| 10) | Formalin scavengers | page 149, lines 15 to 17 |
| 11) | Other additives usable together | page 153, lines 38 to 47; EP421,453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |
| 14) | Film thickness-film physical properties | page 150, lines 35 to 49 |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |
| 18) | Washing-stabilizing steps | page 153, lines 3 to 37 |

EXAMPLE-1

The present invention will be described in detail below by way of its examples, but the invention is not limited to these examples.

Making of Sample 101

A multilayered color photosensitive material including layers having the following compositions was formed on a 127-$\mu$m thick undercoated cellulose triacetate film support to make sample 101. Numbers represent addition amounts per $m^2$. Note that the effects of added compounds are not restricted to the described purposes.

Following Example 1 of JP-A-63-285548, in sample 101 all photosensitive silver halide grains were monodisperse grains and were adjusted such that the total silver halide coating amount was 4.4 g.

1st Layer: Antihalation Layer

| | |
|---|---|
| Black colloidal silver | 0.18 g |
| Gelatin | 1.50 g |
| Ultraviolet absorbent U-1 | 0.10 g |
| Ultraviolet absorbent U-3 | 0.10 g |
| Ultraviolet absorbent U-4 | 0.10 g |
| Ultraviolet absorbent U-6 | 0.30 g |
| High-boiling organic solvent Oil-1 | 0.10 g |
| Dye D-4 | 1.0 mg |
| Dye D-8 | 2.5 mg |
| Fine crystal solid dispersion of dye E-1 | 0.10 g |

2nd Layer: Interlayer

| | |
|---|---|
| Gelatin | 0.40 g |
| Compound Cpd-C | 0.5 mg |
| Compound Cpd-J | 1.0 mg |
| Compound Cpd-K | 2.0 mg |
| Compound Cpd-M | 0.030 g |
| High-boiling organic solvent Oil-3 | 0.010 g |
| High-boiling organic solvent Oil-4 | 0.020 g |
| High-boiling organic solvent Oil-5 | 0.010 g |
| High-boiling organic solvent Oil-7 | 2.0 mg |
| High-boiling organic solvent Oil-8 | 5.0 mg |
| Dye D-7 | 2.5 mg |

3rd Layer: Interlayer

| | |
|---|---|
| Gelatin | 0.30 g |
| Compound Cpd-M | 0.010 g |
| High-boiling organic solvent Oil-3 | 0.010 g |
| Dye D-9 | 5.0 mg |

4th Layer: Low-speed Red-sensitive Emulsion Layer

| | |
|---|---|
| Silver iodobromide emulsion A silver | 0.20 g |
| Silver iodobromide emulsion B silver | 0.20 g |
| Silver iodobromide emulsion C silver | 0.10 g |
| Gelatin | 0.60 g |
| Coupler C-1 | 0.15 g |
| Compound Cpd-C | 5.0 mg |
| Compound Cpd-I | 0.020 g |
| Compound Cpd-J | 5.0 mg |
| High-boiling organic solvent Oil-2 | 0.070 g |
| Additive P-1 | 0.10 g |

5th Layer: Medium-speed Red-sensitive Emulsion Layer

| | |
|---|---|
| Silver iodobromide emulsion C silver | 0.20 g |
| Silver iodobromide emulsion D silver | 0.20 g |

-continued

| | |
|---|---|
| Gelatin | 0.80 g |
| Coupler C-1 | 0.22 g |
| High-boiling organic solvent Oil-2 | 0.10 g |
| Additive P-1 | 0.10 g |

6th Layer: High-speed Red-sensitive Emulsion Layer

| | |
|---|---|
| Silver iodobromide emulsion E silver | 0.20 g |
| Silver iodobromide emulsion F silver | 0.25 g |
| Gelatin | 1.20 g |
| Coupler C-2 | 0.90 g |
| High-boiling organic solvent Oil-2 | 0.10 g |
| Compound Cpd-K | 2.0 mg |
| Compound Cpd-F | 0.050 g |
| Additive P-1 | 0.10 g |

7th Layer: Interlayer

| | |
|---|---|
| Gelatin | 0.70 g |
| Additive P-2 | 0.30 g |
| Compound Cpd-I | 0.010 g |
| Dye D-5 | 0.020 g |
| Dye D-6 | 0.010 g |
| Compound Cpd-M | 0.040 g |
| Compound Cpd-O | 3.0 mg |
| Compound Cpd-P | 2.5 mg |
| High-boiling organic solvent Oil-6 | 0.050 g |

8th Layer: Interlayer

| | |
|---|---|
| Gelatin | 0.80 g |
| Additive P-1 | 0.05 g |
| Compound Cpd-A | 0.10 g |
| Compound Cpd-M | 0.050 g |
| High-boiling organic solvent Oil-6 | 0.10 g |

9th Layer: Low-speed Green-sensitive Emulsion Layer

| | |
|---|---|
| Silver iodobromide emulsion G silver | 0.30 g |
| Silver iodobromide emulsion H silver | 0.30 g |
| Silver iodobromide emulsion I silver | 0.20 g |
| Gelatin | 1.20 g |
| Coupler C-3 | 0.27 g |
| Compound Cpd-B | 0.030 g |
| Compound Cpd-D | 0.020 g |
| Compound Cpd-E | 0.020 g |
| Compound Cpd-G | 2.5 mg |
| Compound Cpd-F | 0.040 g |
| Compound Cpd-K | 2.0 mg |
| Compound Cpd-L | 0.020 g |
| High-boiling organic solvent Oil-2 | 0.10 g |

10th Layer: Medium-speed Green-sensitive Emulsion Layer

| | |
|---|---|
| Silver iodobromide emulsion I silver | 0.25 g |
| Silver iodobromide emulsion J silver | 0.35 g |
| Gelatin | 0.70 g |
| Coupler C-4 | 0.35 g |
| Compound Cpd-B | 0.030 g |
| Compound Cpd-D | 0.020 g |
| Compound Cpd-F | 0.050 g |

-continued

| | |
|---|---|
| Compound Cpd-G | 2.0 mg |
| High-boiling organic solvent Oil-2 | 0.10 g |

11th Layer: High-speed Green-sensitive Emulsion Layer

| | |
|---|---|
| Silver iodobromide eruulsion K silver | 0.60 g |
| Gelatin | 0.70 g |
| Coupler C-4 | 0.45 g |
| Compound Cpd-B | 0.080 g |
| Compound Cpd-D | 0.020 g |
| Compound Cpd-F | 0.040 g |
| Compound Cpd-K | 5.0 mg |
| High-boiling organic solvent Oil-2 | 0.15 g |

12th Layer: Interlayer

| | |
|---|---|
| Gelatin | 0.40 g |
| Compound Cpd-M | 0.05 g |
| High-boiling organic solvent Oil-3 | 0.025 g |
| High-boiling organic solvent Oil-6 | 0.025 g |

13th Layer: Yellow Filter Layer

| | |
|---|---|
| Gelatin | 1.00 g |
| Compound Cpd-C | 0.010 g |
| Compound Cpd-M | 0.030 g |
| Compound Cpd-L | 0.010 g |
| High-boiling organic solvent Oil-1 | 0.020 g |
| Fine crystal solid dispersion of dye E-2 | 0.030 g |
| Fine crystal solid dispersion of dye E-3 | 0.020 g |

14th Layer: Interlayer

| | |
|---|---|
| Gelatin | 0.30 g |

15th Layer: Low-speed Blue-sensitive Emulsion Layer

| | |
|---|---|
| Emulsion L silver | 0.15 g |
| Emulsion M silver | 0.20 g |
| Gelatin | 0.80 g |
| Coupler C-5 | 0.30 g |
| Compound Cpd-M | 0.010 g |
| High-boiling organic solvent Oil-3 | 0.050 g |

16th Layer: Medium-speed Blue-sensitive Emulsion Layer

| | |
|---|---|
| Silver iodobromide emulsion N silver | 0.15 g |
| Silver iodobromide einulsion O silver | 0.15 g |
| Gelatin | 0.90 g |
| Coupler C-6 | 0.40 g |
| Compound Cpd-N | 2.0 mg |
| High-boiling organic solvent Oil-2 | 0.070 g |

17th Layer: High-speed Blue-sensitive Emulsion Layer

| | |
|---|---|
| Silver iodobromide emulsion O silver | 0.20 g |
| Silver iodobromide emulsion P silver | 0.20 g |
| Gelatin | 1.30 g |
| Coupler C-6 | 1.10 g |
| High-boiling organic solvent Oil-2 | 0.20 g |
| Compound Cpd-N | 5.0 mg |
| Compound Cpd-Q | 0.20 g |

18th Layer: 1st Protective Layer

| | |
|---|---|
| Gelatin | 0.60 g |
| Ultraviolet absorbent U-1 | 0.10 g |
| Ultraviolet absorbent U-2 | 0.050 g |
| Ultraviolet absorbent U-5 | 0.20 g |
| Ultraviolet absorbent U-6 | 0.20 g |
| Compound Cpd-O | 5.0 mg |
| Compound Cpd-A | 0.030 g |
| Compound Cpd-H | 0.20 g |
| Dye D-1 | 0.10 g |
| Dye D-2 | 0.050 g |
| Dye D-3 | 0.07 g |
| High-boiling organic solvent Oil-3 | 0.10 g |

19th Layer: 2nd Protective Layer

| | |
|---|---|
| Colloidal silver silver | 0.11 mg |
| Fine grain silver iodobromide emulsion (average grain size 0.06 μm, AgI content 1 mol %) silver | 0.10 g |
| Gelatin | 0.50 g |

20th Layer: 3rd Protective Layer

| | |
|---|---|
| Gelatin | 0.60 g |
| Polymethylmethacrylate (average grain size 2.0 μm) | 0.10 g |
| 6:4 copolymer of methylmethacrylate and methacrylic acid (average grain size 1.5 μm) | 0.10 g |
| Silicone oil SO-1 | 0.10 g |
| Surfactant W-3 | 3.0 mg |
| Surfactant W-2 | 0.030 g |
| Surfactant W-7 | 2.5 mg |

In addition to the above compositions, additives F-1 to F-8 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

TABLE 1

Emulsions used in samples

| | Emulsion used in Sample 101 | | | | Emulsion after changes to use in Samples 115, 116 and 117 | | | |
|---|---|---|---|---|---|---|---|---|
| Emulsion | Characteristics | Average equivalent-sphere diameter (μm) | Coefficient of variation (%) | AgI content (%) | Characteristics | Average equivalent-sphere Diameter (μm) | Coefficient of variation (%) | AgI content (%) |
| A | Monodisperse tetradecahedral grains | 0.13 | 10 | 4.5 | | | | 4.5 |
| B | Monodisperse cubic internally fogged grains | 0.25 | 10 | 4.8 | | | | 4.8 |
| C | Monodisperse cubic grains | 0.30 | 10 | 4.0 | Monodisperse (111) tabular grains, average aspect ratio = 2.0 | 0.30 | 15 | 4.0 |
| D | Monodisperse cubic grains | 0.35 | 12 | 4.8 | Monodisperse (111) tabular grains, average aspect ratio = 3.0 | 0.35 | 18 | 4.8 |
| E | Monodisperse cubic grains | 0.40 | 10 | 2.5 | Monodisperse (111) tabular grains, average aspect ratio = 3.0 | 0.40 | 15 | 2.5 |
| F | Monodisperse (111) tabular grains, average aspect ratio = 4.5 | 0.50 | 12 | 2.5 | | | | 2.5 |
| G | Monodisperse cubic grains | 0.15 | 9 | 3.5 | | | | 3.5 |
| H | Monodisperse cubic internally fogged grains | 0.24 | 12 | 4.9 | | | | 4.9 |
| I | Monodisperse tetradecahedral grains | 0.30 | 12 | 3.5 | Monodisperse (111) tabular grains, average aspect ratio = 4.0 | 0.30 | 17 | 3.5 |

TABLE 1-continued

Emulsions used in samples

| Emulsion | Emulsion used in Sample 101 | | | | Emulsion after changes to use in Samples 115, 116 and 117 | | | |
|---|---|---|---|---|---|---|---|---|
| | Characteristics | Average equivalent-sphere diameter (μm) | Coefficient of variation (%) | AgI content (%) | Characteristics | Average equivalent-sphere Diameter (μm) | Coefficient of variation (%) | AgI content (%) |
| J | monodisperse cubic grains | 0.45 | 10 | 3.0 | Monodisperse (111) tabular grains, average aspect ratio = 5.0 | 0.45 | 16 | 3.0 |
| K | Monodisperse (111) tabular grains, average aspect ratio = 5.5 | 0.60 | 13 | 3.5 | | | | 3.5 |
| L | Monodisperse tetradecahedral grains | 0.33 | 10 | 4.5 | | | | 4.5 |
| M | Monodisperse cubic grains | 0.33 | 9 | 6.0 | | | | 6.0 |
| N | Monodisperse cubic grains | 0.43 | 9 | 2.5 | Monodisperse (111) tabular grains, average aspect ratio = 3.0 | 0.43 | −14 | 2.5 |
| O | Monodisperse (111) tabular grains, average aspect ratio = 6.0 | 0.75 | 9 | 3.0 | | | | 3.0 |
| P | Monodisperse (111) tabular grains, average aspect ratio = 6.0 | 0.90 | 8 | 2.8 | | | | 2.8 |

TABLE 2

Spectral sensitization of emulsions A to P

| Emulsion | Spectral sensitizer added | Addition amount per mol of silver halide (g) |
|---|---|---|
| A | S-1 | 0.020 |
| | S-2 | 0.30 |
| | S-3 | 0.020 |
| | S-13 | 0.025 |
| B | S-2 | 0.30 |
| | S-8 | 0.015 |
| | S-13 | 0.025 |
| C | S-2 | 0.30 |
| | S-8 | 0.050 |
| | S-13 | 0.025 |
| D | S-1 | 0.030 |
| | S-2 | 0.25 |
| | S-3 | 0.020 |
| | S-13 | 0.10 |
| E | S-1 | 0.020 |
| | S-2 | 0.20 |
| | S-8 | 0.020 |
| | S-13 | 0.10 |
| F | S-1 | 0.020 |
| | S-2 | 0.25 |
| | S-8 | 0.10 |
| | S-13 | 0.025 |
| G | S-4 | 0.35 |
| | S-5 | 0.15 |
| | S-12 | 0.10 |
| | S-14 | 0.015 |
| H | S-4 | 0.35 |
| | S-12 | 0.10 |
| I | S-4 | 0.30 |
| | S-5 | 0.10 |
| | S-12 | 0.15 |
| J | S-4 | 0.35 |
| | S-9 | 0.15 |
| | S-12 | 0.15 |

TABLE 2-continued

Spectral sensitization of emulsions A to P

| Emulsion | Spectral sensitizer added | Addition amount per mol of silver halide (g) |
|---|---|---|
| | S-14 | 0.010 |
| K | S-4 | 0.30 |
| | S-5 | 0.050 |
| | S-9 | 0.050 |
| | S-12 | 0.15 |
| L | S-6 | 0.30 |
| | S-7 | 0.15 |
| | S-10 | 0.050 |
| M | S-6 | 0.10 |
| | S-10 | 0.15 |
| | S-11 | 0.25 |
| N | S-10 | 0.25 |
| | S-11 | 0.25 |
| O | S-6 | 0.10 |
| O | S-10 | 0.20 |
| | S-11 | 0.25 |
| P | S-6 | 0.050 |
| | S-7 | 0.050 |
| | S-10 | 0.20 |
| | S-11 | 0.25 |

C-1
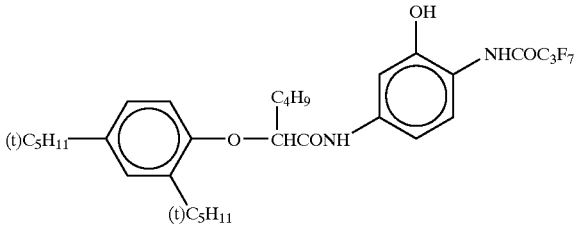
C-2
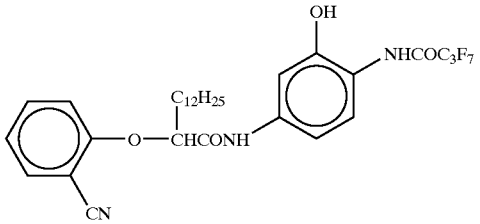
C-3
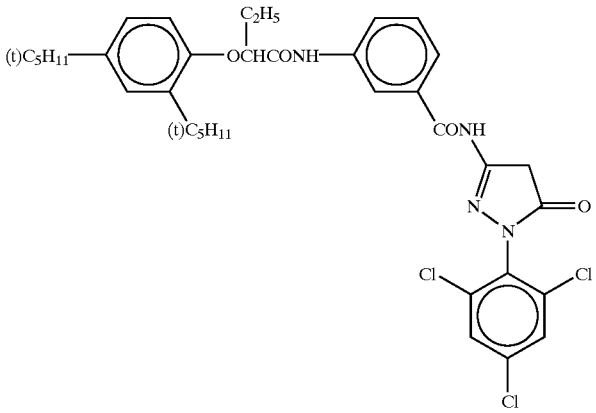
C-4
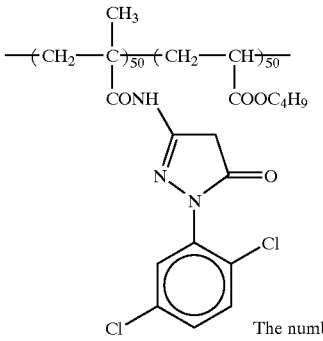
The numbers signify wt. %
Average molecular wt.: about 25,000
C-5
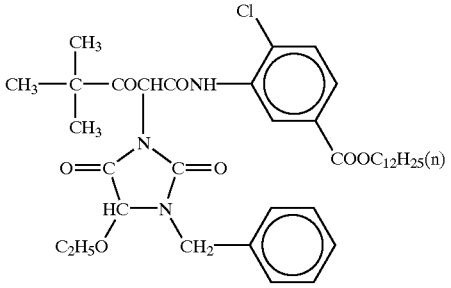
C-6
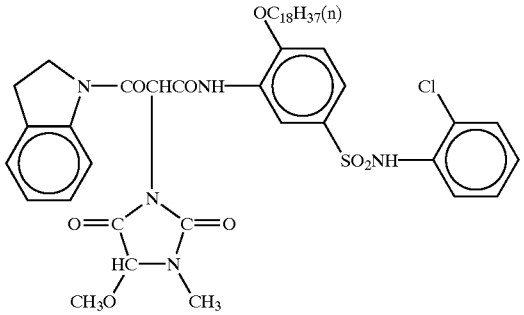
Oil-1
Tri-n-hexyl phosphate
Oil-2
Tricresyl phosphate
Oil-3
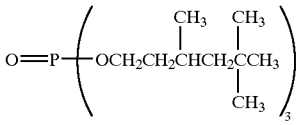
Oil-4
Tricyclohexyl phosphate
Oil-5
Di-2-ethylhexyl succinate
Oil-6
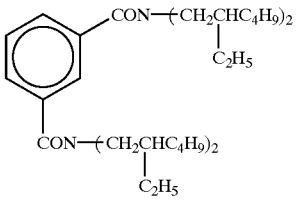
Oil-7
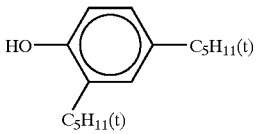
Oil-8
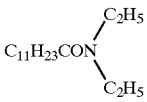

-continued
Cpd-A
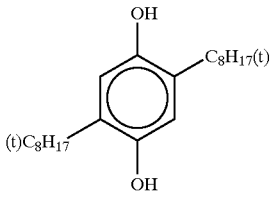
Cpd-B
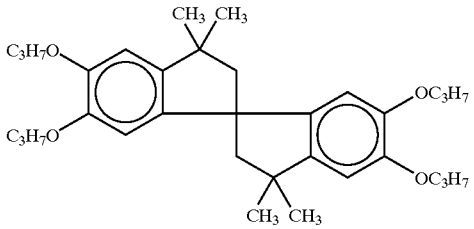
Cpd-C
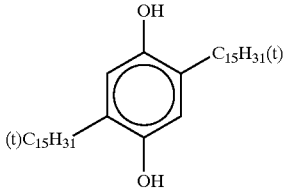
Cpd-D
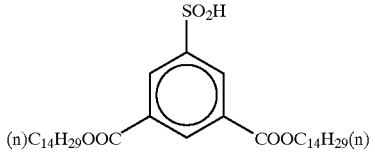
Cpd-E
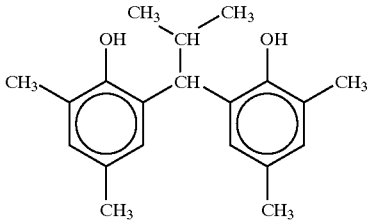
Cpd-F
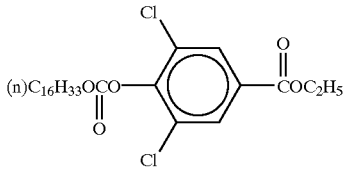
Cpd-G
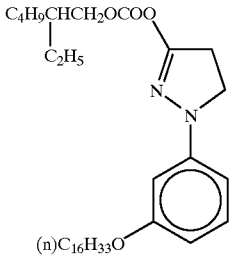
Cpd-H
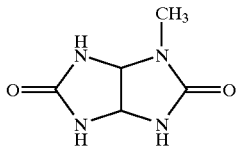
Cpd-I
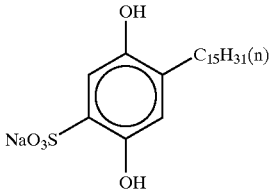
Cpd-J
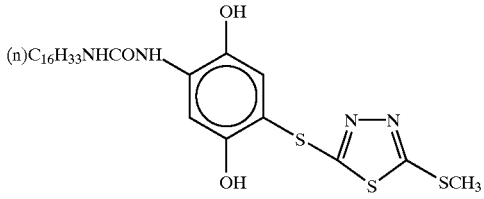
Cpd-K
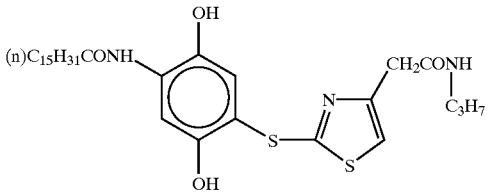
Cpd-L
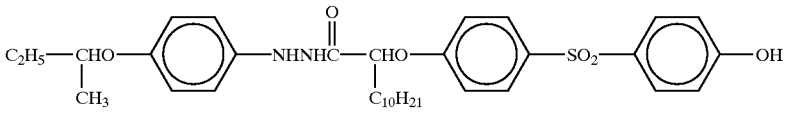

-continued
Cpd-M
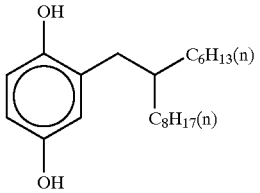
Cpd-N
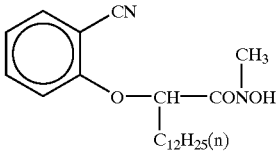
Cpd-O
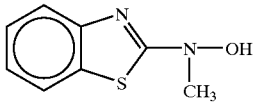
Cpd-P
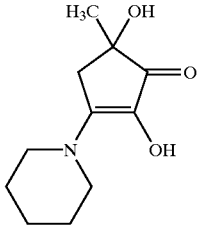
Cpd-Q
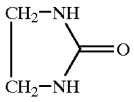
U-1
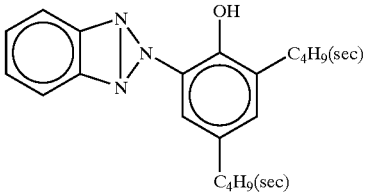
U-2
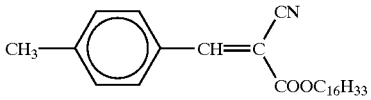
U-3
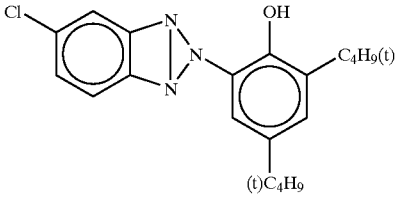
U-4
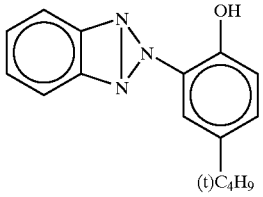
U-5
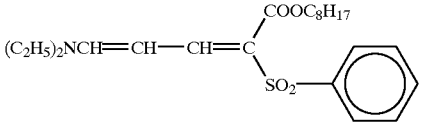
U-6
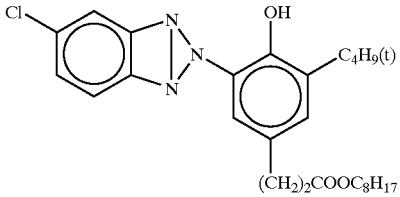
S-1
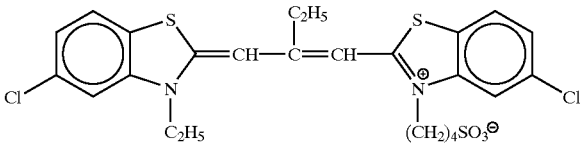
S-2
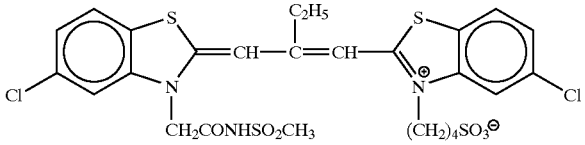
S-3
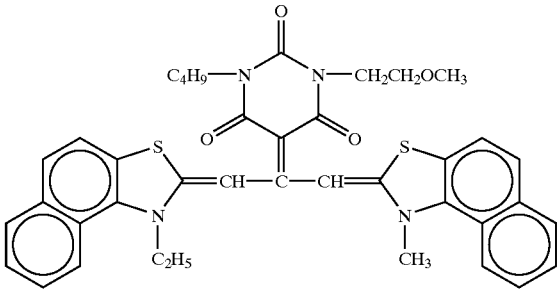

-continued
S-4
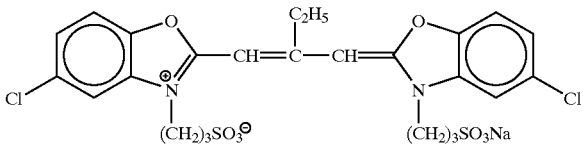
S-5
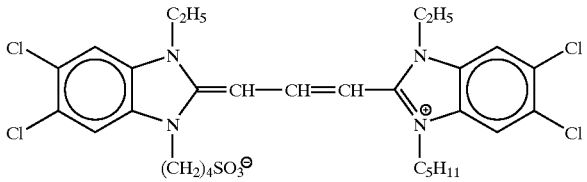
S-6
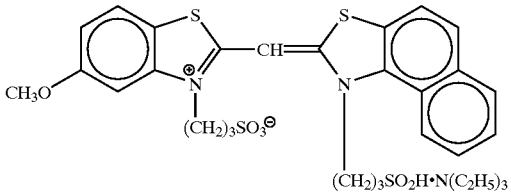
S-7
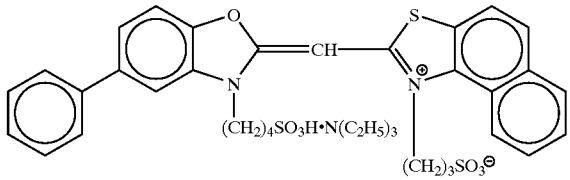
S-8
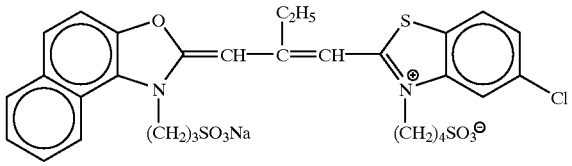
S-9
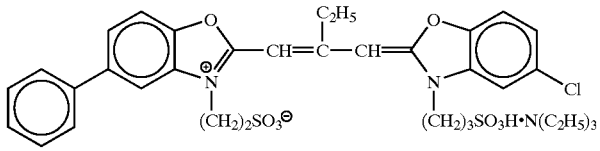
S-10
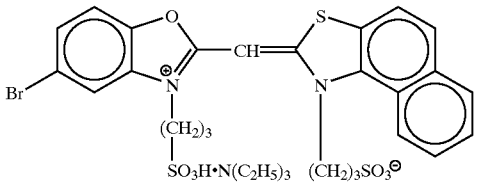
S-11
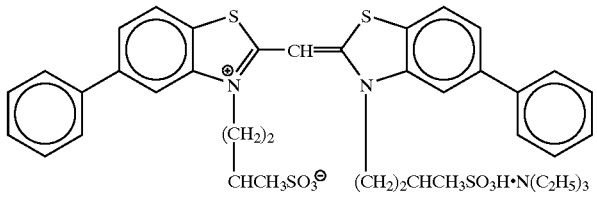
S-12
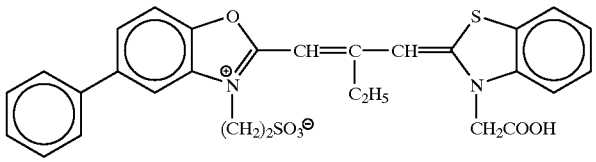
S-13
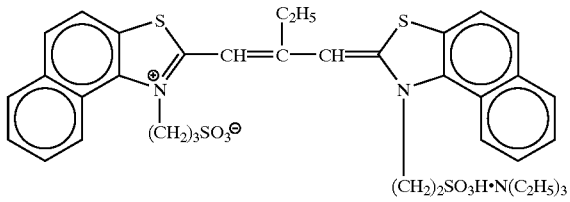
S-14
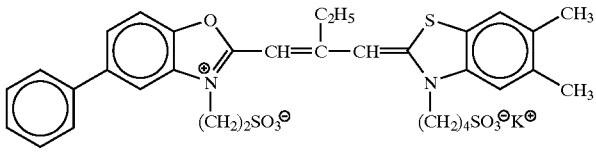
D-1
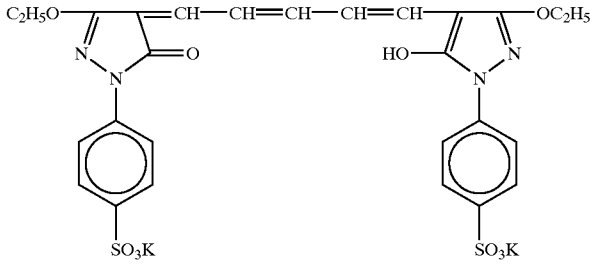

-continued
D-2
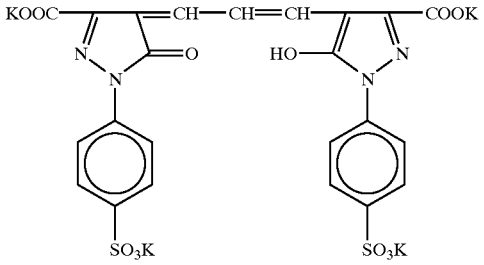
D-3
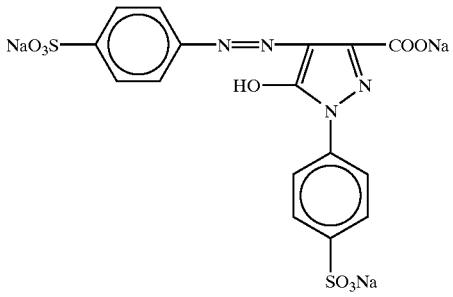
D-4
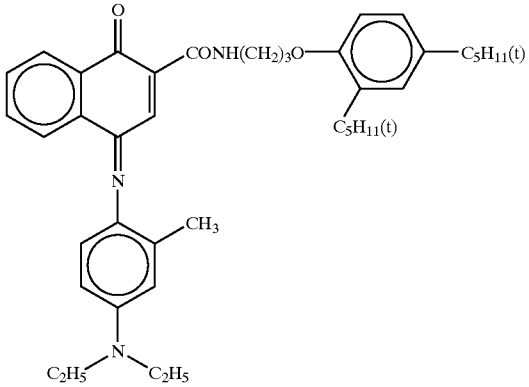
D-5
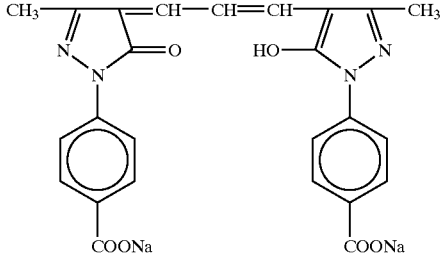
D-6
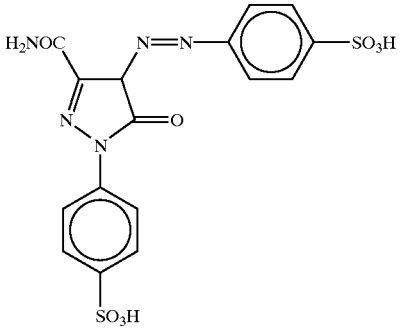
D-7
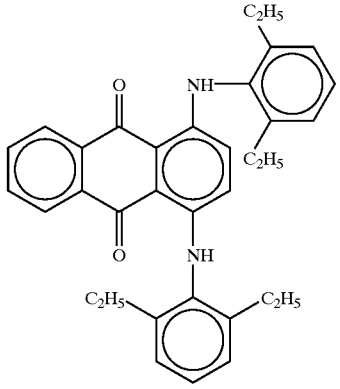
D-8
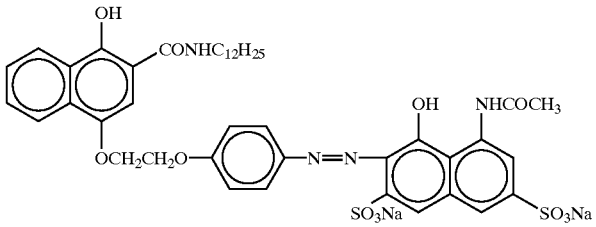
D-9
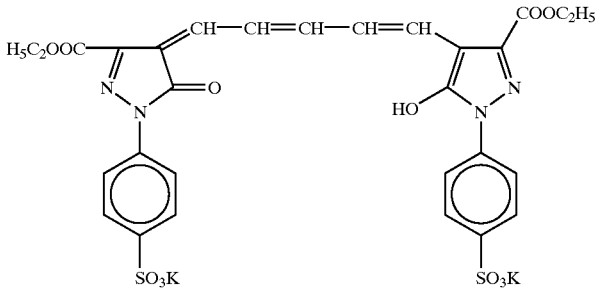
E-1
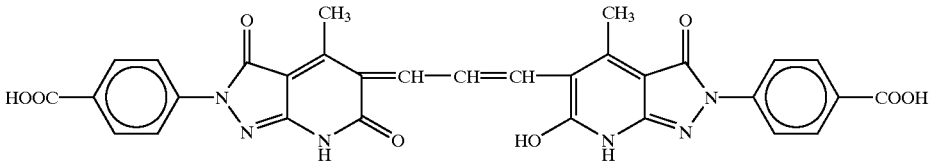

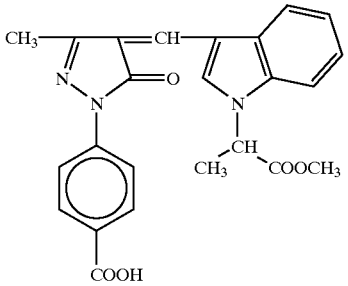
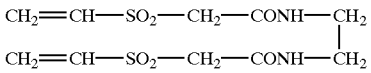
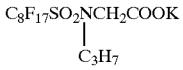
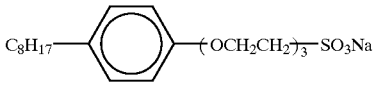
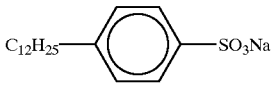
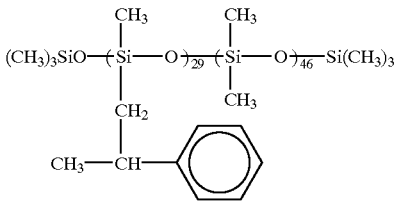
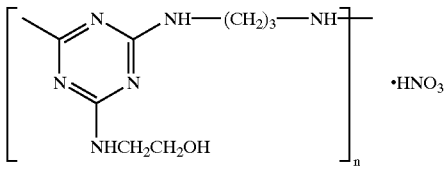
(n = 3–4)
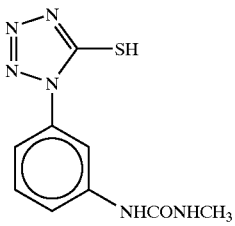
-continued
E-2
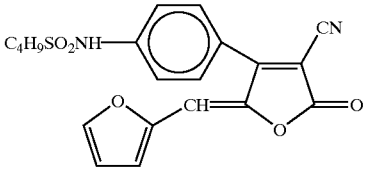
E-3
H-1
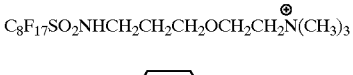
W-1
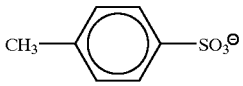
W-2
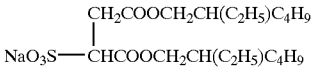
W-3
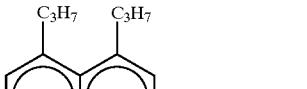
W-4
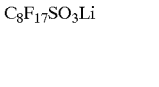
W-5
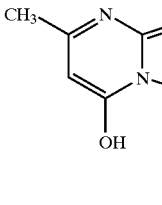
W-6
$C_8F_{17}SO_3Li$
W-7
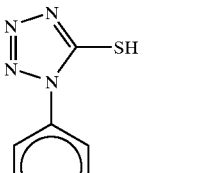
P-1
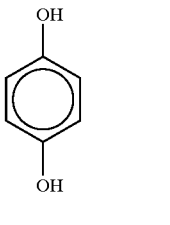
(n = 100–1000)
P-2
(n = 100–1000)
SO-1
F-1
F-2
F-3
F-4
F-5

-continued

F-6

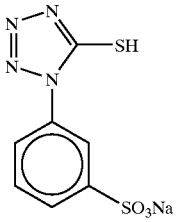

F-7

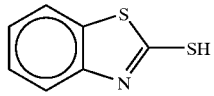

F-8

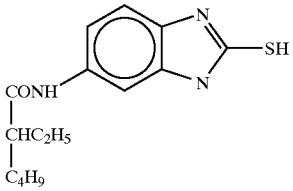

Preparation of Dispersion of Organic Solid Disperse Dye

The dye E-1 was dispersed by the following method. That is, water and 200 g of Pluronic F88 (ethylene oxide-propylene oxide block copolymer) manufactured by BASF CORP. were added to 1,430 g of a dye wet cake containing 30% of methanol, and the resultant material was stirred to form a slurry having a dye concentration of 30%. Subsequently, Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 liter/min for 8 hr (liter will also be referred to as "L" hereinafter). The beads were filtered away, and water was added to dilute the material to a dye concentration of 3%. After that, the material was heated to 90° C. for 10 hr for stabilization. The average grain size of the obtained fine dye grains was 0.60 $\mu$m. The grain size distribution (grain size standard deviation×100/average grain size) was 18%.

Following the same procedure as above, solid dispersions of the dyes E-2 and E-3 were obtained. The average grain sizes were found to be 0.54 and 0.56 $\mu$m, respectively.

Subsequently, samples 102 to 117 were formed following the same procedures as for sample 101 except that the silver halide amounts, coupler amounts, colloidal silver amounts, and photosensitive emulsion types and so on were changed as shown in Table 3. Note that the silver halide amounts were changed such that the types and ratios of emulsions in the individual layers were held constant.

Samples 115, 116, and 117 were formed by changing emulsions as shown in Table 1. Note that the sensitizing dye addition amounts were not changed.

TABLE 3

Construction of sample (blanks in this table signify no change was made from Sample 101)

| Sample | | | 4th layer | 5th layer | 6th layer | 9th layer | 10th layer | 11th layer | 15th layer | 16th layer | 17th layer | 2) Coated amount of silver halide (g) | 3) Silver halide amount at color development (g) |
|---|---|---|---|---|---|---|---|---|---|---|---|---|---|
| 101 | Comparison | Silver halide amount | 0.5 | 0.4 | 0.45 | 0.8 | 0.6 | 0.6 | 0.35 | 0.3 | 0.4 | 4.4 | 3 |
| | | Coupler | | | | | As described in the text | | | | | | |
| 102 | Comparison | Silver halide amount | | | | 0.7 | 0.5 | 0.5 | | | | 4.1 | 2.8 |
| | | Coupler | | | | A | A | A | | | | | |
| 103 | Invention | Silver halide amount | | | | 0.6 | 0.35 | 0.35 | | | | 3.7 | 2.5 |
| | | Coupler | | | | B | B | B | | | | | |
| 104 | Invention | Silver halide amount | 0.4 | 0.25 | 0.3 | 0.6 | 0.35 | 0.35 | | | | 3.3 | 2.2 |
| | | Coupler | C | C | C | B | B | B | | | | | |
| 105 | Invention | Silver halide amount | 0.4 | 0.25 | 0.3 | 0.8 | 0.6 | 0.6 | 0.2 | 0.2 | 0.25 | 3.6 | 2.4 |
| | | Coupler | C | C | C | | | | D | D | D | | |
| 106 | Invention | Silver halide amount | | | | 0.6 | 0.35 | 0.35 | | | | 3.7 | 2.5 |
| | | Coupler | | | | E | E | E | | | | | |
| 107 | Invention | Silver halide amount | 0.4 | 0.25 | 0.3 | 0.6 | 0.35 | 0.35 | | | | 3.3 | 2.2 |
| | | Coupler | F | F | F | E | E | E | | | | | |

TABLE 3-continued

Construction of sample (blanks in this table signify no change was made from Sample 101)

| Sample | | | 4th layer | 5th layer | 6th layer | 9th layer | 10th layer | 11th layer | 15th layer | 16th layer | 17th layer | 2) Coated amount of silver halide (g) | 3) Silver halide amount at color develop-ment (g) |
|---|---|---|---|---|---|---|---|---|---|---|---|---|---|
| 108 | Invention | Silver halide amount | 0.4 | 0.25 | 0.3 | 0.6 | 0.35 | 0.35 | 0.3 | 0.25 | 0.3 | 3.1 | 2.1 |
| | | Coupler | F | F | F | E | E | E | G | G | G | | |
| 109 | Invention | Silver halide amount | 0.4 | 0.25 | 0.3 | 0.6 | 0.35 | 0.35 | | | | 3.3 | 2.2 |
| | | Coupler | H | H | H | I | I | I | | | | | |
| 110 | Invention | Silver halide amount | 0.5 | 0.4 | 0.3 | 0.7 | 0.5 | 0.35 | | | | 3.8 | 2.3 |
| | | Yellow colloidal silver | 3 mg | 2 mg | | 5 mg | | | | | | | |
| | | Coupler | H | H | H | I | I | I | | | | | |
| 111 | Invention | Silver halide amount | 0.5 | 0.4 | 0.3 | 0.7 | 0.5 | 0.35 | | | | 3.8 | 2.3 |
| | | Fogged emulsion (A)[1] | 20 mg | 10 mg | | 20 mg | | | | | | | |
| | | Coupler | H | H | H | I | I | I | | | | | |
| 112 | Invention | Silver halide amount | 0.5 | 0.35 | 0.3 | 0.7 | 0.4 | 0.35 | | | | 3.65 | 2.3 |
| | | Yellow coloidal silver | 20 mg each was added to 3rd, 8th, and 13th layers | | | | | | | | | | |
| | | Coupler | H | H | H | I | I | I | | | | | |
| 113 | Invention | Silver halide amount | 0.4 | 0.25 | 0.3 | 0.6 | 0.35 | 0.35 | 0.3 | 0.25 | 0.3 | 3.1 | 2.2 |
| | | Fine grain silver halide (B)[4] | 5 mg | 2 mg | | 5 mg | 3 mg | | 2 mg | 2 mg | 4 mg | | |
| | | Coupler | H | H | H | I | I | I | G | G | G | | |
| 114 | Invention | Silver halide amount | 0.5 | 0.4 | 0.2 | 0.7 | 0.5 | 0.2 | | | | 3.5 | 1.9 |
| | | Yellow colloidal silver | 7 mg | 5 mg | | 8 mg | 3 mg | | | | | | |
| | | Coupler | J | J | J | K | K | K | | | | | |
| 115 | Comparison | Silver halide amount | 0.5 | 0.4 | 0.45 | 0.8 | 0.6 | 0.6 | | | | 4.4 | 3 |
| | | Coupler | As described in the text | | | | | | | | | | |
| 116 | Invention | Silver halide amount | 0.5 | 0.35 | 0.3 | 0.7 | 0.4 | 0.35 | | | | 3.65 | 2.3 |
| | | Yellow colloidal silver | 20 mg each was added to 3rd, 8th, and 13th layers | | | | | | | | | | |
| | | Coupler | H | H | H | I | I | I | | | | | |
| 117 | Invention | Silver halide amount | 0.5 | 0.35 | 0.3 | 0.7 | 0.4 | 0.35 | | | | 3.65 | 2.3 |
| | | Fine grain silver halide (B)[4] | 5 mg | 2 mg | | 10 mg | 5 mg | | | | | | |
| | | Yellow colloidal silver | 20 mg each was added to 3rd, 8th, and 13th layers | | | | | | | | | | |
| | | Coupler | H | H | H | I | I | I | | | | | |

note

[1]Fogged emulsion (A): silver iodobromide (silver iodide content: 1.0%, average equivalent-sphere diameter: 0.20 μm, cubic, surface and inner portion are fogged)

2) Silver halide content before first development (in terms of silver per $m^2$)

3) Silver halide content immediately before color development at unexposed portion per $m^2$)

[4]Fine grain silver halide (B): Silver bromide, average equivalent-sphere diameter: 0.06 μm cubic

TABLE 4

| Changes of coupler |
|---|
| A Couplers C-3 and C-4 were not changed, but the coated amounts were increased to 1.25 times. |
| B Couplers C-3 and C-4 were not changed, but the coated amounts were increased to 1.7 times. |
| C Couplers C-1 and C-2 were not changed, but the coated amounts were increased to 1.5 times. |
| D Couplers C-5 and C-6 were not changed, but the coated amounts were increased to 1.6 times. |
| E Couplers C-3 and C-4 were replaced by an equimolar amount of coupler 2M-2. The amount of high-boiling organic solvent Oil-2 in the layer was added so that the weight ratio became 0.5 times the coupler. |
| F Coupler C-1 was replaced by an equimolar amount of coupler 2C-(10), and coupler C-2 was replaced by an equimolar amount of 2C-(8). |
| G couplers C-5 and C-6 were not changed but the coated amounts were increased to 1.3 times. |
| H Couplers C-1 and C-2 were replaced by coupler (CC-4) in an amount of 60 mol % of couplers C-1 and C-2. High-boiling organic solvent Oil-2 in the layer was added so that the weight ratio became 0.2 times the coupler. |
| I Couplers C-3 and C-4 were replaced by coupler MC-42 in an amount of 65 mol % of couplers C-3 and C-4. High-boiling organic solvent Oil-2 in the layer was added so that the weight ratio became 0.1 times the coupler. |
| J Couplers C-1 and C-2 were replaced by coupler (CC-10) in an amount of 60 mol % of couplers C-1 and C-2. High-boiling organic solvent Oil-2 in the layer was added so that the weight ratio became 0.2 times the coupler. |
| K Couplers C-3 and C-4 were replaced by coupler MC-4 in an amount of 65 mol % of couplers C-3 and C-4. High-boiling organic solvent Oil-2 in the layer was added so that the weight ratio became 0.5 times the coupler. |

A development process shown below was named (development A).

| Processing Step | Time | Temperature | Tank volume | Replenishment rate |
|---|---|---|---|---|
| 1st development | 6 min | 38° C. | 12 L | 2,200 mL/m$^2$ |
| 1st washing | 2 min | 38° C. | 4 L | 7,500 mL/m$^2$ |
| Reversal | 2 min | 38° C. | 4 L | 1,100 mL/m$^2$ |
| Color development | 6 min | 38° C. | 12 L | 2,200 mL/m$^2$ |
| Pre-bleaching | 2 min | 38° C. | 4 L | 1,100 mL/m$^2$ |
| Bleaching | 6 min | 38° C. | 12 L | 220 mL/m$^2$ |
| Fixing | 4 min | 38° C. | 8 L | 1,100 mL/m$^2$ |
| 2nd washing | 4 min | 38° C. | 8 L | 7,500 mL/m$^2$ |
| Final rinsing | 1 min | 25° C. | 2 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid-pentasodium salt | 1.5 g | 1.5 g |
| Diethylenetriamine pentaacetic acid-pentasodium salt | 2.0 g | 2.0 g |
| Sodium sulfite | 30 g | 30 g |
| Hydro quinone-potassium monosulfonate | 20 g | 20 g |
| Potassium carbonate | 15 g | 20 g |
| Sodium bicarbonate | 12 g | 15 g |
| 1-phenyl-4-methyl-4-hydroxymethyl-3-pyrazolidone | 1.5 g | 2.0 g |

-continued

| <1st developer> | <Tank solution> | <Replenisher> |
|---|---|---|
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid pentasodium salt | 3.0 g | the same as tank solution |
| Stannous chloride-dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid pentasodium salt | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfon amidoethyl)-3-methyl-4 aminoaniline-3/2 sulfuric acid-monohydrate | 11 g | 11 g |
| 3,6-dithiaoctane-1,8-diol | 1.0 g | 1.0 g |
| water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid-disodium salt-dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.30 | 6.10 |

The pH was adjusted by acetic acid or sodium hydroxide.

| <Bleaching solution> | <Tank solution> | <Replenisher> |
|---|---|---|
| Ethylenediaminetetraacetic acid-disodium salt dihydrate | 2.0 g | 4.0 g |
| Ethylenediaminetetraacetic acid-Fe(III)-ammonium-dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | do |
| Sodium bisulfite | 5.0 g | do |
| Water to make | 1,000 mL | do |
| pH | 6.60 | |

The pH was adjusted by acetic acid or ammonia water.

| <Final rinsing> | <Tank solution> | <Replenisher> |
|---|---|---|
| 1,2-benzoisothiazoiine-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

(Development B) was the same as (development A) except the replenishment rate of color development was 900 mL. In the above development process, the solution was continuously circulated and stirred in each bath. Also, a bubbling pipe having small holes 0.3 mm in diameter at intervals of 1 cm was placed on the lower surface of each tank to continuously bubble nitrogen gas to stir the solution.

(Evaluation of Samples)

(Evaluation of Suitability to Reduction of Replenishment Amount and Shortening of Processing Time of Color Development)

Samples 101 to 117 were formed into strips, exposed to white light at a color temperature of 4,800 K via a wedge having a continuously changing density, and subjected to (development A).

In this (development A), a sample completely exposed 40% in area of each of samples 101 to 117 was processed until the replenisher volume of color development of (development A) was 30 times the tank solution. After that, each continuously exposed strip was processed, and its maximum cyan density was measured as DCA. Similarly, DCB was measured in (development B). DCB−DCA was calculated to obtain $DC_6$. The values are shown in Table 5. Smaller $DC_6$ values are more preferable because the smaller the value of $DC_6$, the smaller the performance deterioration when the replenishment of color development was reduced.

Furthermore, the same comparison was performed, except that the color development time was set to 2 min, and DCB−DCA was calculated to obtain $DC_2$.

Also, sample 101 was processed with a solution subjected to the above running processing using sample 114. The result is described as sample 201 in Table 5.

(Evaluation of Processing Nonuniformity)

Each sample was cut into a width of 10 cm and a length of 30 cm, and the entire surface was evenly exposed (given exposure by which the neutral gray density was 0.8). In (development A), nitrogen bubbling stirring in color development was stopped, and the color development time was set to 3 min. The rest was the same as described above.

The density on the entire surface of each processed sample was measured to observe density nonuniformity. At each point, the magenta density and cyan density were measured. Table 5 shows the absolute value of (magenta density)−(cyan density) in a portion where the difference between the magenta density and cyan density was a maximum. Smaller values are more preferable because color nonuniformity produced by the processing was small. The yellow, magenta, and cyan densities (status A) of any sample were higher than 3.0.

TABLE 5

Evaluation of results

| Sample | | $DC_6$ Difference of cyan maximum densities obtained by developments A and B: color-developing time: 6 min | $DC_2$ Difference of cyan maximum densities obtained by developments A and B: color-developing time: 2 min | Processing nonuniformity (Nonuniformity in color = magenta density-cyan density) Development A, developing time: 3 min |
|---|---|---|---|---|
| 101 | Comparison | 0.20 | 0.78 | 0.20 |
| 102 | Comparison | 0.15 | 0.60 | 0.18 |
| 103 | Invention | 0.12 | 0.25 | 0.10 |
| 104 | Invention | 0.10 | 0.24 | 0.10 |
| 105 | Invention | 0.10 | 0.25 | 0.11 |
| 106 | Invention | 0.08 | 0.18 | 0.08 |
| 107 | Invention | 0.04 | 0.13 | 0.07 |
| 108 | Invention | 0.04 | 0.12 | 0.06 |
| 109 | Invention | 0.03 | 0.10 | 0.06 |
| 110 | Invention | 0.03 | 0.08 | 0.04 |
| 111 | Invention | 0.04 | 0.09 | 0.06 |
| 112 | Invention | 0.04 | 0.09 | 0.06 |
| 113 | Invention | 0.03 | 0.05 | 0.02 |
| 114 | Invention | 0.02 | 0.05 | 0.04 |
| 115 | Comparison | 0.20 | 0.76 | 0.18 |

TABLE 5-continued

| Sample | | $DC_6$ Difference of cyan maximum densities obtained by developments A and B: color-developing time: 6 min | $DC_2$ Difference of cyan maximum densities obtained by developments A and B: color-developing time: 2 min | Processing nonuniformity (Nonuniformity in color = magenta density-cyan density) Development A, developing time: 3 min |
|---|---|---|---|---|
| 116 | Invention | 0.03 | 0.06 | 0.05 |
| 117 | Invention | 0.02 | 0.04 | 0.01 |
| 201 | Invention | 0.18 | 0.70 | 0.20 |

As shown in Table 5, comparative sample 101 or 102 had a problem of a large difference between development A and development B. This was particularly significant when the development time was shortened. Also, color nonuniformity produced by the processing was large.

In contrast, each sample in which the silver halide content before color development was reduced to the range of the present invention prevented the density reduction and greatly reduced the processing nonuniformity.

In each of samples 101 and 102, $DC_2$ was about 4 times as large as $DC_6$. By contrast, in each sample of the present invention, the deterioration was within the range of 3 times. This indicates that the problem when color development was shortened was improved. This is outstanding compared to the case (sample 201) in which even when the running processing was performed using the sample of the present invention, the degree of improvement was slight when comparative sample 101 was processed.

Of the samples of the present invention, the improving effect was large in sample 106 and subsequent samples, particularly sample 109 and subsequent samples, using couplers preferable in the present invention.

Also, comparison of samples 115 to 117 in each of which the ratio of tabular grains of emulsion grains in the photosensitive material was increased shows that the effect of the present invention was remarkably large when the ratio of tabular grains was large.

Furthermore, the occurrence of processing nonuniformity was particularly little and the results were favorable in samples 110, 111, 113, and 117 in each of which colloidal silver grains, fogged emulsion grains, or fine silver halide grains were added to photosensitive emulsion layers.

EXAMPLE-2

Samples 301 to 314 were formed following the same procedures as for samples 101 to 114 in Example-1 except that the emulsions A to P were changed to 2A to 2P, respectively, such that A was changed to 2A, B was changed to 2B, and so on, as shown in Table 6.

TABLE 6

Emulsions used in Samples 301 to 314

| Emulsion | Characteristics | Average equivalent-sphere diameter (μm) | Coefficient of variation (%) | AgI content (%) |
|---|---|---|---|---|
| 2A | Monodisperse (111) tabular grain Average aspect ratio 2.5 | 0.30 | 15 | 3.0 |
| 2B | Monodisperse (111) tabular grain Average aspect ratio 2.5 | 0.35 | 12 | 3.5 |
| 2C | Monodisperse (111) tabular grain Average aspect ratio 3.5 | 0.55 | 15 | 3.0 |
| 2D | Monodisperse (111) tabular grain Average aspect ratio 3.5 | 0.70 | 12 | 4.0 |
| 2E | Monodisperse (111) tabular grain Average aspect ratio 4.5 | 0.90 | 15 | 3.0 |
| 2F | Monodisperse (111) tabular grain Average aspect ratio 5.0 | 1.20 | 12 | 3.5 |
| 2G | Monodisperse cubic grain | 0.30 | 10 | 4.0 |
| 2H | Monodisperse (111) tabular grain Average aspect ratio 2.5 | 0.40 | 12 | 4.0 |
| 2I | Monodisperse (111) tabular grain Average aspect ratio 3.0 | 0.55 | 12 | 3.0 |
| 2J | Monodisperse (111) tabular grain Average aspect ratio 3.0 | 0.70 | 15 | 2.5 |
| 2K | Monodisperse (111) tabular grain Average aspect ratio 6.0 | 1.05 | 13 | 2.5 |
| 2L | Monodisperse (111) tabular grain Average aspect ratio 3.5 | 0.45 | 10 | 5.0 |
| 2M | Monodisperse (111) tabular grain Average aspect ratio 4.0 | 0.50 | 12 | 4.0 |
| 2N | Monodisperse (111) tabular grain Average aspect ratio 5.5 | 0.80 | 15 | 2.0 |

TABLE 6-continued

Emulsions used in Samples 301 to 314

| Emulsion | Characteristics | Average equivalent-sphere diameter (μm) | Coefficient of variation (%) | AgI content (%) |
|---|---|---|---|---|
| 2O | Monodisperse (111) tabular grain Average aspect ratio 8.0 | 0.10 | 15 | 1.0 |
| 2P | Monodisperse (111) tabular grain Average aspect ratio 10.0 | 1.90 | 15 | 0.8 |

(Same sensitizing dyes were added to Emulsions 2A to 2P as for Emulsions A to P, respectively, so that the molar ratio of the dye to silver become equal)

When these samples 301 to 314 were tested in the same manner as in Example-1, the samples of the present invention gave favorable results.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color reversal photosensitive material comprising at least one blue-sensitive emulsion layer, at least one green-sensitive emulsion layer, and at least one red-sensitive emulsion layer on a transparent support, and capable of forming a color image when the photosensitive material was subjected to color development in the presence of an aromatic primary amine color developing agent after the photosensitive material was subjected to first development of black-and-white development, wherein the silver halide content in the photosensitive material before the first development is 2.5 to 6.0 g in terms of silver per $m^2$ of the photosensitive material, the silver halide content in an unexposed portion of the photosensitive material immediately before the color development is 1.0 to 2.5 g in terms of silver per $m^2$ of the photosensitive material, and the maximum density of each of cyan, magenta, and yellow in the color image after the color development is 3.0 or more.

2. The color reversal photosensitive material according to claim 1, wherein at least one of the green- and red-sensitive emulsion layers contains a 2-equivalent coupler, and the molar ratio of the 2-equivalent coupler to all image-forming couplers contained in the photosensitive emulsion layer is 30% to 100%.

3. The color reversal photosensitive material according to claim 1, wherein the photosensitive material contains at least one magenta coupler represented by formula (MC-I) below or at least one cyan coupler represented by formula (CC-I) below, and the molar ratio of the coupler to all image-forming couplers contained in the photosensitive emulsion layer containing the magenta coupler or the cyan coupler is 30% to 100%:

(MC-I)

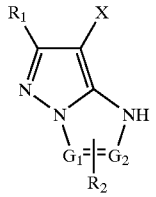

wherein $R_1$ represents a hydrogen atom or a substituent; one of $G_1$ and $G_2$ represents a carbon atom, the other of $G_1$ and $G_2$ represents a nitrogen atom; $R_2$ represents a substituent and bounds to one of $G_1$ and $G_2$ which is a carbon atom, provided that $R_1$ and $R_2$ can further have a substituent, and a polymer of formula (MC-I) can be formed via $R_1$ or $R_2$, or the coupler represented by formula (MC-I) can bond to a polymeric chain via $R_1$ or $R_2$; and X represents a hydrogen atom or a group which splits off by a coupling reaction with an oxidized form of the aromatic primary amine color developing agent;

(CC-I)

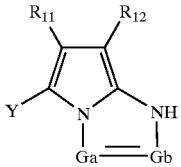

wherein $G_a$ represents —C($R_{13}$)═ or —N═, provided that when $G_a$ represents —N═, $G_b$ represents —C($R_{13}$)═, and when $G_a$ represents —C($R_{13}$)═, $G_b$ represents —N═, wherein $R_{13}$ represents a substituent; each of $R_{11}$ and $R_{12}$ represents an electron attracting group having a Hammett substituent constant σp value of 0.20 to 1.0; Y represents a hydrogen atom or a group which splits off by a coupling reaction with the oxidized form of the aromatic primary amine color developing agent.

4. A color image forming method comprising a step of black-and-white development, a step of reversal processing and then a step of color development, wherein the photosensitive material according to claim 1 is subjected to the step of color development with a development time of 1 to 5 min.

5. A color image forming method comprising a step of black-and-white development, a step of reversal processing and then a step of color development, wherein the photosensitive material according to claim 2 is subjected to the step of color development with a development time of 1 to 5 min.

6. A color image forming method comprising a step of black-and-white development, a step of reversal processing and then a step of color development, wherein the photosensitive material according to claim 3 is subjected to the step of color development with a development time of 1 to 5 min.

7. A color image forming method comprising a step of black-and-white development, a step of reversal processing and then a step of color development, wherein the photosensitive material according to claim 1 is subjected to the step of color development in which a replenishment amount of a color developer is set to 1.0 L or less per $m^2$ of a processing area of the photosensitive material.

8. A color image forming method comprising a step of black-and-white development, a step of reversal processing and then a step of color development, wherein the photosensitive material according to claim 2 is subjected to the step of color development in which a replenishment amount of a color developer is set to 1.0 L or less per $m^2$ of a processing area of the photosensitive material.

9. A color image forming method comprising a step of black-and-white development, a step of reversal processing and then a step of color development, wherein the photosensitive material according to claim 3 is subjected to the step of color development in which a replenishment amount of a color developer is set to 1.0 L or less per $m^2$ of a processing area of the photosensitive material.

10. The color reversal photosensitive material according to claim 2, wherein the photosensitive material further comprises at least one layer containing silver halide grains having substantially no photosensitivity.

11. The color reversal photosensitive material according to claim 3, wherein the photosensitive material further comprises at least one layer containing silver halide grains having substantially no photosensitivity.

12. The color reversal photosensitive material according to claim 10, wherein the silver halide grains having substantially no photosensitivity are fine silver halide grains having an average equivalent-sphere diameter of 0.02 $\mu$m to less than 0.15 $\mu$m.

13. The color reversal photosensitive material according to claim 11, wherein the silver halide grains having substantially no photosensitivity are fine silver halide grains having an average equivalent-sphere diameter of 0.02 $\mu$m to less than 0.15 $\mu$m.

14. The color reversal photosensitive material according to claim 12, wherein the fine silver halide grains having substantially no photosensitivity are unfogged and are silver iodobromide or silver bromochloroiodide whose iodide content is 1% to 20%, or silver bromide.

15. The color reversal photosensitive material according to claim 13, wherein the fine silver halide grains having substantially no photosensitivity are unfogged and are silver iodobromide or silver bromochloroiodide whose iodide content is 1% to 20%, or silver bromide.

16. The color reversal photosensitive material according to claim 2, wherein 70% or more in terms of silver of all the photosensitive silver halide grains are tabular grains having an aspect ratio of 2 or more.

17. The color reversal photosensitive material according to claim 3, wherein 70% or more in terms of silver of all the photosensitive silver halide grains are tabular grains having an aspect ratio of 2 or more.

18. The color reversal photosensitive material according claim 16, wherein the photosensitive material further comprises at least one layer containing silver halide grains having substantially no photosensitivity and having an average equivalent-sphere diameter of 0.02 $\mu$m to less than 0.15 $\mu$m.

19. The color reversal photosensitive material according claim 17, wherein the photosensitive material further comprises at least one layer containing silver halide grains having substantially no photosensitivity and having an average equivalent-sphere diameter of 0.02 $\mu$m to less than 0.15 $\mu$m.

* * * * *